US007867063B2

(12) United States Patent
Togawa et al.

(10) Patent No.: US 7,867,063 B2
(45) Date of Patent: Jan. 11, 2011

(54) SUBSTRATE HOLDING APPARATUS AND POLISHING APPARATUS

(75) Inventors: Tetsuji Togawa, Tokyo (JP); Hiroshi Yoshida, Tokyo (JP); Osamu Nabeya, Tokyo (JP); Makoto Fukushima, Tokyo (JP); Koichi Fukaya, Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 12/453,598

(22) Filed: May 15, 2009

(65) Prior Publication Data

US 2009/0233532 A1 Sep. 17, 2009

Related U.S. Application Data

(62) Division of application No. 12/073,430, filed on Mar. 5, 2008, which is a division of application No. 10/543,546, filed as application No. PCT/JP2004/001143 on Feb. 4, 2004, now Pat. No. 7,357,699.

(30) Foreign Application Priority Data

Feb. 10, 2003 (JP) ..... 2003-033015
Jun. 6, 2003 (JP) ..... 2003-163051
Jun. 6, 2003 (JP) ..... 2003-163052

(51) Int. Cl.
*B24B 7/22* (2006.01)

(52) U.S. Cl. ..... 451/288; 451/388; 451/398

(58) Field of Classification Search ..... 451/287, 451/288, 388, 398, 41
See application file for complete search history.

(56) References Cited

U.S. PATENT DOCUMENTS 4,256,535 A 3/1981 Banks
4,918,869 A 4/1990 Kitta
5,584,751 A 12/1996 Kobayashi et al.
5,624,299 A 4/1997 Shendon
5,913,718 A 6/1999 Shendon (Continued)

FOREIGN PATENT DOCUMENTS

CN 1274949 11/2000

(Continued)

OTHER PUBLICATIONS

International Search Report issued May 13, 2004 in the International (PCT) Application No. PCT/JP2004/001143 of which the grandparent of the present application is the U.S. National Stage (U.S. Appl. No. 10/543,546).

(Continued)

*Primary Examiner*—Robert Rose
(74) *Attorney, Agent, or Firm*—Wenderoth, Lind & Ponack, L.L.P.

(57) ABSTRACT

A substrate holding apparatus is for holding a substrate such as a semiconductor wafer in a polishing apparatus for polishing the substrate to a flat finish. The substrate holding apparatus comprises a vertically movable member, and an elastic member for defining a chamber. The elastic member comprises a contact portion which is brought into contact with the substrate, and a circumferential wall extending upwardly from the contact portion and connected to the vertically movable member. The circumferential wall has a stretchable and contractible portion which is stretchable and contractible vertically.

20 Claims, 29 Drawing Sheets

U.S. PATENT DOCUMENTS

| | | | | |
|---|---|---|---|---|
| 5,938,884 | A | 8/1999 | Hoshizaki et al. | |
| 5,964,653 | A | 10/1999 | Perlov et al. | |
| 5,985,094 | A | 11/1999 | Mosca | |
| 6,056,632 | A | 5/2000 | Mitchel et al. | |
| 6,080,050 | A | 6/2000 | Chen et al. | |
| 6,106,379 | A | 8/2000 | Mosca | |
| 6,110,026 | A | 8/2000 | Arai | |
| 6,132,298 | A | 10/2000 | Zuniga et al. | |
| 6,159,079 | A | 12/2000 | Zuniga et al. | |
| 6,162,116 | A | 12/2000 | Zuniga et al. | |
| 6,183,354 | B1 | 2/2001 | Zuniga et al. | |
| 6,210,255 | B1 | 4/2001 | Zuniga et al. | |
| 6,225,224 | B1 | 5/2001 | Pandey et al. | |
| 6,241,593 | B1 * | 6/2001 | Chen et al. | 451/288 |
| 6,244,942 | B1 | 6/2001 | Zuniga | |
| 6,277,010 | B1 | 8/2001 | Perlov et al. | |
| 6,277,014 | B1 | 8/2001 | Chen et al. | |
| 6,358,121 | B1 | 3/2002 | Zuniga | |
| 6,361,420 | B1 | 3/2002 | Zuniga et al. | |
| 6,406,361 | B1 | 6/2002 | Zuniga et al. | |
| 6,443,823 | B1 | 9/2002 | Tolles et al. | |
| 6,645,044 | B2 | 11/2003 | Zuniga | |
| 6,676,497 | B1 | 1/2004 | Chen et al. | |
| 6,722,965 | B2 | 4/2004 | Zuniga et al. | |
| 6,852,019 | B2 | 2/2005 | Togawa et al. | |
| 6,857,945 | B1 * | 2/2005 | Chen et al. | 451/288 |
| 6,890,402 | B2 | 5/2005 | Gunji et al. | |
| 7,033,260 | B2 | 4/2006 | Togawa et al. | |
| 7,255,771 | B2 | 8/2007 | Chen et al. | |
| 7,311,585 | B2 | 12/2007 | Togawa et al. | |
| 7,632,173 | B2 | 12/2009 | Togawa et al. | |
| 7,635,292 | B2 | 12/2009 | Togawa et al. | |
| 2002/0081955 | A1 | 6/2002 | Numoto | |
| 2002/0086624 | A1 | 7/2002 | Zuniga et al. | |
| 2003/0171076 | A1 | 9/2003 | Moloney et al. | |

FOREIGN PATENT DOCUMENTS

| | | |
|---|---|---|
| EP | 0 859 399 | 8/1998 |
| JP | 10-180627 | 7/1998 |
| JP | 10-270538 | 10/1998 |
| JP | 2000-127026 | 5/2000 |
| JP | 2000-167762 | 6/2000 |
| JP | 2000-301452 | 10/2000 |
| JP | 2001-38604 | 2/2001 |
| JP | 2001-54855 | 2/2001 |
| JP | 2002-096261 | 4/2002 |
| JP | 2002-187060 | 7/2002 |
| JP | 2002-198337 | 7/2002 |
| JP | 2002-198339 | 7/2002 |
| JP | 2002-527894 | 8/2002 |
| JP | 2002-530876 | 9/2002 |
| JP | 2003-025214 | 1/2003 |
| JP | 2004-165175 | 6/2004 |
| WO | 00/21715 | 4/2000 |
| WO | 02/07931 | 1/2002 |

OTHER PUBLICATIONS

Supplementary European Search Report issued Jul. 21, 2008 in European Application No. 04 70 8039.

Korean Prior Art Search Report (with English Translation) issued Jun. 25, 2009 in Korean Patent Application No. 10-2009-7010306, which is a foreign counterpart of the present application.

U.S. Appl. No. 12/613,016 (unpublished).

Japanese Office Action (and English translation thereof) issued Sep. 8, 2009 in Japanese Application 2003-163051 which is a foreign counterpart of the present application.

* cited by examiner

SUBSTRATE HOLDING APPARATUS AND POLISHING APPARATUS

This application is a divisional of U.S. application Ser. No. 12/073,430 filed Mar. 5, 2008, which is a divisional of U.S. application Ser. No. 10/543,546 filed Jul. 27, 2005, now U.S. Pat. No. 7,357,699, which is the National Stage of International Application No. PCT/JP2004/001143, filed Feb. 4, 2004.

TECHNICAL FIELD

The present invention relates to a substrate holding apparatus for holding a substrate to be polished and pressing the substrate against a polishing surface, and more particularly to a substrate holding apparatus for holding a substrate such as a semiconductor wafer in a polishing apparatus for polishing the substrate to a flat finish. The present invention also relates to a polishing apparatus having such a substrate holding apparatus.

BACKGROUND ART

In recent years, semiconductor devices have become more integrated, and structures of semiconductor elements have become more complicated. Further, a number of layers in multilayer interconnections used for a logical system has been increased. Accordingly, irregularities on a surface of a semiconductor device become increased, so that step heights on the surface of the semiconductor device tend to be larger. This is because, in a manufacturing process of a semiconductor device, a thin film is formed on a semiconductor device, then micromachining processes, such as patterning or forming holes, are performed on the semiconductor device, and these processes are repeated many times to form subsequent thin films on the semiconductor device.

When a number of irregularities is increased on a surface of a semiconductor device, the following problems arise. A thickness of a film formed in a portion having a step is relatively small when a thin film is formed on a semiconductor device. An open circuit is caused by disconnection of interconnections, or a short circuit is caused by insufficient insulation between interconnection layers. As a result, good products cannot be obtained, and a yield tends to be reduced. Further, even if a semiconductor device initially works normally, reliability of the semiconductor device is lowered after long-term use. At a time of exposure in a lithography process, if an irradiation surface has irregularities, then a lens unit in an exposure system is locally unfocused. Therefore, if the irregularities of the surface of the semiconductor device are increased, then it becomes problematic in that it is difficult to form a fine pattern itself on the semiconductor device.

Accordingly, in a manufacturing process of a semiconductor device, it increasingly becomes important to planarize a surface of the semiconductor device. A most important one of planarizing technologies is CMP (Chemical Mechanical Polishing). In chemical mechanical polishing, with use of a polishing apparatus, while a polishing liquid containing abrasive particles such as silica ($SiO_2$) therein is supplied onto a polishing surface such as a polishing pad, a substrate such as a semiconductor wafer is brought into sliding contact with the polishing surface, so that the substrate is polished.

This type of polishing apparatus comprises a polishing table having a polishing surface constituted by a polishing pad, and a substrate holding apparatus, which is called a top ring or a carrier head, for holding a semiconductor wafer. When a semiconductor wafer is polished with such a polishing apparatus, the semiconductor wafer is held and pressed against the polishing table under a predetermined pressure by the substrate holding apparatus. At this time, the polishing table and the substrate holding apparatus are moved relatively to each other to bring the semiconductor wafer into sliding contact with the polishing surface, so that a surface of the semiconductor wafer is polished to a flat mirror finish.

In such a polishing apparatus, if a relative pressing force between the semiconductor wafer being polished and the polishing surface of the polishing pad is not uniform over an entire surface of the semiconductor wafer, then the semiconductor wafer may insufficiently be polished or may excessively be polished at some portions depending on a pressing force applied to those portions of the semiconductor wafer. Therefore, it has been attempted to form a surface, for holding a semiconductor wafer, of a substrate holding apparatus by an elastic membrane made of an elastic material such as rubber, and to supply fluid pressure such as air pressure to a backside surface of the elastic membrane to unformize pressing forces applied to the semiconductor wafer over an entire surface of the semiconductor wafer.

Further, the polishing pad is so elastic that pressing forces applied to a peripheral portion of the semiconductor wafer being polished become non-uniform, and hence only the peripheral portion of the semiconductor wafer may excessively be polished, which is referred to as "edge rounding". In order to prevent such edge rounding, there has been used a substrate holding apparatus in which a semiconductor wafer is held at its peripheral portion by a guide ring or a retainer ring, and an annular portion of the polishing surface that corresponds to the peripheral portion of the semiconductor wafer is pressed by the guide ring or retainer ring.

A conventional substrate holding apparatus will be described below with reference to FIGS. 29A and 29B. FIGS. 29A and 29B are fragmentary cross-sectional views showing a conventional substrate holding apparatus.

As shown in FIG. 29A, the substrate holding apparatus has a top ring body 2, a chucking plate 6 housed in the top ring body 2, and an elastic membrane 80 attached to the chucking plate 6. The elastic membrane 80 is disposed on an outer circumferential portion of the chucking plate 6, and is brought into contact with a circumferential edge of a semiconductor wafer W. An annular retainer ring 3 is fixed to a lower end of the top ring body 2, and presses a polishing surface near the outer circumferential edge of the semiconductor wafer W.

The chucking plate 6 is mounted on the top ring body 2 through an elastic pressurizing sheet 13. The chucking plate 6 and the elastic membrane 80 are vertically moved in a certain range with respect to the top ring body 2 and the retainer ring 3 by fluid pressure. The substrate holding apparatus having such a structure is referred to as a so-called floating-type substrate holding apparatus. A pressure chamber 130 is defined by the elastic membrane 80, a lower surface of the chucking plate 6, and an upper surface of the semiconductor wafer W. A pressurized fluid is supplied into the pressure chamber 130, thereby lifting the chucking plate 6 and simultaneously pressing the semiconductor wafer W against a polishing surface. In this state, a polishing liquid is supplied onto the polishing surface, and a top ring (the substrate holding apparatus) and the polishing surface are rotated independently of each other, thus polishing a lower surface of the semiconductor wafer W to a flat finish.

After this polishing process is finished, the semiconductor wafer W is attracted under vacuum and held by the top ring. The top ring is moved to a transfer position while holding the semiconductor wafer W, and then a fluid (e.g., a pressurized fluid or a mixture of nitrogen and pure water) is ejected from a lower portion of the chucking plate 6 so as to release the semiconductor wafer W.

However, in the conventional floating-type substrate holding apparatus described above, when the chucking plate 6 is moved upwardly for pressing the semiconductor wafer W, the elastic membrane 80, which is held in contact with an outer circumferential edge of the semiconductor wafer W, is lifted by the chucking plate 6, thus causing an outer circumferential edge of the elastic membrane 80 to be brought out of contact with the semiconductor wafer W. Consequently, a pressing force applied to the semiconductor wafer W is locally changed at the outer circumferential edge of the semiconductor wafer W. As a result, a polishing rate is lowered at the outer circumferential edge of the semiconductor wafer W and is increased at a region located radially inwardly of the outer circumferential edge of the semiconductor wafer W.

As a hardness of the elastic membrane becomes higher, such a problem becomes worse. Therefore, it has been attempted to use an elastic membrane having a low hardness so that a contact area between the elastic membrane and the semiconductor wafer is kept constant. However, in the floating-type substrate holding apparatus, the semiconductor wafer W is polished while the retainer ring 3 is held in sliding contact with the polishing surface. Accordingly, the retainer ring 3 tends to wear with time, resulting in a reduction in a distance between the semiconductor wafer W and the chucking plate 6 (see FIG. 29B). Consequently, a pressing force applied to the outer circumferential edge of the semiconductor wafer W is changed, and hence the polishing rate is changed at the outer circumferential edge of the semiconductor wafer W, thus causing a change in a polishing profile. Further, because of such a drawback, it is necessary to replace a worn retainer ring at an early stage, and hence a lifetime of the retainer ring is limited to a short period.

In addition to the above problem, the conventional substrate holding apparatus has another problem as follows: When a polishing process is to be started, pressurized fluid is supplied to the pressure chamber while the elastic membrane and the semiconductor wafer may not be sufficiently held in close contact with each other. As a result, the pressurized fluid is liable to leak from a gap between the elastic membrane and the semiconductor wafer.

Further, in a process of releasing the semiconductor wafer from the top ring, the following problem arises: If a film of nitride or the like is formed on a backside surface (upper surface) of the semiconductor wafer, then the elastic membrane and the semiconductor wafer adhere to each other. Therefore, when releasing the semiconductor wafer, the elastic membrane may not be brought out of contact with the semiconductor wafer. In this state, if a pressurized fluid is continuously ejected to the semiconductor wafer, the elastic membrane is stretched while keeping contact with the semiconductor wafer. As a result, the semiconductor wafer is deformed, or broken at worst, due to a fluid pressure.

Furthermore, still another problem arises in the conventional substrate holding apparatus as follows: The pressure chamber constituted by the elastic membrane is deformed due to a fluid pressure. Therefore, the elastic membrane is locally brought out of contact with the semiconductor wafer as the pressurized fluid is supplied to the pressure chamber. Consequently, a pressing force applied to the semiconductor wafer is locally lowered, and hence a uniform polishing rate cannot be obtained over an entire polished surface of the semiconductor wafer.

As a hardness of the elastic membrane becomes higher, such a problem becomes worse. Therefore, as already described, it has been attempted to use an elastic membrane having a low hardness so that a contact area between the elastic membrane and the semiconductor wafer is kept constant. However, because the elastic membrane having a low hardness has a low mechanical strength, the elastic membrane tends to suffer cracking, and is thus required to be replaced frequently.

SUMMARY OF THE INVENTION

The present invention has been made in view of the above drawbacks. According to the present invention, there is provide a substrate holding apparatus for applying a pressing force to a substrate by supplying a pressurized fluid to a space defined by an elastic membrane. The substrate holding apparatus is constructed to process the substrate stably during all processes including a substrate polishing process and a substrate releasing process. Specifically, it is a first object of the present invention to provide a substrate holding apparatus which can apply a uniform pressing force to an entire surface of a substrate so as to obtain a uniform polishing profile over the entire surface of the substrate, and a polishing apparatus having such a substrate holding apparatus. It is a second object of the present invention to provide a substrate holding apparatus which can quickly release a substrate, and a polishing apparatus having such a substrate holding apparatus. It is a third object of the present invention to provide a substrate holding apparatus which can obtain a uniform polishing rate over an entire polished surface of a substrate, and a polishing apparatus having such a substrate holding apparatus.

In order to achieve the above objects, according to one aspect of the present invention, there is provided a substrate holding apparatus for holding and pressing a substrate to be polished against a polishing surface, the substrate holding apparatus comprising: a vertically movable member; and an elastic member connected to the vertically movable member for defining a chamber. The elastic member comprises a contact portion which is brought into contact with the substrate, and a circumferential wall or part extending upwardly from the contact portion and connected to the vertically movable member, with the circumferential wall having a stretchable (extendible) and contractible portion which is stretchable (extendible) and contractible vertically.

In a preferred aspect of the present invention, the circumferential wall or part comprises an outer circumferential wall, and an inner circumferential wall disposed radially inwardly of the outer circumferential wall, wherein at least one of the outer circumferential wall and the inner circumferential wall has the stretchable and contractible portion, and the contact portion is divided at a position between the outer circumferential wall and the inner circumferential wall.

With the present invention having the above structure, since the stretchable and contractible portion is vertically stretched as the vertically movable member (chucking plate) is moved upwardly, the contact portion, which is held in contact with the substrate, can maintain its shape. Therefore, a contact area between the elastic member and the substrate can be kept constant, and hence it is possible to obtain a uniform pressing force over the entire surface of the substrate.

Even if a retainer ring is worn to cause a change in a distance between the vertically movable member and the substrate, the stretchable and contractible portion is contracted so as to follow the change of the distance. Therefore, the contact portion, which is held in contact with the substrate, can maintain its shape. Consequently, it is possible to press the substrate under a uniform pressure over an entire surface from a center of the substrate to a circumferential edge thereof, thus achieving a uniform polishing rate, i.e. polishing profile, over the entire surface of the substrate. Furthermore, since the stretchable and contractible portion is contracted in accordance with wear of the retainer ring, a worn retainer ring can be used without being replaced.

In a preferred aspect of the present invention, the circumferential wall has a folded portion to form the stretchable and contractible portion.

In a preferred aspect of the present invention, the folded portion has a substantially arcuate cross section.

With this structure, the stretchable and contractible portion can be stretched smoothly downwardly.

In a preferred aspect of the present invention, the stretchable and contractible portion is made of a material softer than the contact portion.

In a preferred aspect of the present invention, a predetermined portion of the circumferential wall is thinner than the contact portion to form the stretchable and contractible portion.

In a preferred aspect of the present invention, the circumferential wall has a portion made of a material harder than the contact portion and positioned below the stretchable and contractible portion.

In a preferred aspect of the present invention, the circumferential wall has a portion which is thicker than the contact portion and positioned below the stretchable and contractible portion.

In a preferred aspect of the present invention, a hard member harder than the elastic member is embedded in the circumferential wall, and the hard member is positioned below the stretchable and contractible portion.

In a preferred aspect of the present invention, a hard member harder than the elastic member is fixed to the circumferential wall, and the hard member is positioned below the stretchable and contractible portion.

In a preferred aspect of the present invention, the circumferential wall has a portion whose surface is coated with a hard material harder than the elastic member, and the portion is positioned below the stretchable and contractible portion.

With the present invention having the above structure, a strength of the circumferential wall can be enhanced, thus preventing the elastic member from being twisted when the substrate is polished.

According to another aspect of the present invention, there is provided a substrate holding apparatus for holding and pressing a substrate to be polished against a polishing surface, the substrate holding apparatus comprising: a vertically movable member; and an elastic member connected to the vertically movable member for defining a chamber. The elastic member comprises a contact portion which is brought into contact with the substrate, and a circumferential wall extending upwardly from the contact portion and connected to the vertically movable member. The circumferential wall comprises an outer circumferential wall, and an inner circumferential wall disposed radially inwardly of the outer circumferential wall, with the contact portion being divided at a position between the outer circumferential wall and the inner circumferential wall.

In a preferred aspect of the present invention, a pressing member is brought into contact with an upper surface of the contact portion so as to press the contact portion against the substrate.

With the present invention having the above structure, the pressing member can bring a lower surface of the contact portion into intimate contact with an upper surface of the substrate. Therefore, it is possible to prevent a pressurized fluid from leaking from a gap between the contact portion and the substrate.

In a preferred aspect of the present invention, the pressing member has a plurality of grooves formed in a lower surface thereof and extending radially.

In a preferred aspect of the present invention, the pressing member has a fluid supply port formed in a lower surface thereof for supplying a fluid to the upper surface of the contact portion.

With the present invention having the above structure, a pressurized fluid can quickly be supplied to the upper surface of the contact portion through the grooves or the fluid supply port. Therefore, while the contact portion is being pressed against the substrate by the pressing member, the pressurized fluid can press the contact portion against the substrate.

In a preferred aspect of the present invention, the contact portion has a thick portion formed on the upper surface thereof and extending in a circumferential direction of the contact portion.

In a preferred aspect of the present invention, the thick portion has a substantially triangular or arcuate cross section.

In a preferred aspect of the present invention, a reinforcement member is embedded in the contact portion.

With the present invention having the above structure, since a strength of the contact portion is enhanced, the contact portion is prevented from being twisted in a circumferential direction when the pressing member presses the contact portion against the substrate. Therefore, the contact portion and the substrate can be kept in intimate contact with each other, thus preventing a pressurized fluid from leaking.

In a preferred aspect of the present invention, the contact portion has a plurality of convexities and concavities formed on an upper surface thereof.

With the present invention having the above structure, adhesiveness of the contact portion to the vertically movable member is weakened. Therefore, when the vertically movable member is moved upwardly, the contact portion of the elastic member is prevented from being lifted by the vertically movable member.

According to another aspect of the present invention, there is provided a polishing apparatus comprising: the substrate holding apparatus; and a polishing table having a polishing surface.

According to another aspect of the present invention, there is provided a method of polishing a substrate, comprising: holding the substrate by the substrate holding apparatus; placing the substrate onto a polishing surface of a polishing table; moving the vertically movable member downwardly to press the contact portion against the substrate; supplying a pressurized fluid to the chamber while pressing the contact portion against the substrate; and bringing the substrate into sliding contact with the polishing surface so as to polish the substrate.

According to another aspect of the present invention, there is provided a substrate holding apparatus for holding and pressing a substrate to be polished against a polishing surface, the substrate holding apparatus comprising: a vertically movable member; and an elastic member for defining a chamber, with the elastic member having a contact portion which is brought into contact with the substrate, and the contact portion having a removal promoting portion for promoting the contact portion to be removed from the substrate.

In a preferred aspect of the present invention, the removal promoting portion comprises a notch formed in a circumferential edge of the contact portion.

In a preferred aspect of the present invention, the contact portion has a region which is made of a material having a lower adhesiveness to the substrate than that of the elastic member.

In a preferred aspect of the present invention, a surface of the contact portion has a plurality of convexities and concavities.

In a preferred aspect of the present invention, the elastic member comprises a plurality of contact portions, and the removal promoting portion comprises an interconnecting portion for interconnecting one of the plurality of contact portions and another of the plurality of contact portions.

In a preferred aspect of the present invention, the removal promoting portion comprises an upwardly concave recess formed in the contact portion, and the recess is brought into intimate contact with the substrate when a pressurized fluid is supplied to the chamber.

With the present invention having the above structure, when a fluid is ejected to the substrate, the removal promoting portion starts being removed from the substrate to allow the contact portion to be brought out of contact with the substrate smoothly. Therefore, the substrate can be transferred to a substrate lifting and lowering apparatus such as a pusher without being damaged by a fluid pressure. Further, it is possible to release the substrate from the elastic member smoothly without being affected by a type of the substrate, particularly a type of a film formed on a backside surface (upper surface) of the substrate.

According to another aspect of the present invention, there is provided a polishing apparatus comprising: the substrate holding apparatus; and a polishing table having a polishing surface.

According to another aspect of the present invention, there is provided a substrate holding apparatus for holding and pressing a substrate to be polished against a polishing surface, the substrate holding apparatus comprising: a movable member which is movable perpendicularly to the polishing surface; and an elastic membrane connected to the movable member for defining a plurality of chambers, with the elastic membrane comprising a contact portion which is brought into contact with the substrate, and a plurality of circumferential walls for connecting the contact portion to the movable member, and with each of the plurality of circumferential walls having a stretchable and contractible portion which is stretchable and contractible perpendicularly to the polishing surface.

With the present invention having the above structure, since the stretchable and contractible portions are stretched perpendicularly to the polishing surface as the fluid is supplied to the chambers, the contact portion of the elastic member can maintain its shape. Therefore, a contact area between the elastic membrane (the contact portion) and the substrate can be kept constant, and hence a uniform polishing rate can be obtained over an entire polished surface of the substrate. Further, because the elastic membrane and the substrate are kept well in contact with each other by the stretchable and contractible portions, it is possible to use an elastic membrane having a high hardness. Therefore, a durability of the elastic membrane can be increased. In this case, the elastic membrane having a high hardness can maintain a contact area between the substrate and the elastic membrane (the contact portion), compared to an elastic membrane having a low hardness. Thus, a stable polishing rate can be obtained.

In a preferred aspect of the present invention, the elastic membrane has an integral structure.

With the present invention having the above structure, it is possible to prevent a fluid from leaking out of the chambers. Further, the substrate can be easily released from the contact portion after polishing of the substrate is finished. If an elastic membrane is divided into a plurality of divided portions, some of these divided portions may adhere to the substrate, thereby preventing the substrate from being released smoothly. According to the present invention, an integrally formed elastic membrane allows the substrate to be released smoothly from the contact portion.

In a preferred aspect of the present invention, the contact portion has an upwardly inclined portion disposed on an outer edge thereof.

In a preferred aspect of the present invention, the inclined portion has a curved cross section.

In a preferred aspect of the present invention, the inclined portion has a straight cross section.

With the present invention having the above structure, a circumferential edge of the substrate and the elastic membrane are kept out of contact with each other. Therefore, no pressing force is applied to the circumferential edge of the substrate, thus preventing the circumferential edge of the substrate from being excessively polished.

In a preferred aspect of the present invention, the inclined portion is thinner than the contact portion.

With the present invention having the above structure, the inclined portion can be easily deformed under a fluid pressure. Therefore, the inclined portion can be brought into contact with the circumferential edge of the substrate under a desired pressing force. Consequently, a polishing rate at the circumferential edge of the substrate can be controlled independently.

According to another aspect of the present invention, there is provided a polishing apparatus comprising: the substrate holding apparatus; and a polishing table having a polishing surface.

DETAILED DESCRIPTION OF THE PREFERRED EMBODIMENTS

A substrate holding apparatus and a polishing apparatus according to a first embodiment of the present invention will be described in detail below with reference to the drawings.

Figure 1:
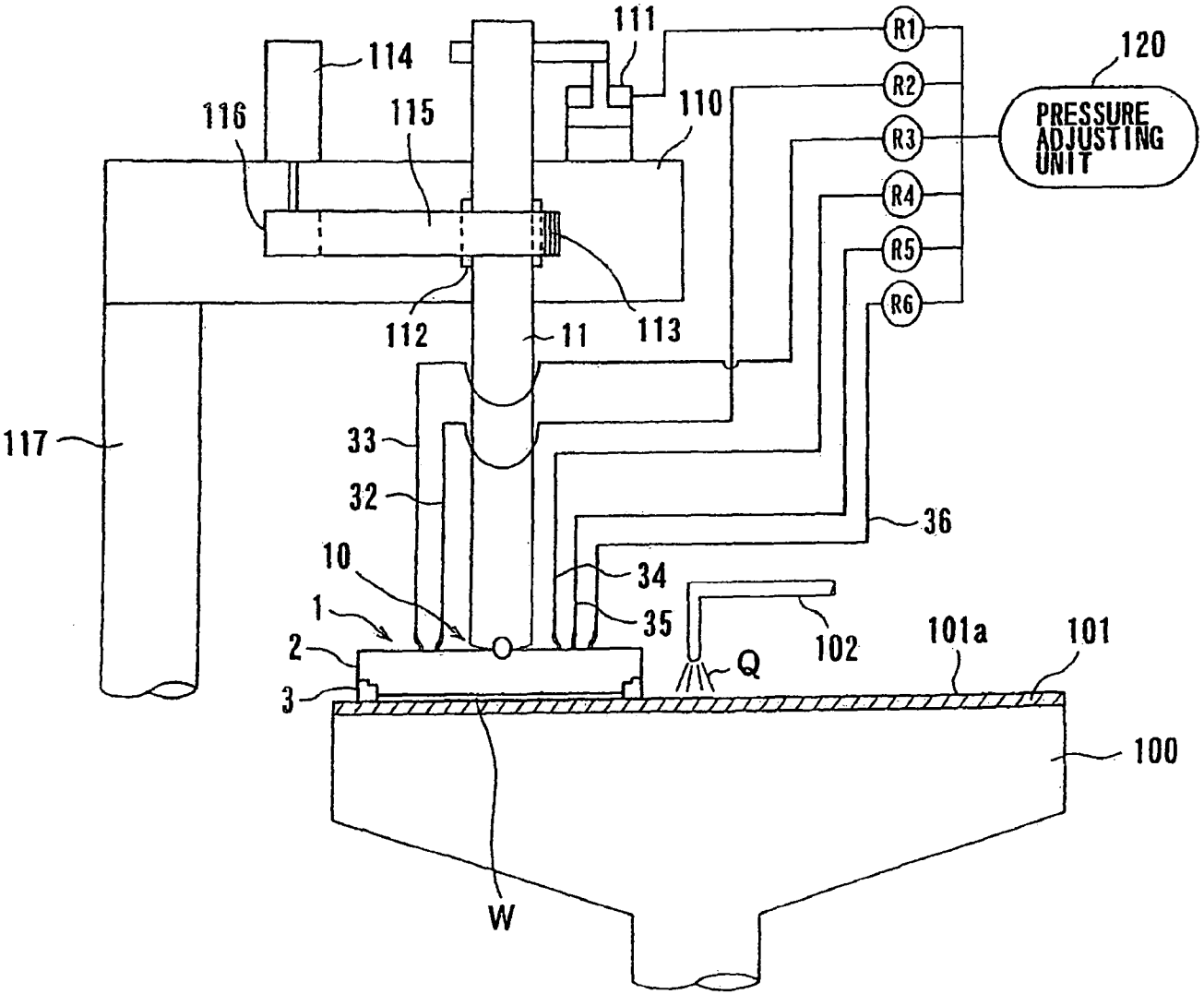
FIG. 1 is a cross-sectional view showing an entire structure of a polishing apparatus having a substrate holding apparatus according to a first embodiment of the present invention.

FIG. 1 is a cross-sectional view showing an entire structure of a polishing apparatus having a substrate holding apparatus according to a first embodiment of the present invention. The substrate holding apparatus serves to hold a substrate such as a semiconductor wafer to be polished and to press the substrate against a polishing surface on a polishing table. As shown in FIG. 1, a polishing table 100 having a polishing pad 101 attached on an upper surface thereof is provided underneath a top ring 1 constituting a substrate holding apparatus according to the present invention. A polishing liquid supply nozzle 102 is provided above the polishing table 100, and a polishing liquid Q is supplied onto a polishing surface 101*a* of the polishing pad 101 placed on the polishing table 100 from the polishing liquid supply nozzle 102.

Various kinds of polishing pads are available on the market. For example, some of these are SUBA800, IC-1000, and IC-1000/SUBA100 (two-layer cloth) manufactured by Rodel Inc., and Surfin xxx-5 and Surfin 000 manufactured by Fujimi Inc. SUBA800, Surfin xxx-5, and Surfin 000 are non-woven fabrics bonded by urethane resin, and IC-1000 is made of rigid foam polyurethane (single-layer). Foam polyurethane is porous and has a large number of fine recesses or holes formed in its surface.

The top ring 1 is connected to a top ring drive shaft 11 by a universal joint 10, and the top ring drive shaft 11 is coupled to a top ring air cylinder 111 fixed to a top ring head 110. The top ring air cylinder 111 operates to move the top ring drive shaft 11 vertically to thereby lift and lower the top ring 1 as a whole and to press a retainer ring 3 fixed to a lower end of a top ring body 2 against the polishing pad 101. The top ring air cylinder 111 is connected to a pressure adjusting unit 120 via a regulator R1. The pressure adjusting unit 120 serves to adjust a pressure by supplying a pressurized fluid such as pressurized air from a compressed air source (not shown) or developing a vacuum with a pump (not shown) or the like. The pressure adjusting unit 120 can adjust a fluid pressure of the pressurized fluid to be supplied to the top ring air cylinder 111 with the regulator R1. Thus, it is possible to adjust a pressing force of the retainer ring 3 which presses the polishing pad 101.

The top ring drive shaft 11 is connected to a rotary sleeve 112 by a key (not shown). The rotary sleeve 112 has a timing pulley 113 fixedly disposed on a peripheral portion thereof. A top ring motor 114 is fixed to the top ring head 110, and the timing pulley 113 is coupled to a timing pulley 116 mounted on the top ring motor 114 via a timing belt 115. Therefore, when the top ring motor 114 is energized for rotation, the rotary sleeve 112 and the top ring drive shaft 11 are rotated in unison with each other via the timing pulley 116, the timing belt 115, and the timing pulley 113 to thereby rotate the top ring 1. The top ring head 110 is supported by a top ring head shaft 117 which is rotatably supported by a frame (not shown).

Figure 2:
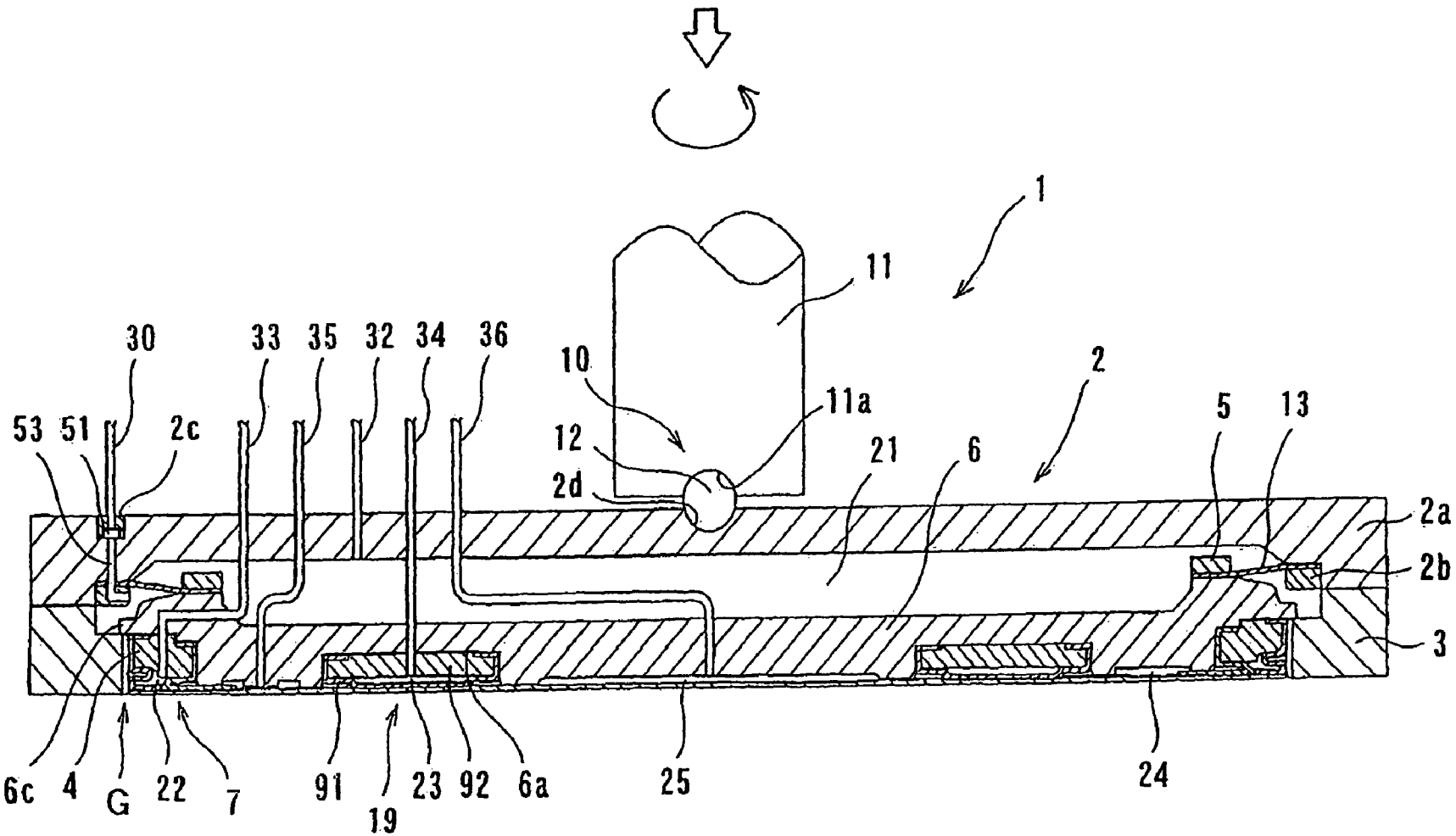
FIG. 2 is a vertical cross-sectional view showing a top ring incorporated in the substrate holding apparatus according to the first embodiment of the present invention.

The top ring 1 serving as the substrate holding apparatus according to the first embodiment of the present invention will be described below in detail. FIG. 2 is a vertical cross-sectional view showing the top ring 1 according to the first embodiment.

As shown in FIG. 2, the top ring 1 serving as the substrate holding apparatus comprises cylinder-vessel-shaped top ring body 2 having a housing space formed therein, and the annular retainer ring 3 fixed to the lower end of the top ring body 2. The top ring body 2 is made of a highly strong and rigid material such as metal or ceramic. The retainer ring 3 is made of highly rigid resin, ceramic, or the like.

The top ring body 2 comprises a cylinder-vessel-shaped housing 2*a*, an annular pressurizing sheet support 2*b* fitted into a cylindrical portion of the housing 2*a*, and an annular seal 2*c* fitted into a groove formed in a circumferential edge of an upper surface of the housing 2*a*. The retainer ring 3 is fixed to a lower end of the housing 2*a* of the top ring body 2. The retainer ring 3 has a lower portion projecting radially inwardly. The retainer ring 3 may be formed integrally with the top ring body 2.

The top ring drive shaft 11 is disposed above a central portion of the housing 2*a* of the top ring body 2, and the top ring body 2 is coupled to the top ring drive shaft 11 by the universal joint 10. The universal joint 10 has a spherical bearing mechanism by which the top ring body 2 and the top ring drive shaft 11 are tiltable with respect to each other, and a rotation transmitting mechanism for transmitting rotation of the top ring drive shaft 11 to the top ring body 2. The spherical bearing mechanism and the rotation transmitting mechanism transmit a pressing force and a rotating force from the top ring drive shaft 11 to the top ring body 2 while allowing the top ring body 2 and the top ring drive shaft 11 to be tilted with respect to each other.

The spherical bearing mechanism comprises a hemispherical concave recess 11*a* defined centrally in a lower surface of the top ring drive shaft 11, a hemispherical concave recess 2*d* defined centrally in an upper surface of the housing 2*a*, and a bearing ball 12 made of a highly hard material such as ceramic and interposed between the concave recesses 11*a* and 2*d*. The rotation transmitting mechanism comprises drive pins (not shown) fixed to the top ring drive shaft 11, and driven pins (not shown) fixed to the housing 2*a*. Even if the top ring body 2 is tilted with respect to the top ring drive shaft 11, the drive pins and the driven pins remain in engagement with each other while contact points are displaced because the drive pins and the driven pins are vertically movable relatively to each other. Thus, the rotation transmitting mechanism reliably transmits rotational torque of the top ring drive shaft 11 to the top ring body 2.

The top ring body 2 and the retainer ring 3 integrally fixed to the top ring body 2 define a housing space therein. An annular holder ring 5 and a disk-shaped chucking plate 6 serving as a vertically movable member are disposed in the housing space. The chucking plate 6 is vertically movable within the housing space formed in the top ring body 2. The chucking plate 6 may be made of metal. However, when a thickness of a thin film formed on a surface of a semiconductor wafer is measured by a method using eddy current in a state such that a semiconductor wafer to be polished is held by the top ring 1, the chucking plate 6 should preferably be made of a non-magnetic material, e.g., an insulating material such as PPS, PEEK, fluororesin, or ceramic.

A pressurizing sheet 13 comprising an elastic membrane is disposed between the holder ring 5 and the top ring body 2. The pressurizing sheet 13 has a radially outer edge clamped between the housing 2*a* and the pressurizing sheet support 2*b* of the top ring body 2, and a radially inner edge clamped between the holder ring 5 and the chucking plate 6. The top ring body 2, the chucking plate 6, the holder ring 5, and the pressurizing sheet 13 jointly define a pressure chamber 21 in the top ring body 2. As shown in FIG. 2, the pressure chamber 21 communicates with a fluid passage 32 comprising a tube, a connector, and the like. The pressure chamber 21 is connected to the pressure adjusting unit 120 via a regulator R2 provided in the fluid passage 32. The pressurizing sheet 13 is made of a highly strong and durable rubber material such as ethylene propylene rubber (EPDM), polyurethane rubber, or silicone rubber.

In a case where the pressurizing sheet 13 is made of an elastic material such as rubber, if the pressurizing sheet 13 is fixedly clamped between the retainer ring 3 and the top ring body 2, then a desired horizontal surface cannot be maintained on a lower surface of the retainer ring 3 because of elastic deformation of the pressurizing sheet 13 as an elastic material. In order to prevent such a drawback, the pressurizing sheet 13 is clamped between the housing 2*a* of the top ring body 2 and the pressurizing sheet support 2*b* provided as a separate member in the present embodiment. The retainer ring 3 may vertically be movable with respect to the top ring body 2, or the retainer ring 3 may have a structure capable of pressing the polishing surface 101*a* independently of the top ring body 2. In such cases, the pressurizing sheet 13 is not necessarily fixed in the aforementioned manner.

An annular edge membrane (elastic member) 7 is mounted on an outer circumferential edge of the chucking plate 6, and is brought into contact with an outer circumferential edge of semiconductor wafer W held by the top ring 1. An upper end of the edge membrane 7 is clamped between the outer circumferential edge of the chucking plate 6 and an annular edge ring 4, so that the edge membrane 7 is attached to the chucking plate 6.

The edge membrane 7 has a pressure chamber 22 formed therein which communicates with a fluid passage 33 comprising a tube, a connector, and the like. The pressure chamber 22 is connected to the pressure adjusting unit 120 via a regulator R3 provided in the fluid passage 33. The edge membrane 7 is made of a highly strong and durable rubber material such as ethylene propylene rubber (EPDM), polyurethane rubber, silicone rubber, as with the pressurizing sheet 13. The rubber material of the edge membrane 7 should preferably have a hardness (duro) ranging from 20 to 60.

When the semiconductor wafer W is polished, the semiconductor wafer W is rotated by rotation of the top ring 1. The edge membrane 7 has a small contact area with the semiconductor wafer W, and is thus liable to fail to transmit a sufficient rotational torque to the semiconductor wafer W. Accordingly, an annular intermediate air bag 19, to be brought into close contact with the semiconductor wafer W, is fixed to a lower surface of the chucking plate 6, so that a sufficient torque is transmitted to the semiconductor wafer W by the intermediate air bag 19. The intermediate air bag 19 is disposed radially inwardly of the edge membrane 7, and is brought into close contact with the semiconductor wafer W with a contact area large enough to transmit a sufficient torque to the semiconductor wafer W.

The intermediate air bag 19 comprises an elastic membrane 91 brought into contact with an upper surface of the semiconductor wafer W, and an air bag holder 92 for detachably holding the elastic membrane 91 in position. An annular groove 6*a* is formed in the lower surface of the chucking plate 6, and the air bag holder 92 is fixedly mounted in the annular groove 6*a* by screws (not shown). An upper end of the elastic membrane 91 constituting the intermediate air bag 19 is clamped between the annular groove 6*a* and the air bag holder 92, so that the elastic membrane 91 is detachably mounted on the lower surface of the chucking plate 6.

The intermediate air bag 19 has a pressure chamber 23 defined therein by the elastic membrane 91 and the air bag holder 92. The pressure chamber 23 communicates with a fluid passage 34 comprising a tube, a connector, and the like. The pressure chamber 23 is connected to the pressure adjusting unit 120 via a regulator R4 provided in the fluid passage 34. The elastic membrane 91 is made of a highly strong and durable rubber material such as ethylene propylene rubber (EPDM), polyurethane rubber, silicone rubber, as with the pressurizing sheet 13.

An annular space defined by the edge membrane 7, the intermediate air bag 19, the semiconductor wafer W, and the chucking plate 6 serves as a pressure chamber 24. The pressure chamber 24 communicates with a fluid passage 35 comprising a tube, a connector, and the like. The pressure chamber 24 is connected to the pressure adjusting unit 120 via a regulator R5 provided in the fluid passage 35.

A circular space defined by the intermediate air bag 19, the semiconductor wafer W, and the chucking plate 6 serves as a pressure chamber 25. The pressure chamber 25 communicates with a fluid passage 36 comprising a tube, a connector, and the like. The pressure chamber 25 is connected to the pressure adjusting unit 120 via a regulator R6 provided in the fluid passage 36. The fluid passages 32, 33, 34, 35 and 36 are connected to the regulators R2 through R6, respectively, through a rotary joint (not shown) disposed on an upper end of the top ring head 110.

A cleaning liquid passage 51 in the form of an annular groove is formed in the seal 2*c* of the top ring body 2 near an outer circumferential edge of the upper surface of the housing 2*a*. The cleaning liquid passage 51 communicates with a fluid passage 30 and is supplied with a cleaning liquid such as pure water through the fluid passage 30. A plurality of communication holes 53 extend from the cleaning liquid passage 51 and pass through the housing 2*a* and the pressurizing sheet support 2*b*. The communication holes 53 communicate with a small gap G between an outer circumferential surface of the edge membrane 7 and an inner circumferential surface of the retainer ring 3.

Since the small gap G is formed between the outer circumferential surface of the edge membrane 7 and the retainer ring 3, members including the holder ring 5, the chucking plate 6, and the edge membrane 7 mounted on the chucking plate 6 are vertically movable with respect to the top ring body 2 and the retainer ring 3 in a floating manner. The chucking plate 6 has a plurality of projections 6*c* projecting radially outwardly from an outer circumferential edge thereof. When the projections 6*c* engage with an upper surface of an inwardly projecting portion of the retainer ring 3, downward movement of the members including the chucking plate 6 is restricted to a certain position.

Figure 3A:
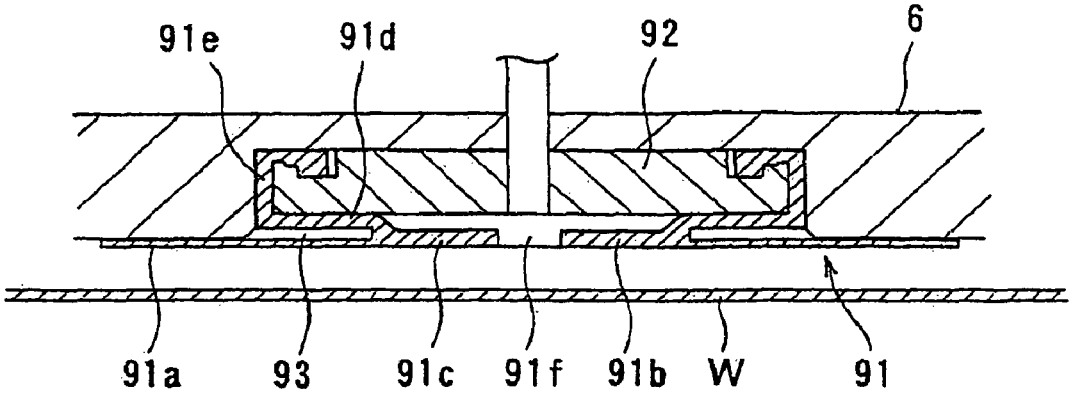
FIGS. 3A through 3C are enlarged cross-sectional views showing an intermediate air bag shown in FIG. 2.
Figure 3B:
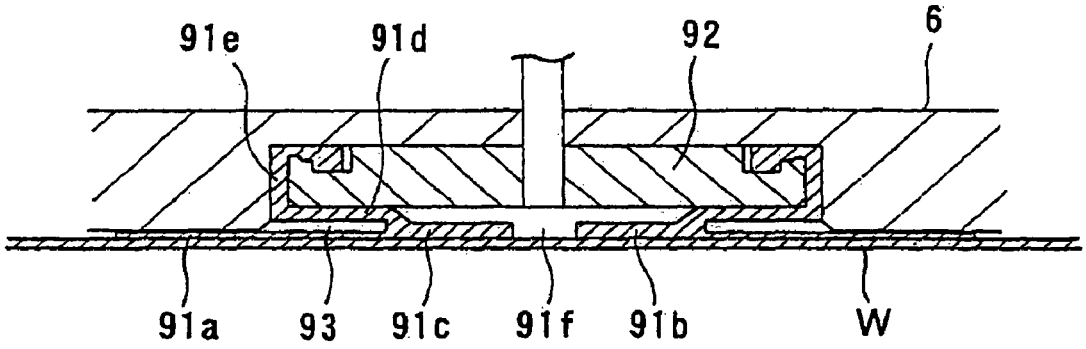
Figure 3C:
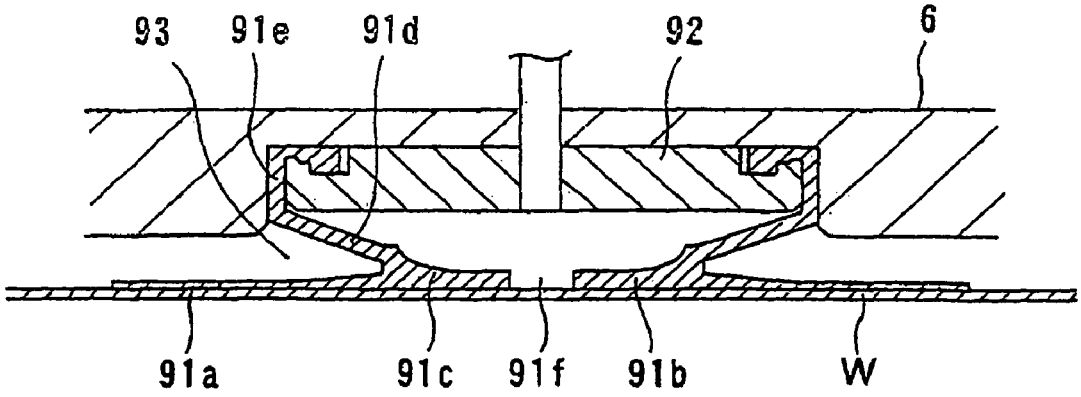

The intermediate air bag 19 will be described in detail below with reference to FIGS. 3A through 3C. FIGS. 3A through 3C are enlarged cross-sectional views showing the intermediate air bag shown in FIG. 2.

As shown in FIG. 3A, the elastic membrane 91 of the intermediate air bag 19 has an intermediate contact portion 91*b* having flanges 91*a* projecting outwardly, extending portions 91*d* extending outwardly from base portions 91*c* of the flanges 91*a* to form grooves 93 between the extending portions 91*d* and the flanges 91*a*, and connecting portions 91*e* connected to the chucking plate 6 by the air bag holder 92. The extending portions 91*d* extend outwardly from the base portions 91*c* of the flanges 91*a* to positions inward of tips of the flanges 91*a*, and the connecting portions 91*e* extend upwardly from outward ends of the extending portions 91*d*. The flanges 91*a*, the intermediate contact portion 91*b*, the connecting portions 91*e*, and the extending portions 91*d* are integrally formed with each other and are made of the same material. An open mouth 91*f* is formed in a central portion of the intermediate contact portion 91*b*.

With this structure, in a case where the chucking plate 6 is lifted for polishing after the semiconductor wafer W is brought into close contact with the intermediate contact portion 91*b* of the intermediate air bag 19 (see FIG. 3B), upward forces by the connecting portions 91*e* are converted into forces in horizontal or oblique directions by the extending portions 91*d*, and these converted forces are applied to the base portions 91*c* of the flanges 91*a* (see FIG. 3C). Therefore, upward forces applied to the base portions 91*c* of the flanges 91*a* can be made extremely small, so that excessive upward forces are not applied to the contact portion 91*b*. Accordingly, a vacuum is not formed near the base portions 91*c*, so that a uniform polishing rate can be achieved over an entire surface of the intermediate contact portion 91*b* except the flanges 91*a*. In this case, a thickness of the connecting portions 91*e* or a length of the flanges 91*a* may be varied between a portion of the connecting portion disposed radially inwardly and a portion of the connecting portion disposed radially outwardly. Further, a length of the extending portions 91*d* may be varied between a portion of the extending portion disposed radially inwardly and a portion of the extending portion disposed radially outwardly. Furthermore, a thickness of the flanges 91*a* may be varied according to a type of a film formed on a semiconductor wafer to be polished or a type of the polishing pad. When a resistance or a polishing torque transmitted to the semiconductor wafer is large, the thickness of the flanges 91*a* should preferably be made larger in order to prevent torsion of the flanges 91*a*.

Figure 4A:
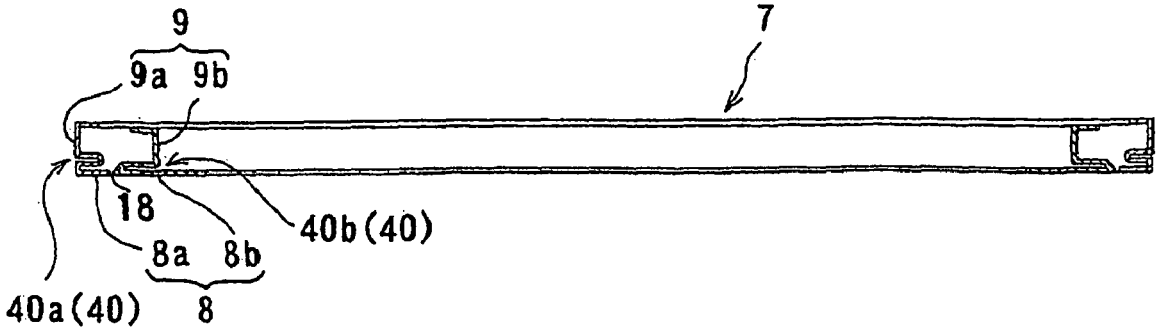
FIG. 4A is a cross-sectional view showing an entire structure of an edge membrane of the first embodiment of the present invention.

The edge membrane 7 according to the present embodiment will be described in detail below with reference to FIGS. 4A through 4C. FIG. 4A is a cross-sectional view showing an entire structure of the edge membrane according to the first embodiment of the present invention, and FIGS. 4B and 4C are fragmentary cross-sectional views showing the substrate holding apparatus shown in FIG. 2.

The edge membrane (elastic member) 7 according to the present embodiment comprises an annular contact portion 8 which is brought into contact with an outer circumferential edge of the semiconductor wafer W, and an annular circumferential wall or part 9 extending upwardly from the contact portion 8 and connected to the chucking plate 6. The circumferential wall or part 9 comprises an outer circumferential wall 9*a*, and an inner circumferential wall 9*b* disposed radially inwardly of the outer circumferential wall 9*a*. The contact portion 8 has a shape extending radially inwardly from the circumferential wall 9 (i.e., the outer circumferential wall 9*a* and the inner circumferential wall 9*b*). The contact portion 8 has a circumferentially extending slit 18 positioned between the outer circumferential wall 9*a* and the inner circumferential wall 9*b*. Specifically, the slit 18 divides the contact portion 8 into an outer contact portion 8*a* and an inner contact portion 8*b* at a position between the outer circumferential wall 9*a* and the inner circumferential wall 9*b*.

Figure 4B:
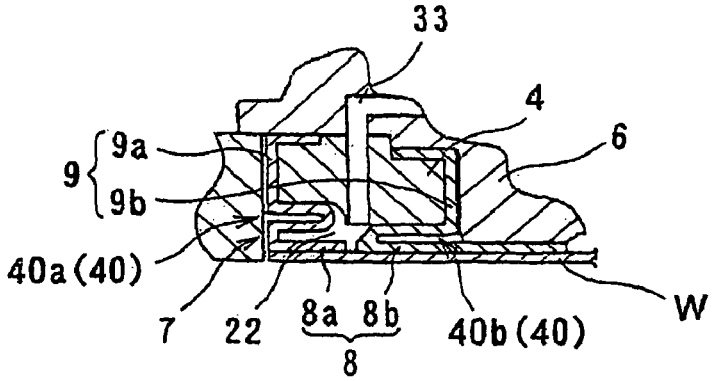
FIGS. 4B and 4C are fragmentary cross-sectional views showing the substrate holding apparatus shown in FIG. 2.
Figure 4C:
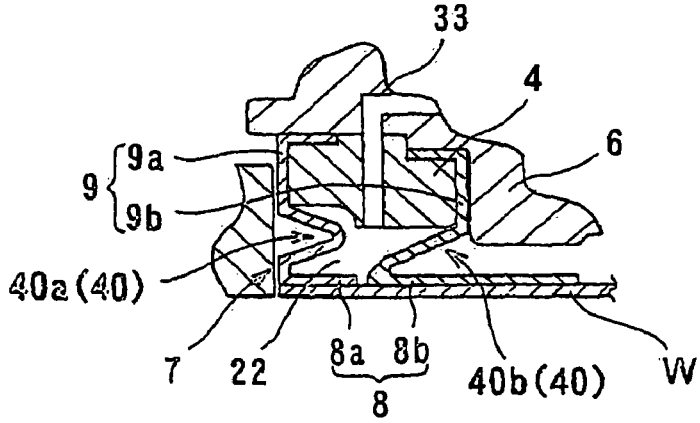

As shown in FIGS. 4B and 4C, the outer circumferential wall 9*a* and the inner circumferential wall 9*b* extend upwardly along outer and inner circumferential surfaces of the annular edge ring 4, respectively. Upper ends of the outer circumferential wall 9*a* and the inner circumferential wall 9*b* are clamped between the chucking plate 6 and an upper surface of the edge ring 4. The edge ring 4 is fastened to the chucking plate 6 by screws (not shown), so that the edge membrane 7 is detachably attached to the chucking plate 6. The fluid passage 33 extends vertically through the edge ring 4 and opens at a lower surface of the edge ring 4. Therefore, the annular pressure chamber 22 defined by the edge ring 4, the edge membrane 7, and the semiconductor wafer W communicates with the fluid passage 33, and is connected to the pressure adjusting unit 120 through the fluid passage 33 and the regulator R3.

The circumferential wall 9 has a stretchable (extendible) and contractible portion 40 which is stretchable (extendible) and contractible vertically, i.e., substantially perpendicularly to the semiconductor wafer W. More specifically, the outer circumferential wall 9*a* constituting the circumferential wall 9 has a stretchable and contractible portion 40*a* which is stretchable and contractible vertically. The stretchable and contractible portion 40*a* has a structure such that a portion of the outer circumferential wall 9*a* is folded inwardly and further folded outwardly to form a folded-back portion extending along a circumferential direction. The stretchable and contractible portion 40*a* is positioned near the outer contact portion 8*a* and is positioned below the edge ring 4. The inner circumferential wall 9*b* constituting the circumferential wall 9 also has a stretchable and contractible portion 40*b* which is stretchable and contractible vertically. The stretchable and contractible portion 40*b* has a structure such that a portion of the inner circumferential wall 9*b* near a lower end thereof is folded inwardly along the circumferential direction. Since the stretchable and contractible portions 40*a*, 40*b* are provided in the outer circumferential wall 9*a* and the inner circumferential wall 9*b*, respectively, the outer circumferential wall 9*a* and the inner circumferential wall 9*b* can largely be stretched and contracted while the contact portion 8 (i.e., the outer contact portion 8*a* and the inner contact portion 8*b*) maintains its shape. Therefore, as shown in FIG. 4C, when the chucking plate 6 is moved upwardly, the stretchable and contractible portions 40*a*, 40*b* are stretched so as to follow movement of the chucking plate 6, thus allowing a contact area between the edge membrane 7 and the semiconductor wafer W to be maintained constant.

The pressure chamber 21 above the chucking plate 6 and the pressure chambers 22, 23, 24 and 25 are supplied with pressurized fluid such as pressurized air, or atmospheric pressure or vacuum is produced in the pressure chambers 21, 22, 23, 24 and 25, through the fluid passages 32, 33, 34, 35 and 36 connected to respective pressure chambers. Specifically, the regulators R2 through R6 provided respectively in the fluid passages 32, 33, 34, 35 and 36 can respectively regulate pressures of pressurized fluids supplied to respective pressure chambers 21, 22, 23, 24 and 25. Thus, it is possible to independently control pressures in the pressure chambers 21, 22, 23, 24 and 25, or independently produce atmospheric pressure or vacuum in the pressure chambers 21, 22, 23, 24 and 25.

As described above, the edge membrane 7 has the contact portion 8 (the inner contact portion 8*b*) extending radially inwardly on a lower end thereof, and the intermediate air bag 19 has the flange 91*a* on a lower end thereof. The contact portion 8 (the inner contact portion 8*b*) and the flange 91*a* are brought into intimate contact with the semiconductor wafer W by a pressurized fluid supplied to the pressure chambers 22, 23 and 24. Therefore, the pressurized fluid in the pressure chambers 22, 23 and 24 does not flow under lower surfaces of the edge membrane 7 and the intermediate air bag 19. Specifically, the contact portion 8 and the flange 91*a* are pressed against the semiconductor wafer W by the pressurized fluid, and hence the edge membrane 7 and the intermediate air bag 19 are kept in intimate contact with the semiconductor wafer W. Therefore, it is possible to stably control pressure in each of the pressure chambers 22, 23 and 24.

In this case, the pressurized fluid supplied to the pressure chambers 22, 23, 24 and 25, or atmospheric air supplied to the above pressure chambers when producing atmospheric pressure therein may independently be controlled in terms of temperature. With such a structure, it is possible to directly control temperature of a workpiece such as a semiconductor wafer from a backside of a surface to be polished. Particularly, when temperatures of respective pressure chambers are independently controlled, a rate of chemical reaction can be controlled during a chemical polishing process of CMP.

Next, operation of the top ring 1 thus constructed will be described in detail.

In the polishing apparatus having the above structure, when a semiconductor wafer W is to be transferred to the polishing apparatus, the top ring 1 as a whole is moved to a transfer position where the semiconductor wafer W is transferred. In a case where the semiconductor wafer W has a diameter of 200 mm, the pressure adjusting unit 120 communicates with the pressure chamber 23 through the fluid passage 34. In a case where the semiconductor wafer W has a diameter of 300 mm, the pressure adjusting unit 120 communicates with the pressure chamber 24 through the fluid passage 35. Then, the pressure chamber 23 or 24 is evacuated by the pressure adjusting unit 120, so that the semiconductor wafer W is attracted under vacuum to the lower end of the top ring 1 by suction effect of the pressure chamber 23 or 24. With the semiconductor wafer W attracted to the top ring 1, the top ring 1 as a whole is moved to a position above the polishing table 100 having the polishing surface 101*a* on the polishing pad 101. An outer circumferential edge of the semiconductor wafer W is held by the retainer ring 3, so that the semiconductor wafer W is not removed from the top ring 1, or the semiconductor wafer W does not slide.

Thereafter, attraction of the semiconductor wafer W by the pressure chamber 23 or 24 is stopped. About at the same time, the top ring air cylinder 111 connected to the top ring drive shaft 11 is actuated to press the retainer ring 3 fixed to the lower end of the top ring 1 against the polishing surface 101*a* of the polishing pad 101 under a predetermined pressure. Then, pressurized fluid is supplied to the pressure chamber 21 so as to move the chucking plate 6 downwardly, thereby pressing the edge membrane 7 and the intermediate air bag 19 against the semiconductor wafer W. In this manner, lower surfaces of the edge membrane 7 and the intermediate air bag 19 can be brought into intimate contact with an upper surface of the semiconductor wafer W. In such a state, pressurized fluids having respective pressures are supplied respectively to the pressure chambers 22, 23, 24 and 25, so that the chucking plate 6 is moved upwardly and simultaneously the semiconductor wafer W is pressed against the polishing surface 101*a* of the polishing pad 101. At this time, the stretchable and contractible portions 40*a*, 40*b* provided in the edge membrane 7 are stretched so as to follow upward movement of the chucking plate 6. Therefore, a contact area between the lower surface, i.e. the contact portion 8, of the edge membrane 7 and the outer circumferential edge of the semiconductor wafer W can be kept constant. The polishing liquid supply nozzle 102 supplies a polishing liquid Q onto the polishing surface 101*a* of the polishing pad 101 in advance, so that the polishing liquid Q is held on the polishing pad 101. Thus, the semiconductor wafer W is polished in presence of the polishing liquid Q between a (lower) surface, to be polished, of the semiconductor wafer W and the polishing pad 101.

With the top ring 1 serving as the substrate holding apparatus according to the present embodiment, since the contact area between the edge membrane 7 and the outer circumferential edge of the semiconductor wafer W is kept constant, a pressing force applied to the outer circumferential edge of the semiconductor wafer W is prevented from being changed. Therefore, an entire surface including the outer circumferential edge of the semiconductor wafer W can be pressed against the polishing surface 101*a* under a uniform pressing force. As a result, a polishing rate at the outer circumferential edge of the semiconductor wafer W is prevented from being lowered. Further, a polishing rate at a region positioned radially inwardly of the outer circumferential edge of the semiconductor wafer W is prevented from being increased. Specifically, in a case where the semiconductor wafer has a diameter of 200 mm, the polishing rate at a region apart from the outer circumferential edge of the semiconductor wafer W by a distance of about 20 mm is prevented from being increased. In a case where the semiconductor wafer has a diameter of 300 mm, the polishing rate at a region apart from the outer circumferential edge of the semiconductor wafer W by a distance of about 25 mm is prevented from being increased.

The circumferentially extending slit 18 formed in the contact portion 8 of the edge membrane 7 is effective to increase stretchability of the circumferential wall 9 (the outer circumferential wall 9*a* and the inner circumferential wall 9*b*) in a downward direction. Therefore, even when a pressure of a pressurized fluid supplied to the pressure chamber 22 is small, a contact area between the edge membrane 7 and the semiconductor wafer W can be kept constant. Thus, it is possible to press the semiconductor wafer W under a smaller pressing force.

Local areas of the semiconductor wafer W that are positioned beneath the pressure chambers 22, 23, 24 and 25 are pressed against the polishing surface 101*a* under pressures of pressurized fluids supplied to the pressure chambers 22, 23, 24 and 25. Therefore, the pressures of the pressurized fluids supplied to the pressure chambers 22, 23, 24 and 25 are controlled independently of each other, so that the entire surface of the semiconductor wafer W can be pressed against the polishing surface under a uniform pressing force. As a result, a uniform polishing rate can be obtained over the entire surface of the semiconductor wafer W. In the same manner, the regulator R2 regulates the pressure of the pressurized fluid supplied to the pressure chamber 21 so as to change a pressing force applied to the polishing pad 101 by the retainer ring 3. In this manner, during polishing, the pressing force applied to the polishing pad 101 by the retainer ring 3 and pressing forces applied by the respective pressure chambers 22, 23, 24 and 25 to press the semiconductor wafer W against the polishing pad 101 are appropriately adjusted so as to control a polishing profile of the semiconductor wafer W. The semiconductor wafer W has an area to which the pressing force is applied by pressurized fluid through a contact portion of the intermediate air bag 19, and an area to which pressure of the pressurized fluid is directly applied. The pressing forces applied to these areas have the same pressure as each other.

As described above, the pressing force applied by the top ring air cylinder 111 to press the retainer ring 3 against the polishing pad 101 and the pressing forces applied by the pressurized fluids supplied to the pressure chambers 22, 23, 24 and 25 to press the semiconductor wafer W against the polishing pad 101 are appropriately adjusted to polish the semiconductor wafer W. When polishing of the semiconductor wafer W is finished, supply of the pressurized fluids into the pressure chambers 22, 23, 24 and 25 is stopped, and the pressures in the pressure chambers 22, 23, 24 and 25 are reduced to atmospheric pressure. Thereafter, the pressure chamber 23 or the pressure chamber 24 is evacuated to produce a negative pressure therein, so that the semiconductor wafer W is attracted to the lower surface of the top ring 1 again. At this time, atmospheric pressure or a negative pressure is produced in the pressure chamber 21. This is because if the pressure chamber 21 is maintained at a high pressure, then the semiconductor wafer W is locally pressed against the polishing surface 101*a* by the lower surface of the chucking plate 6.

After attraction of the semiconductor wafer W in a manner as described above, the top ring 1 as a whole is moved to the transfer position, and then a fluid (e.g., a pressurized fluid or a mixture of nitrogen and pure water) is ejected from the fluid passage 35 to the semiconductor wafer W so as to release the semiconductor wafer W from the top ring 1.

The polishing liquid Q used to polish the semiconductor wafer W tends to flow into the small gap G between the outer circumferential surface of the edge membrane 7 and the retainer ring 3. If the polishing liquid Q is firmly deposited in the gap G, then the holder ring 5, the chucking plate 6, and the edge membrane 7 are prevented from moving smoothly vertically with respect to the top ring body 2 and the retainer ring 3. In order to avoid such a drawback, a cleaning liquid such as pure water is supplied through the fluid passage 30 to the annular cleaning liquid passage 51. Accordingly, the pure water is supplied through a plurality of the communication holes 53 to a space above the gap G, thus cleaning the gap G to prevent the polishing liquid Q from being firmly deposited in the gap G. The pure water is preferably supplied after polished semiconductor wafer W is released and until a next semiconductor wafer to be polished is attracted to the top ring 1.

Figure 5A:
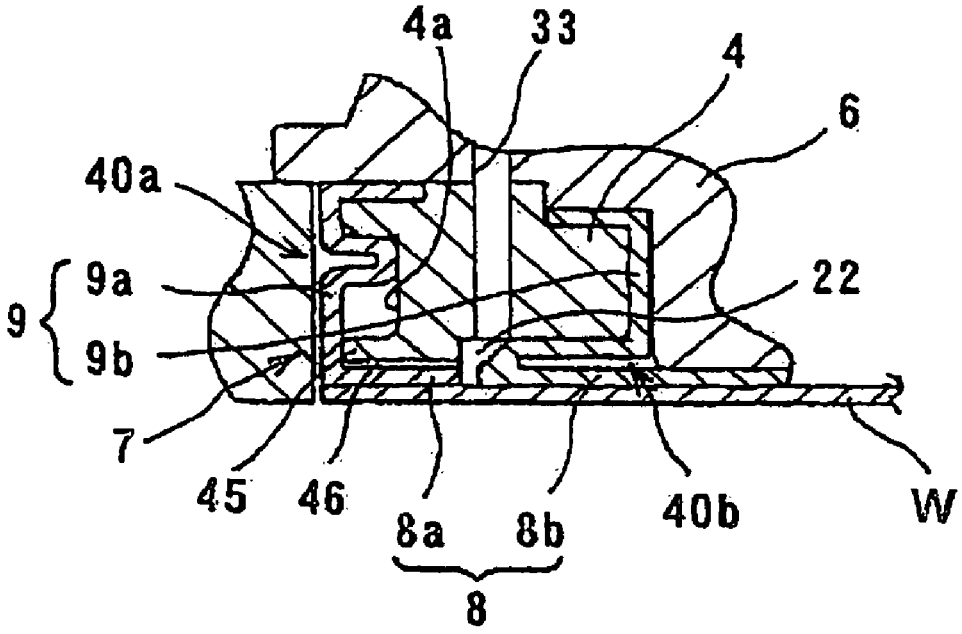
FIGS. 5A and 5B are fragmentary cross-sectional views showing a substrate holding apparatus according to a second embodiment of the present invention.
Figure 5B:
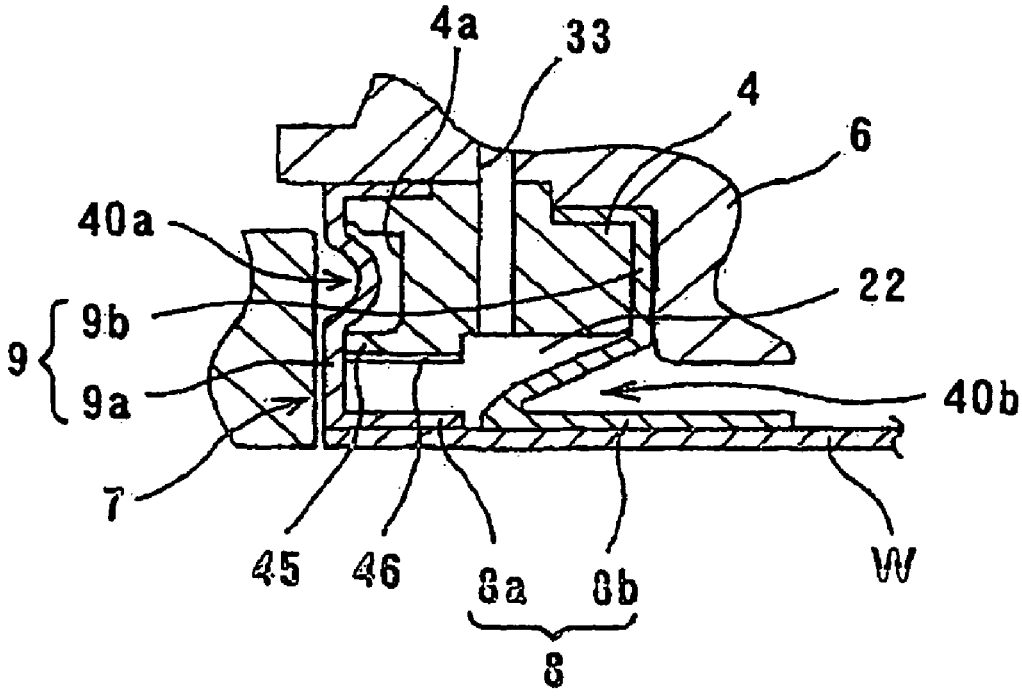

A substrate holding apparatus according to a second embodiment of the present invention will be described below with reference to FIGS. 5A and 5B. FIGS. 5A and 5B are fragmentary cross-sectional views showing the substrate holding apparatus according to the second embodiment of the present invention. Structural details of the substrate holding apparatus according to the second embodiment which will not be described below are identical to those of the substrate holding apparatus according to the first embodiment.

As shown in FIG. 5A, a stretchable and contractible portion 40*a* formed in outer circumferential wall 9*a* is positioned near an upper end of the outer circumferential wall 9*a*. Edge ring 4 has an annular housing groove 4*a* for housing the stretchable and contractible portion 40*a* therein. The housing groove 4*a* is formed in an outer circumferential surface of the edge ring 4, and extends in a circumferential direction of the edge ring 4. As shown in FIG. 5B, the housing groove 4*a* has a width large enough to allow the stretchable and contractible portion 40*a* to be kept out of contact with the edge ring 4 even when the stretchable and contractible portion 40*a* is stretched downwardly. The edge ring 4 has a pressing member 45 which is brought into contact with an upper surface of outer contact portion 8*a* (contact portion 8) for pressing the outer contact portion 8*a* against an outer circumferential edge of semiconductor wafer W. A plurality of radially extending grooves 46 are formed on a lower surface of the pressing member 45. Pressurized fluid supplied through fluid passage 33 to pressure chamber 22 is supplied through the grooves 46 to an upper surface of the outer contact portion 8*a* constituting the contact portion 8. In the present embodiment, the pressing member 45 is integrally formed with the edge ring 4. However, the pressing member 45 may be separate from the edge ring 4.

Operation of the substrate holding apparatus having the above structure according to the present embodiment will be described below. Operational details of the substrate holding apparatus according to the second embodiment of the present invention which will not be described below are identical to those of the substrate holding apparatus according to the first embodiment of the present invention.

The semiconductor wafer W is placed on the polishing surface 101*a* by top ring 1, and then a pressurized fluid is supplied to pressure chamber 21 so as to move chucking plate 6 and the edge ring 4 downwardly. At this time, the lower surface of the pressing member 45 is brought into contact with the upper surface of the outer contact portion 8*a*, so that the pressing member 45 presses the outer contact portion 8*a* against the semiconductor wafer W under a predetermined pressure. Edge membrane 7 and the semiconductor wafer W are thus held in sufficiently intimate contact with each other. In this state, a pressurized fluid is supplied to pressure chambers 22, 23, 24 and 25.

Pressurizing fluid supplied through the fluid passage 33 to the pressure chamber 22 is quickly supplied through the grooves 46 to the upper surface of the outer contact portion 8*a*. Therefore, at the same time that the pressurized fluid is supplied to the pressure chamber 22, the pressurized fluid presses the outer contact portion 8*a* against the semiconductor wafer W. As pressurized fluid is supplied to the pressure chambers 22, 23, 24 and 25, the chucking plate 6 is moved upwardly, and the stretchable and contractible portion 40*a* of the outer circumferential wall 9*a* and stretchable and contractible portion 40*b* of inner circumferential wall 9*b* are stretched. At this time, the stretchable and contractible portion 40*a* is deformed within the housing groove 4*a* formed in the edge ring 4. Therefore, the stretchable and contractible portion 40*a* is prevented from being brought into contact with the edge ring 4 and hence an excellent stretchability thereof can be secured. In this manner, the semiconductor wafer W is polished while being pressed against the polishing surface 101*a* by the pressure chambers 22, 23, 24 and 25.

According to the substrate holding apparatus having the above structure, the pressing member 45 can bring the edge membrane 7 into intimate contact with the semiconductor wafer W. Therefore, it is possible to prevent the pressurized fluid supplied to the pressure chamber 22 from leaking. Further, the pressurized fluid can quickly be supplied through the grooves 46 to the upper surface of the outer contact portion 8*a*. Therefore, the pressurized fluid can start pressing the outer contact portion 8*a* against the semiconductor wafer W while the edge membrane 7 is being pressed by the pressing member 45. Furthermore, the stretchable and contractible portion 40*a* is positioned near an upper end of the outer circumferential wall 9*a*. Therefore, stretchability of the outer circumferential wall 9*a* can be increased, and the outer circumferential wall 9*a* is prevented from being twisted in a circumferential direction, thus allowing the edge membrane 7 to behave in the same manner at all times.

Figure 6A:
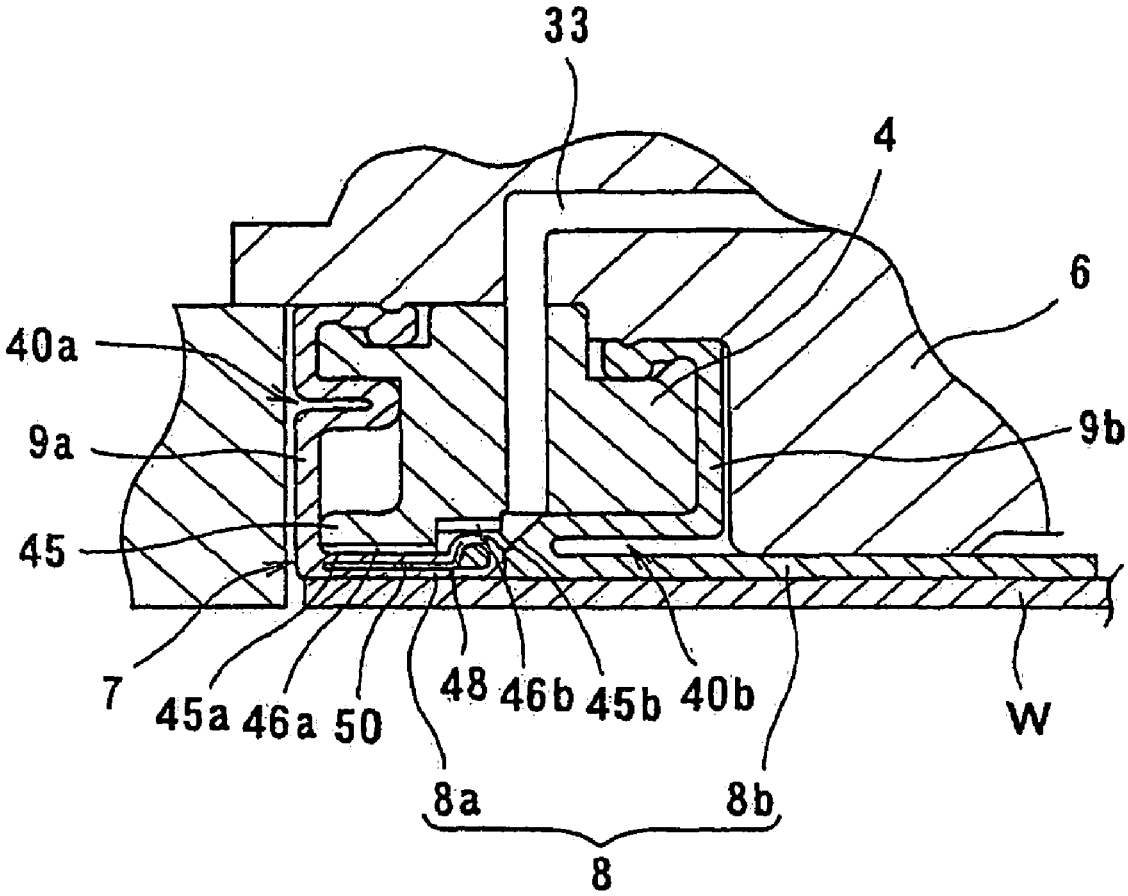
FIG. 6A is a fragmentary cross-sectional view showing a substrate holding apparatus according to a third embodiment of the present invention.
Figure 6B:
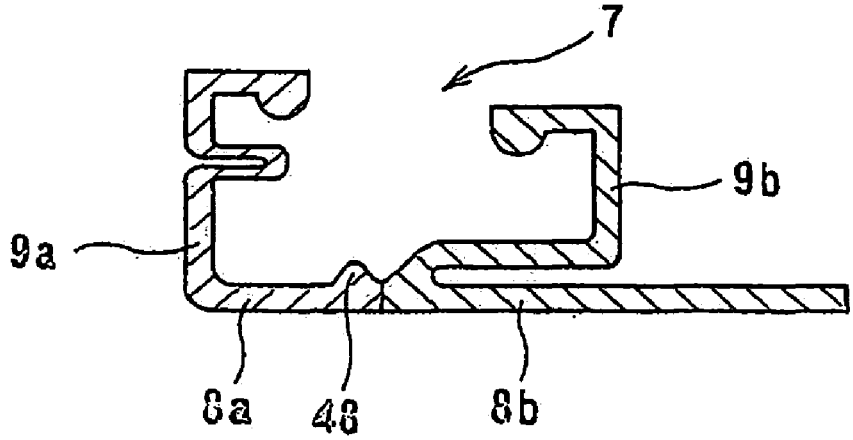
FIG. 6B is a fragmentary cross-sectional view showing another structure of an edge membrane of the third embodiment of the present invention.

An edge membrane 7 according to a third embodiment of the present invention will be described below with reference to FIGS. 6A and 6B. FIG. 6A is a fragmentary cross-sectional view showing a substrate holding apparatus according to the third embodiment of the present invention, and FIG. 6B is a fragmentary cross-sectional view showing another structure of an edge membrane of the third embodiment of the present invention. Structural and operational details of the substrate holding apparatus according to the third embodiment of the present invention which will not be described below are identical to those of the substrate holding apparatus according to the second embodiment of the present invention.

As shown in FIG. 6A, outer contact portion 8*a* constituting contact portion 8, to be pressed by pressing member 45, has a thick portion 48 on an upper surface thereof. The thick portion 48 extends in a circumferential direction of the outer contact portion 8*a*, and has a substantially arcuate cross section. A reinforcement member 50 for reinforcing a strength of the outer contact portion 8*a* is embedded in the outer contact portion 8*a*. The pressing member 45 has a step on a lower surface thereof to form a first pressing surface 45*a* and a second pressing surface 45*b* positioned upwardly of the first pressing surface 45*a*. The first pressing surface 45*a* is brought into contact with the outer contact portion 8*a*, and the second pressing surface 45*b* is brought into contact with the thick portion 48. The first pressing surface 45*a* and the second pressing surface 45*b* have a plurality of radially extending grooves 46*a*, 46*b* formed therein, respectively. The grooves 46*a*, 46*b* allow pressurized fluid to start pressing the outer contact portion 8*a* against semiconductor wafer W while the edge membrane 7 is being pressed by the pressing member 45, as with the second embodiment.

As described above, according to the present embodiment, the outer contact portion 8*a*, to be pressed by the pressing member 45, has the thick portion 48, and the reinforcement member 50 is embedded in the outer contact portion 8*a*. With this structure, it is possible to enhance mechanical strength of the outer contact portion 8*a*. Thus, when the outer contact portion 8*a* is pressed against the semiconductor wafer W by the pressing member 45, the outer contact portion 8*a* is prevented from being twisted in a circumferential direction. As a result, the edge membrane 7 and the semiconductor wafer W can be kept in intimate contact with each other, thus preventing the pressurized fluid from leaking.

Further, since the thick portion 48 has a substantially arcuate cross section, polishing liquid which has entered pressure chamber 22 is less liable to be firmly deposited at the thick portion 48. Furthermore, a lower surface, i.e. second pressing surface 45*b*, of the pressing member 45 and the thick portion 48 are not held in intimate contact with each other, thus enabling the pressing member 45 to be easily brought out of contact with the thick portion 48. Only one of the thick portion 48 or the reinforcement member 50 may be used to reinforce the contact portion 8. As shown in FIG. 6B, the thick portion 48 may have a triangular cross section.

Figure 7:
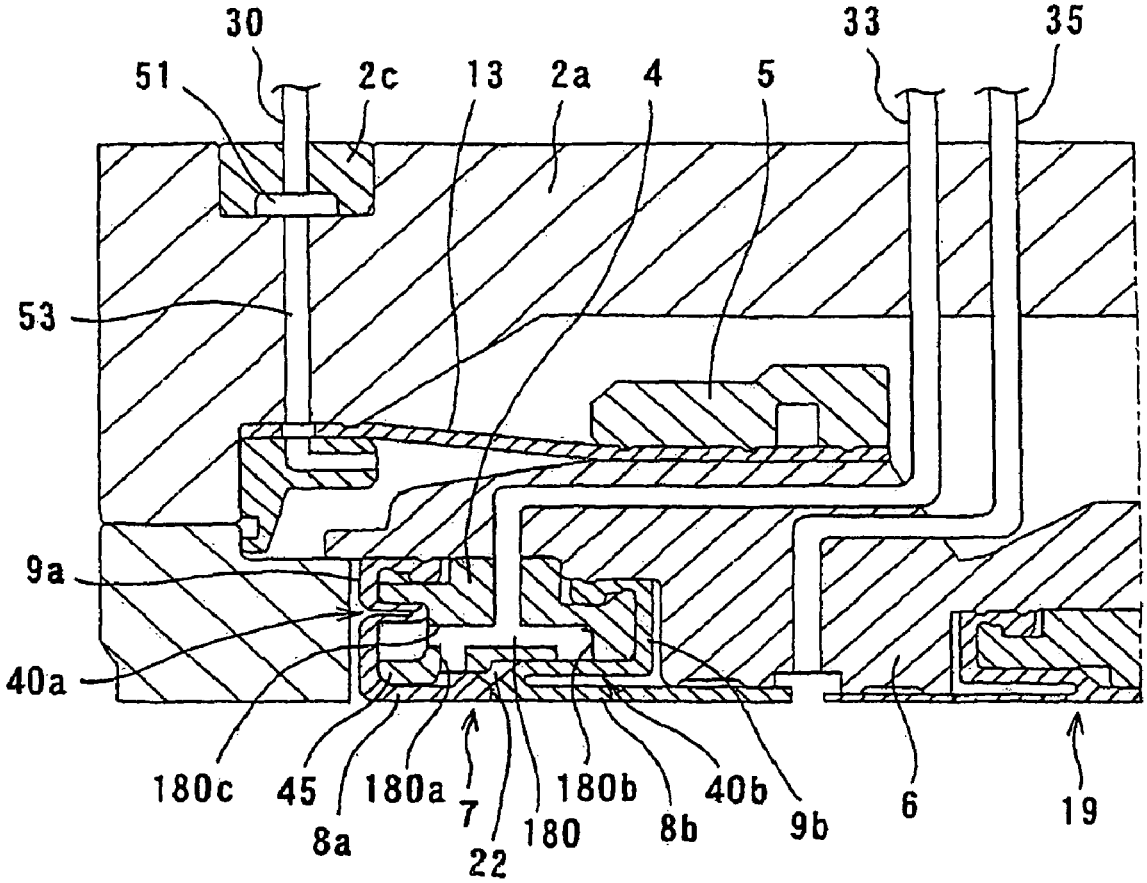
FIG. 7 is a fragmentary cross-sectional view showing a substrate holding apparatus according to a fourth embodiment of the present invention.

A substrate holding apparatus according to a fourth embodiment of the present invention will be described below with reference to FIG. 7. FIG. 7 is a fragmentary cross-sectional view showing the substrate holding apparatus according to the fourth embodiment of the present invention. Structural and operational details of the substrate holding apparatus according to the fourth embodiment of the present invention which will not be described below are identical to those of the substrate holding apparatus according to the third embodiment of the present invention. The substrate holding apparatus according to the fourth embodiment is different from the substrate holding apparatus according to the third embodiment in that a fluid supply port for supplying a pressurized fluid to an upper surface of the contact portion is provided in the edge ring, instead of providing grooves in the lower surface of the pressing member.

As shown in FIG. 7, edge ring 4 has a through hole 180 formed therein which communicates with fluid passage 33. The through hole 180 has three open mouths, i.e., a first open mouth 180*a* serving as a fluid supply port which opens toward outer contact portion 8*a* (contact portion 8), a second open mouth 180*b* which opens toward stretchable and contractible portion 40*b* of inner circumferential wall 9*b*, and a third open mouth 180*c* which opens at an outer circumferential surface of the edge ring 4. A pressurized fluid introduced into the through hole 180 through the fluid passage 33 is divided into three flows of the fluid in the edge ring 4. Specifically, the pressurized fluid forming a first flow is supplied from the first open mouth 180*a* to an upper surface of the outer contact portion 8*a*, the pressurized fluid forming a second flow is supplied from the second open mouth 180*b* to the stretchable and contractible portion 40*b* of the inner circumferential wall 9*b*, and the pressurized fluid forming a third flow is supplied from the third open mouth 180*c* to a backside surface of outer circumferential wall 9*a*.

With this structure, while the outer contact portion 8*a* is being pressed by the pressing member 45, the pressurized fluid is supplied to the upper surface of the outer contact portion 8*a*. Therefore, as with the third embodiment described above, while edge membrane 7 is being pressed by the pressing member 45, the pressurized fluid can start pressing the outer contact portion 8*a* (contact portion 8).

Figure 8A:
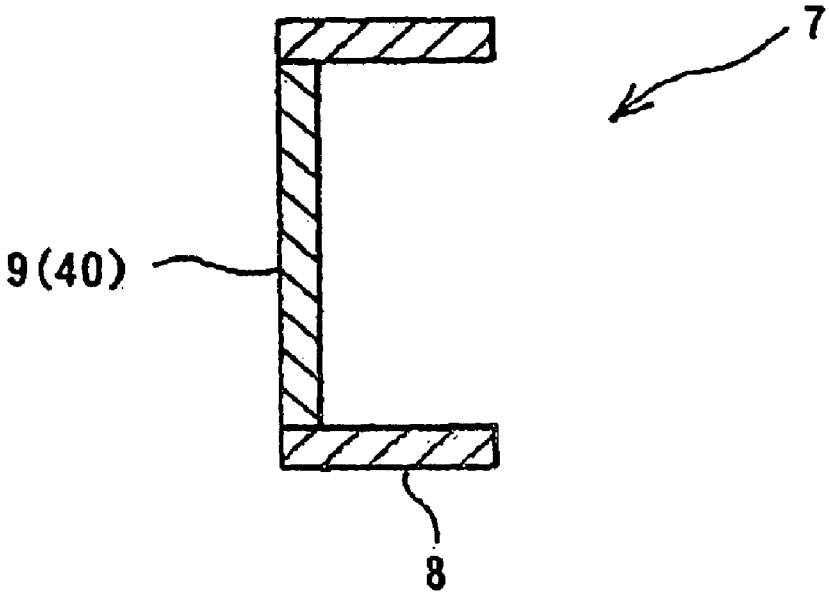
FIG. 8A is a cross-sectional view showing an edge membrane according to a fifth embodiment of the present invention.
Figure 8B:
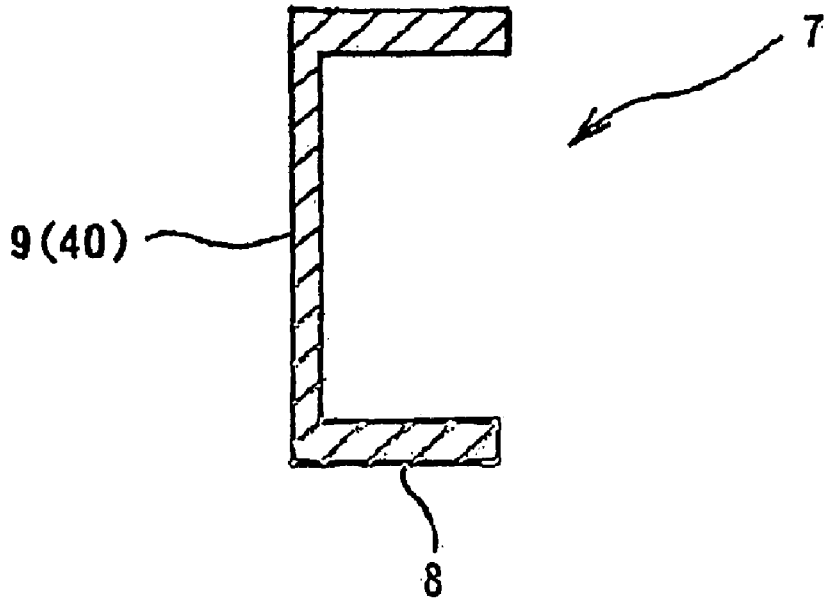
FIG. 8B is a cross-sectional view showing another structure of an edge membrane of the fifth embodiment of the present invention.

An edge membrane according to a fifth embodiment of the present invention will be described below with reference to FIGS. 8A and 8B. FIG. 8A is a cross-sectional view showing the edge membrane according to the fifth embodiment of the present invention, and FIG. 8B is a cross-sectional view showing another structure of an edge membrane of the fifth embodiment of the present invention.

With the edge membrane according to the first embodiment, the stretchable and contractible portion is provided by folding a portion of a circumferential wall along a circumferential direction. Alternatively, as shown in FIG. 8A, circumferential wall 9 may be made of a material which is softer than contact portion 8 so as to provide a stretchable and contractible portion 40. Alternatively, as shown in FIG. 8B, the circumferential wall 9 may be thinner than the contact portion 8 so as to provide a stretchable and contractible portion 40. According to these structures, as with the stretchable and contractible portions according to the above embodiments, the circumferential wall 9 can be stretched and contracted vertically, i.e., perpendicularly to a semiconductor wafer.

Figure 9A:
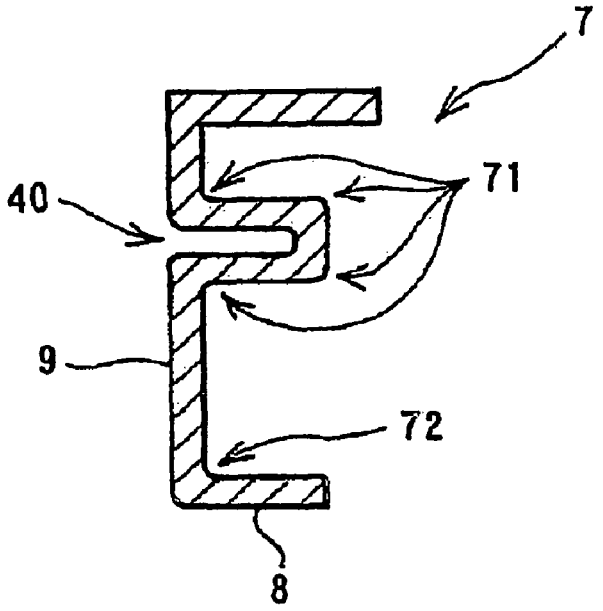
FIG. 9A is a cross-sectional view showing an edge membrane according to a sixth embodiment of the present invention.
Figure 9B:
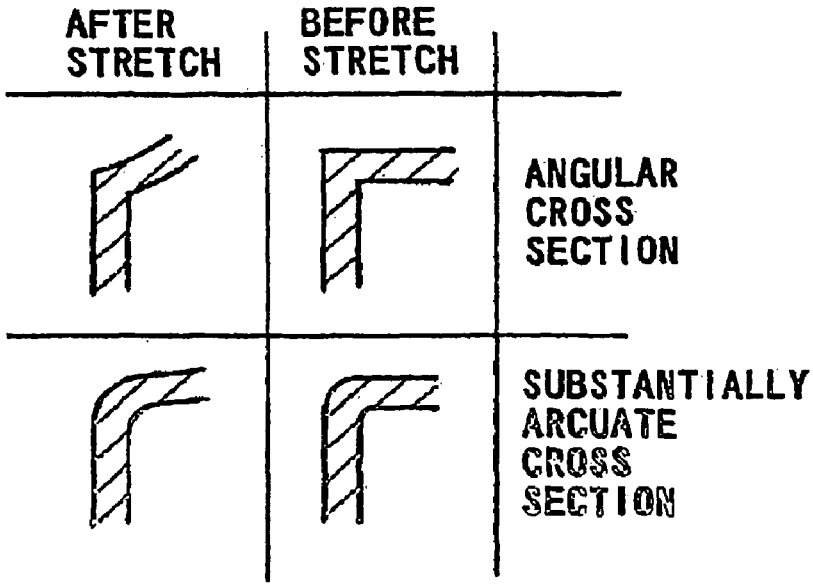
FIG. 9B is a reference view illustrating stretchability of the edge membrane according to the sixth embodiment of the present invention.

An edge membrane according to a sixth embodiment of the present invention will be described below with reference to FIGS. 9A and 9B. FIG. 9A is a cross-sectional view showing the edge membrane according to the sixth embodiment of the present invention, and FIG. 9B is a reference view illustrating a stretchability of the edge membrane according to the sixth embodiment of the present invention. The edge membrane according to the present embodiment has a basic structure which is identical to that of the edge membrane according to the second embodiment.

As shown in FIG. 9A, folded portions 71 of a stretchable and contractible portion 40 and a joint portion 72 between circumferential wall 9 and contact portion 8 have substantially arcuate cross sections, respectively. As shown in FIG. 9B, generally, if a joint portion between members has an angular cross section, then such an angular cross section maintains its shape even after these members are vertically stretched, thus causing stretchability of the members to be restricted. On the other hand, if a joint portion between members has a substantially arcuate cross section, then such a joint portion can be deformed flexibly, thus providing the members with excellent stretchability. With the above structure, therefore, the circumferential wall 9 including the stretchable and contractible portion 40 can be stretched smoothly.

Figure 10A:
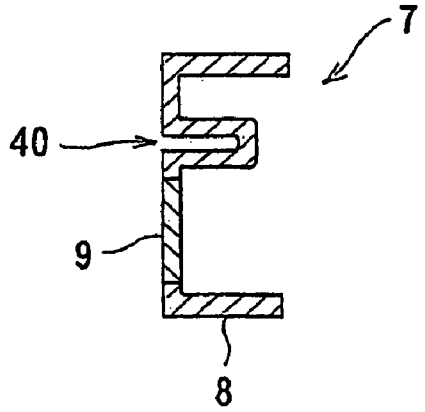
FIG. 10A is a cross-sectional view showing an edge membrane according to a seventh embodiment of the present invention.

An edge membrane according to a seventh embodiment of the present invention will be described below with reference to FIGS. 10A through 10E. FIG. 10A is a cross-sectional view showing the edge membrane according to the seventh embodiment of the present invention, and FIGS. 10B through 10E are cross-sectional views each showing another structure of an edge membrane of the seventh embodiment of the present invention. The edge membrane according to the present embodiment has a basic structure which is identical to that of the edge membrane according to the second embodiment.

Generally, when a semiconductor wafer is being polished, frictional force is produced between the semiconductor wafer held by a top ring and a polishing surface. Accordingly, an edge membrane may be twisted in a circumferential direction thereof, and hence intimate contact between the edge membrane and the semiconductor wafer tends to be impaired. Therefore, in an edge membrane 7 shown in FIGS. 10A through 10E, in order to prevent the edge membrane from being twisted, a portion of circumferential wall 9 positioned below stretchable and contractible portion 40 has an enhanced mechanical strength.

Figure 10B:
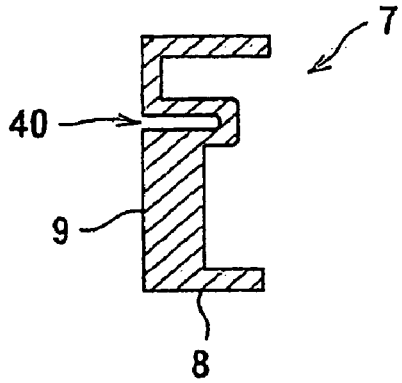
FIGS. 10B through 10E are cross-sectional views each showing another structure of an edge membrane of the seventh embodiment of the present invention.
Figure 10D:
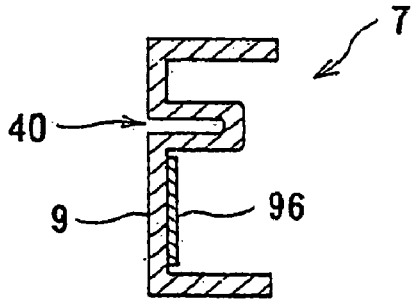
Figure 10C:
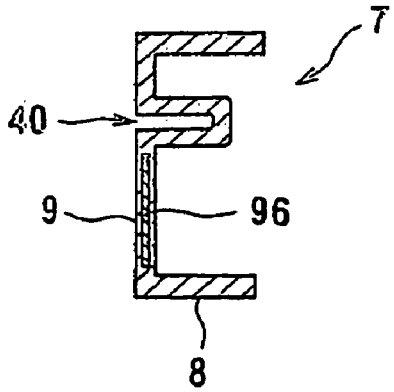
Figure 10E:
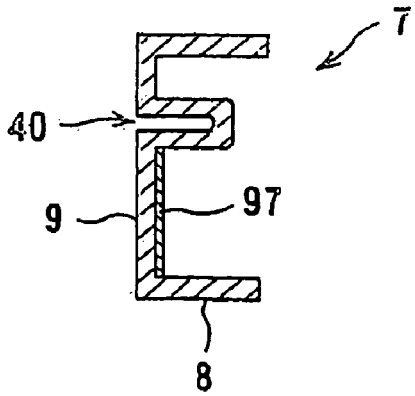

Specifically, FIG. 10A shows an edge membrane 7 in which a portion of the circumferential wall 9 positioned below the stretchable and contractible portion 40 is made of a material harder than contact portion 8. FIG. 10B shows an edge membrane 7 in which a portion of the circumferential wall 9 positioned below the stretchable and contractible portion 40 is thicker than the contact portion 8. FIG. 10C shows an edge membrane 7 in which a hard member 96 harder than the edge membrane 7 is embedded in a portion of the circumferential wall 9 positioned below the stretchable and contractible portion 40. FIG. 10D shows an edge membrane 7 in which a hard member 96 harder than the edge membrane 7 is fixed to a portion of the circumferential wall 9 positioned below the stretchable and contractible portion 40. FIG. 10E shows an edge membrane 7 in which a portion of the circumferential wall 9 positioned below the stretchable and contractible portion 40 is coated with a hard material 97 harder than the edge membrane 7. The hard member 96 preferably comprises a metal such as stainless steel having an excellent rust-resistant capability, or a resin. The edge membranes 7 having the above structures are prevented from being twisted in a circumferential direction thereof when a semiconductor wafer is being polished, thus enabling the edge membrane 7 and semiconductor wafer W to be kept in intimate contact with each other.

Figure 11A:
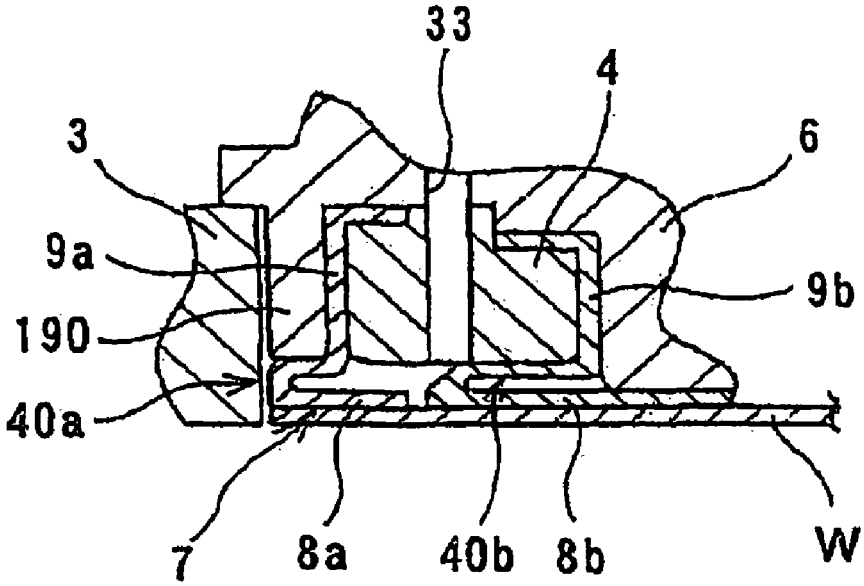
FIGS. 11A and 11B are fragmentary cross-sectional views showing a substrate holding apparatus according to an eighth embodiment of the present invention.
Figure 11B:
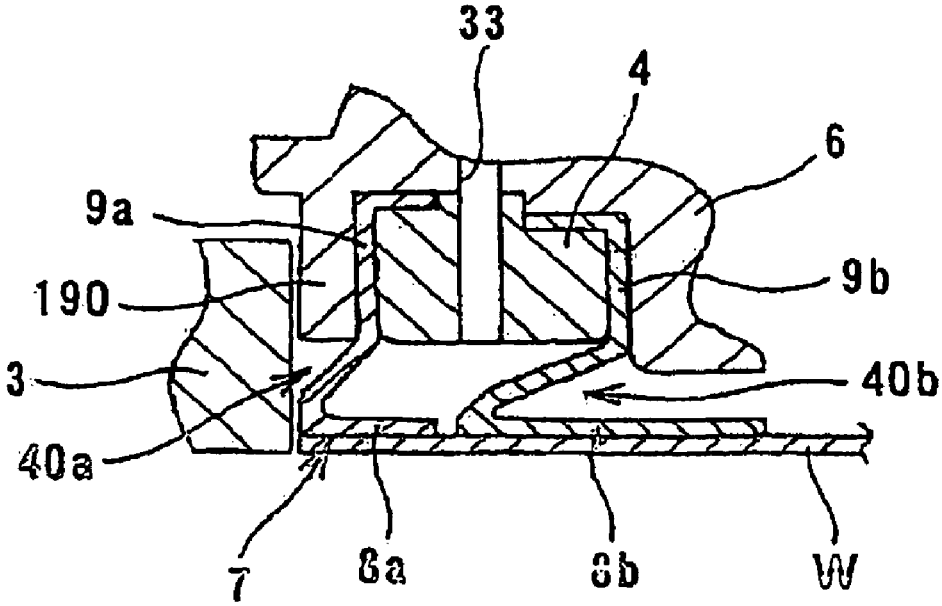

A substrate holding apparatus according to an eighth embodiment of the present invention will be described below with reference to FIGS. 11A and 11B. FIGS. 11A and 11B are fragmentary cross-sectional views showing the substrate holding apparatus according to the eighth embodiment of the present invention. Structural and operational details of the substrate holding apparatus according to the eighth embodiment of the present invention which will not be described below are identical to those of the substrate holding apparatus according to the first embodiment of the present invention.

As shown in FIG. 11A, outer circumferential wall 9*a* is folded radially inwardly along a circumferential direction thereof at a position near outer contact portion 8*a*, thus providing a stretchable and contractible portion 40*a*. The stretchable and contractible portion 40*a* is disposed below edge ring 4. A protection member 190 is disposed radially outwardly of the outer circumferential wall 9*a* (circumferential wall 9). The protection member 190 serves to prevent edge membrane 7 and retainer ring 3 from being brought into contact with each other. The protection member 190 is disposed on an outer circumferential edge of chucking plate 6 and is integrally formed with the chucking plate 6. Alternatively, the protection member 190 may be provided as a member separate from the chucking plate 6. With this structure, the edge membrane 7 and the retainer ring 3 are prevented from being brought into contact with each other, thus allowing the chucking plate 6 to move smoothly vertically.

A substrate holding apparatus according to a ninth embodiment of the present invention will be described below. Structural and operational details of the substrate holding apparatus according to the ninth embodiment of the present invention which will not be described below are identical to those of the substrate holding apparatus according to the first embodiment of the present invention.

Outer contact portion 8*a* and inner contact portion 8*b* constituting contact portion 8 have a plurality of fine convexities and concavities (not shown) on upper surfaces thereof. Such convexities and concavities are preferably formed by a graining process, for example. The graining process is a process for forming regular or irregular convexities and concavities on a surface of a workpiece so as to roughen the surface. With this structure having such convexities and concavities on the upper surfaces of the outer contact portion 8*a* and the inner contact portion 8*b*, adhesiveness of the inner contact portion 8*b* to chucking plate 6 can be weakened. Therefore, when the chucking plate 6 is moved upwardly, the inner contact portion 8*b* of edge membrane 7 is prevented from being moved upwardly together with the chucking plate 6. Further, in a case where pressing member 45 is brought into contact with the outer contact portion 8*a* as described in the second embodiment, the pressing member 45 can be easily brought out of contact with the outer contact portion 8*a*. In the present embodiment, lower surfaces of the outer contact portion 8*a* and the inner contact portion 8*b* of the contact portion 8 also have a plurality of fine convexities and concavities, so that a semiconductor wafer can be easily released from the edge membrane 7 after the substrate is polished.

In the above embodiments, the fluid passages 32, 33, 34, 35 and 36 are provided as separate passages. These fluid passages may be combined with each other, or the pressure chambers may be communicated with each other in accordance with a magnitude of a pressing force to be applied to the semiconductor wafer W and a position to which the pressing force is applied. The above embodiments may appropriately be combined with each other.

In the embodiments described above, the polishing surface is formed by the polishing pad. However, the polishing surface is not limited to such a structure. For example, the polishing surface may be formed by a fixed abrasive. The fixed abrasive is formed into a flat plate comprising abrasive particles fixed by a binder. With the fixed abrasive, a polishing process is performed by abrasive particles that are self-generated from the fixed abrasive. The fixed abrasive comprises abrasive particles, a binder, and pores. For example, cerium dioxide ($CeO_2$) having an average particle diameter of at most 0.5 μm is used as an abrasive particle, and epoxy resin is used as a binder. Such a fixed abrasive forms a harder polishing surface. The fixed abrasive includes a fixed abrasive pad having a two-layer structure formed by a thin layer of a fixed abrasive and an elastic polishing pad attached to a lower surface of the thin layer of the fixed abrasive. IC-1000 described above may be used for another hard polishing surface.

Figure 12A:
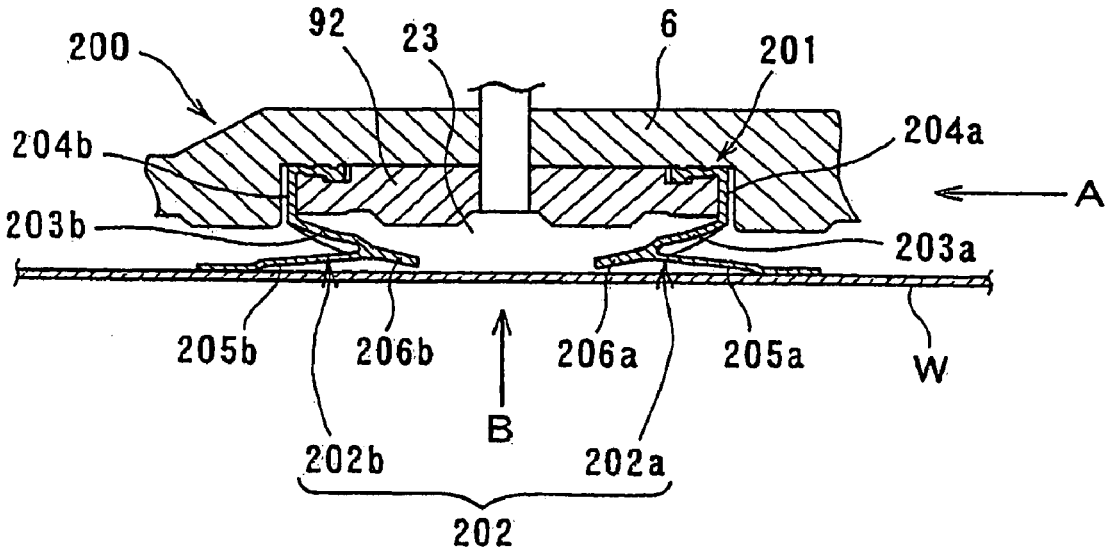
FIG. 12A is a cross-sectional view showing a part of a substrate holding apparatus according to a tenth embodiment of the present invention.
Figure 12B:
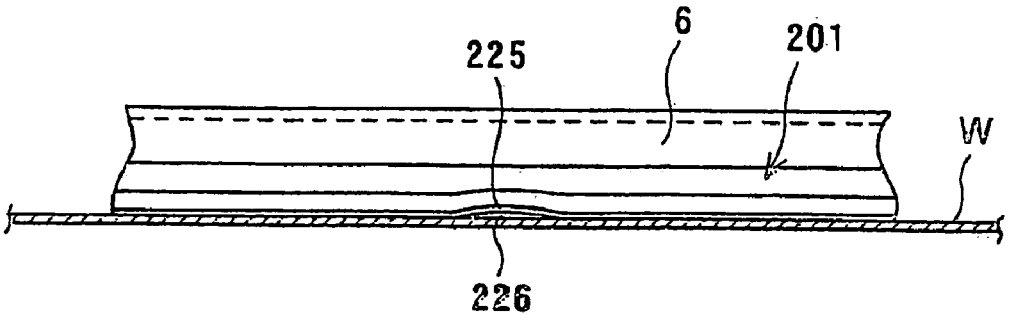
FIG. 12B is a view showing a part of the substrate holding apparatus as viewed in a direction indicated by arrow A in FIG. 12A.
Figure 13:
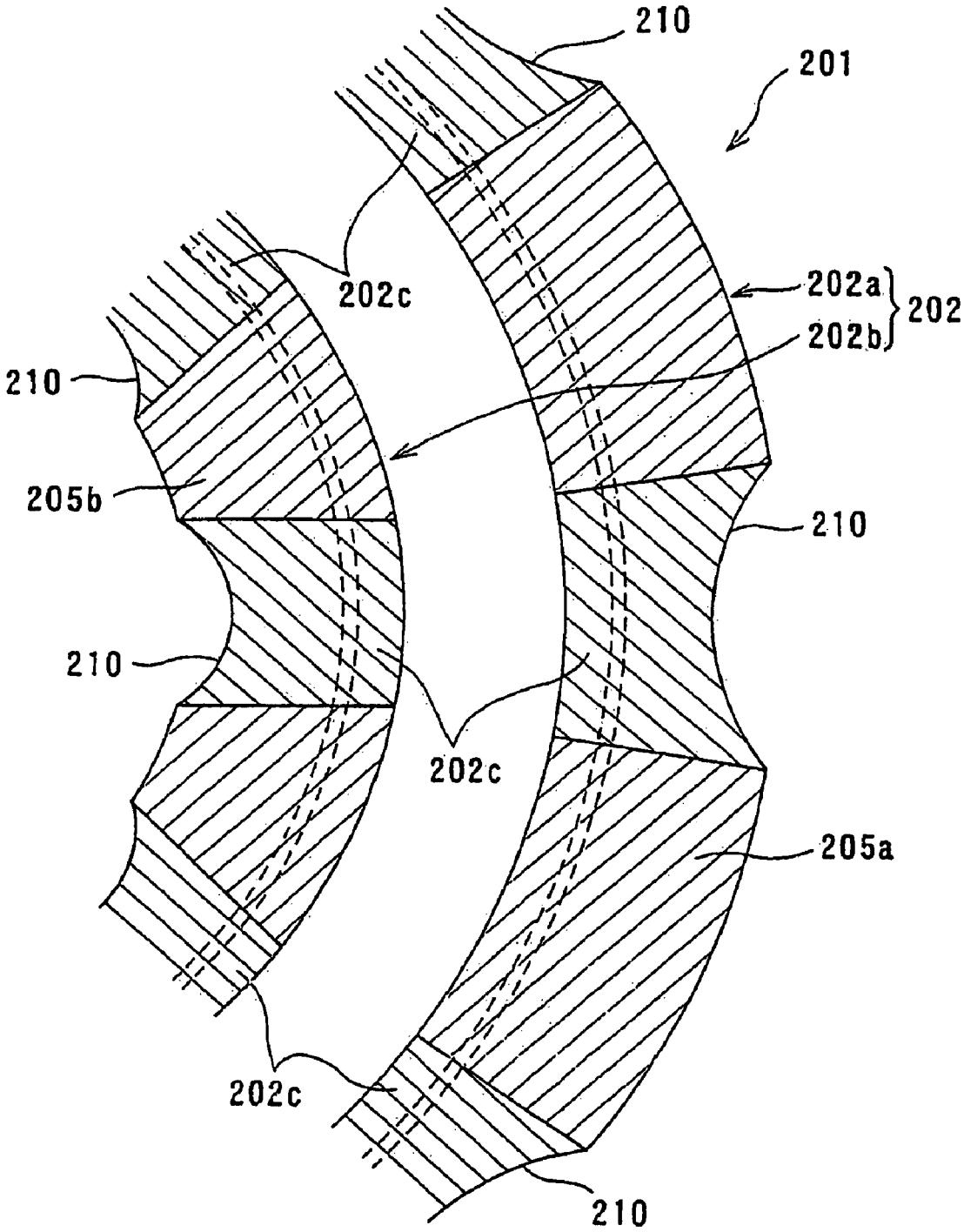
FIG. 13 is a view showing an intermediate membrane as viewed in a direction indicated by arrow B in FIG. 12A.
Figure 14:
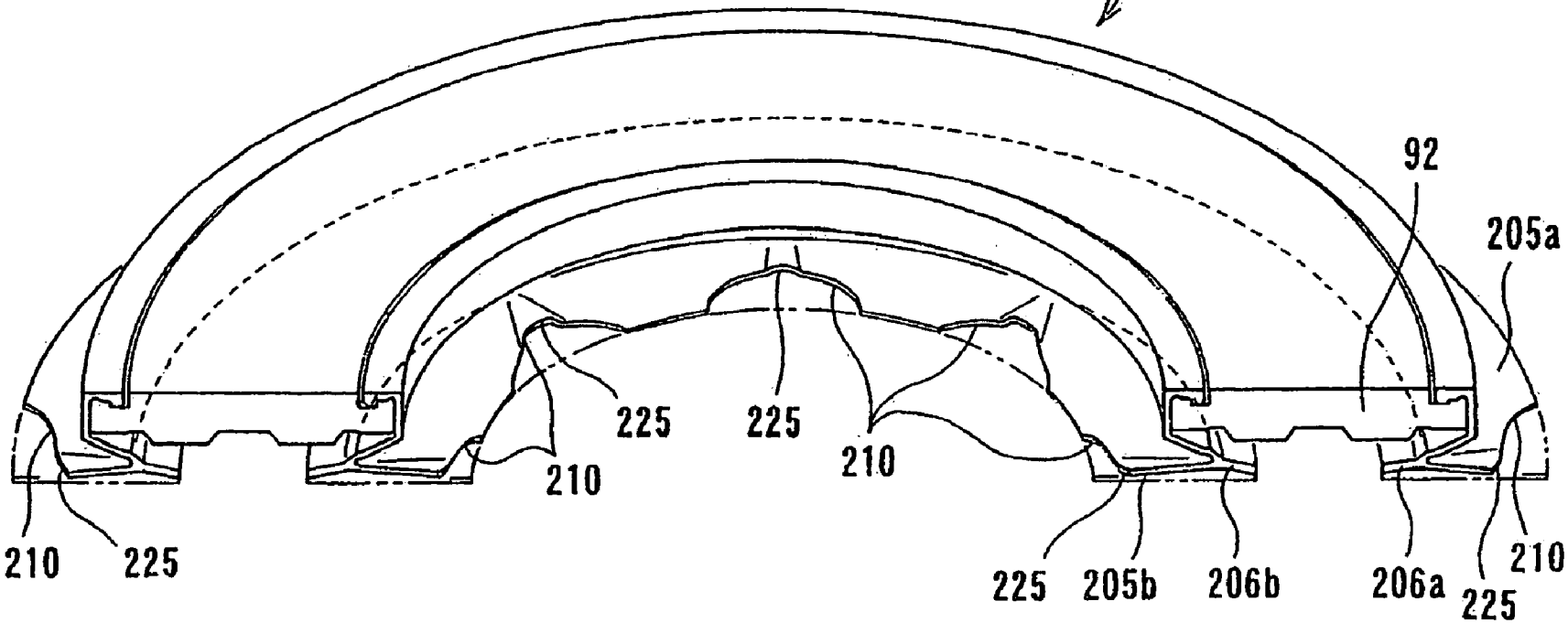
FIG. 14 is a perspective view showing an intermediate air bag incorporated in the substrate holding apparatus according to the tenth embodiment of the present invention.

A substrate holding apparatus according to a tenth embodiment of the present invention will be described below with reference to FIGS. 12A through 14. FIG. 12A is a cross-sectional view showing a part of the substrate holding apparatus according to the tenth embodiment of the present invention, and FIG. 12B is a view showing a part of the substrate holding apparatus as viewed in a direction indicated by arrow A in FIG. 12A. FIG. 13 is a view showing a part of an intermediate membrane as viewed in a direction indicated by arrow B in FIG. 12A. FIG. 14 is a perspective view showing an intermediate air bag incorporated in the substrate holding apparatus according to the tenth embodiment of the present invention. Structural and operational details of the substrate holding apparatus according to the tenth embodiment of the present invention which will not be described below are identical to those of the substrate holding apparatus according to the first embodiment of the present invention.

An intermediate air bag 200 comprises an intermediate membrane 201 having an intermediate contact portion 202 which is brought into contact with semiconductor wafer W. The intermediate membrane 201 serves as an elastic member and corresponds to the elastic membrane 91 in the first embodiment. The intermediate contact portion 202 has an outer intermediate contact portion 202*a* and an inner intermediate contact portion 202*b*. The outer intermediate contact portion 202*a* is disposed radially outwardly of the inner intermediate contact portion 202*b*. The outer intermediate contact portion 202*a* and the inner intermediate contact portion 202*b* have noses 205*a*, 205*b* extending outwardly from pressure chamber 23 and base portions 206*a*, 206*b* disposed in the pressure chamber 23, respectively. Hereinafter, the outer intermediate contact portion 202*a* and the inner intermediate contact portion 202*b* may be collectively referred to as the intermediate contact portion 202. The noses 205*a*, 205*b* correspond to the flanges 91*a* in the first embodiment.

The intermediate membrane 201 has extending portions 203*a*, 203*b* connected to the noses 205*a*, 205*b* and extending substantially parallel to the intermediate contact portion 202. The intermediate membrane 201 also has connecting portions 204*a*, 204*b* extending upwardly from tip ends of the extending portions 203*a*, 203*b* and connected to chucking plate 6 by air bag holder 92. The pressure chamber 23 is defined by the intermediate membrane 201, the air bag holder 92, and the semiconductor wafer W.

As shown in FIGS. 13 and 14, the noses 205*a*, 205*b* have a plurality of arcuate notches 210, each serving as a removal promoting portion, which are formed in circumferential edges of the noses 205*a*, 205*b* at circumferentially equal intervals. As shown in FIG. 13, the notches 210 are formed in respective regions 202*c* of the intermediate contact portion 202. The regions 202*c* are arranged along a circumferential direction of the intermediate contact portion 202 at circumferentially equal intervals. Each of the regions 202*c* is made of a material having a lower adhesiveness to the semiconductor wafer W than that of other regions of the intermediate contact portion 202. Surfaces, to be brought into contact with the semiconductor wafer W, of the regions 202*c* are grained to form fine convexities and concavities thereon by a satin finish process or blasting process. An entire lower surface of the intermediate contact portion 202 may be grained. The graining process is a process for forming fine convexities and concavities on a surface of a workpiece.

The noses 205*a*, 205*b* have upwardly concave recesses 225, each serving as a removal promoting portion, which are formed in circumferential edges thereof. As shown in FIG. 12B, a gap 226 is formed between the recess 225 and the semiconductor wafer W. When a pressurized fluid is supplied to pressure chambers 23, 24 and 25 (see FIG. 2), the recesses 225 are deformed to be brought into intimate contact with an upper surface of the semiconductor wafer W, thus making the pressure chamber 23 airtight. At this time, the gap 226 is not formed. When pressures in the pressure chambers 23, 24 and 25 are reduced to, e.g., atmospheric pressure, the recesses 225 are brought out of contact with the upper surface of the semiconductor wafer W. The recesses 225 are preferably formed in such positions that a lower portion of the chucking plate 6 is brought into contact with the recesses 225 when the chucking plate 6 is moved downwardly. In such positions, the recesses 225 are pressed downwardly against the semiconductor wafer W by the chucking plate 6, thus allowing an interior of the pressure chamber 23 to be sealed. In the present embodiment, the recesses 225 are formed in the notches 210, respectively, as shown in FIG. 14. However, locations of the recesses 225 are not limited to the positions of the notches 210.

Operation for releasing a semiconductor wafer according to a top ring, i.e. the substrate holding apparatus, having the above structure will be described below with reference to FIG. 2. After a polishing process is finished, supply of the pressurized fluid to the pressure chambers 22, 23, 24 and 25 is stopped, and the pressures in the pressure chambers 22, 23, 24 and 25 are reduced to atmospheric pressure. Then, the pressurized fluid is supplied to the pressure chamber 21 to move the chucking plate 6 downwardly, so that the contact portion 8 (see FIG. 4) and the intermediate contact portion 202 (see FIG. 12A) are brought into uniformly intimate contact with the upper surface of the semiconductor wafer W. In this state, a negative pressure is produced in the pressure chamber 23 or the pressure chamber 24 so as to attract the semiconductor wafer W under vacuum to the lower end of the top ring 1.

Thereafter, the top ring 1 is moved horizontally to an overhanging position where the top ring 1 overhangs the polishing table 100 (see FIG. 1), and then a negative pressure is produced in the pressure chamber 21 so as to move the chucking plate 6 upwardly. A negative pressure may be produced in the pressure chamber 21 when the top ring 1 is being moved to the overhanging position. Thereafter, the top ring 1 is moved upwardly to a position above a pusher, i.e. substrate lifting and lowering device which is not shown, that is disposed in the transfer position. Then, attraction of the semiconductor wafer W under vacuum by the pressure chamber 23 or the pressure chamber 24 is stopped.

Next, a fluid (e.g., a pressurized fluid or a mixture of nitrogen and pure water) is ejected from the fluid passage 35 or the fluid passage 34 to the semiconductor wafer W. Specifically, in a case where the semiconductor wafer W has a diameter of 300 mm, the fluid is ejected from the fluid passage 35. In a case where the semiconductor wafer W has a diameter of 200 mm, the fluid is ejected from the fluid passage 34. When the fluid is ejected to the semiconductor wafer W, the notches 210 and the recesses 225 of the intermediate contact portion 202 starts being removed from the semiconductor wafer W, and hence an ambient gas flows into the pressure chamber 23. Therefore, a sealed state of the pressure chamber 23 produced by the intermediate contact portion 202 is broken, thus allowing the semiconductor wafer W to be released from the intermediate air bag 200 smoothly and quickly. The notches 210 formed in the intermediate contact portion 202 are effective to allow the intermediate contact portion 202, particularly the noses 205*a*, 205*b*, to be easily brought out of contact with the semiconductor wafer W. Therefore, it is possible to release the semiconductor wafer W from the intermediate air bag 200 quickly. In the present embodiment, the intermediate contact portion 202 has the regions 202*c* whose widths in a radial direction are smaller than that of other regions, thereby providing the notches 210.

In this embodiment, as described above, the intermediate contact portion 202 is partly made of a material having a low adhesiveness to the semiconductor wafer W, and the intermediate contact portion 202 is partly grained to form the fine convexities and concavities on the lower surface thereof. With this structure, the semiconductor wafer W can be released from the intermediate air bag 200 smoothly. It is preferable to supply a fluid such as pure water between the semiconductor wafer W and the intermediate contact portion 202 at the same time that a fluid is ejected from the fluid passage 35 or the fluid passage 34. With this structure, the semiconductor wafer W can be released from the intermediate air bag 200 more smoothly.

Figure 15:
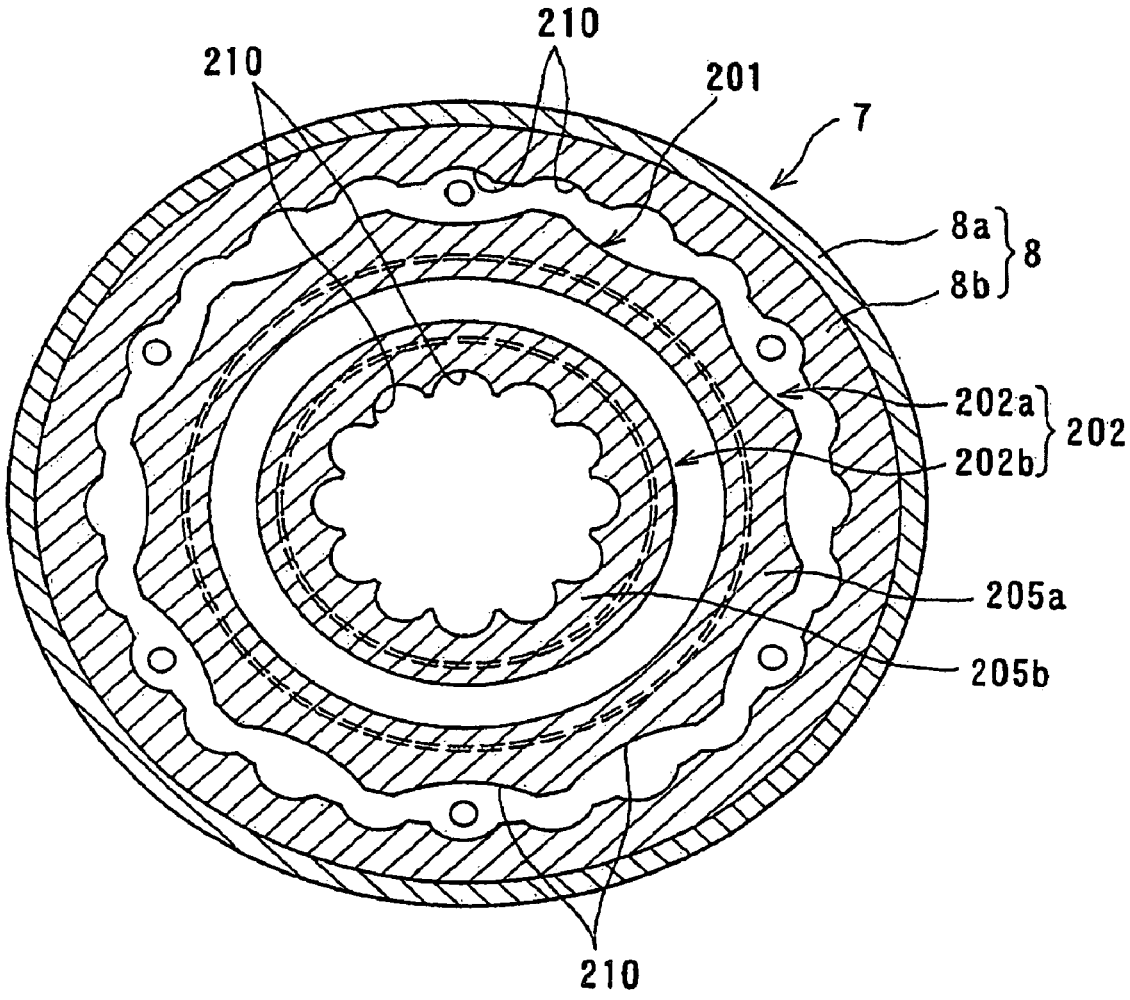
FIG. 15 is a rear view showing an elastic member incorporated in a substrate holding apparatus according to an eleventh embodiment of the present invention.

A substrate holding apparatus according to an eleventh embodiment of the present invention will be described below with reference to FIG. 15. FIG. 15 is a rear view showing an elastic member of the substrate holding apparatus according to the eleventh embodiment of the present invention. Structural and operational details of the substrate holding apparatus according to the eleventh embodiment of the present invention which will not be described below are identical to those of the substrate holding apparatus according to the first and tenth embodiments of the present invention.

As shown in FIG. 15, an elastic member comprises an edge membrane 7 disposed in an outermost circumferential region, and an intermediate membrane 201 disposed radially inwardly of the edge membrane 7. An inner contact portion 8*b* of the edge membrane 7 has notches 210 formed in an inner circumferential edge thereof. A nose 205*a* of an outer intermediate contact portion 202*a* and a nose 205*b* of an inner intermediate contact portion 202*b* have notches 210 formed in circumferential edges thereof, respectively. With this structure, when a fluid is supplied from fluid passage 35 or fluid passage 34 (see FIG. 2), the edge membrane 7 and the intermediate membrane 201 can quickly be removed from semiconductor wafer W. As described above, in the case where the semiconductor wafer W has a diameter of 300 mm, the fluid is ejected from the fluid passage 35, and in the case where the semiconductor wafer W has a diameter of 200 mm, the fluid is ejected from the fluid passage 34. At the same time that the fluid is ejected from the fluid passage 35 or the fluid passage 34, a fluid such as pure water is preferably supplied between the semiconductor wafer W and contact portion 8, and between the semiconductor wafer W and intermediate contact portion 202.

Figure 16:
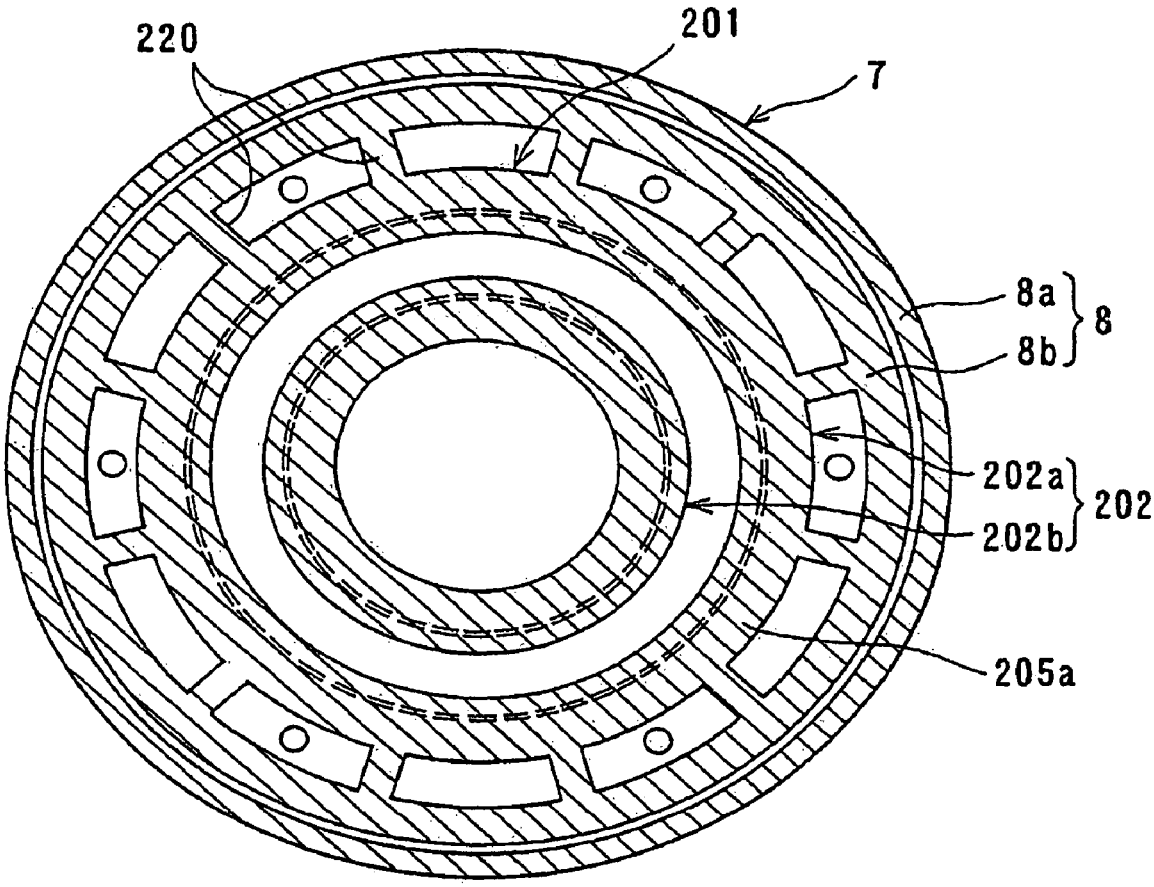
FIG. 16 is a rear view showing a first example of an elastic member incorporated in a substrate holding apparatus according to a twelfth embodiment of the present invention.
Figure 17:
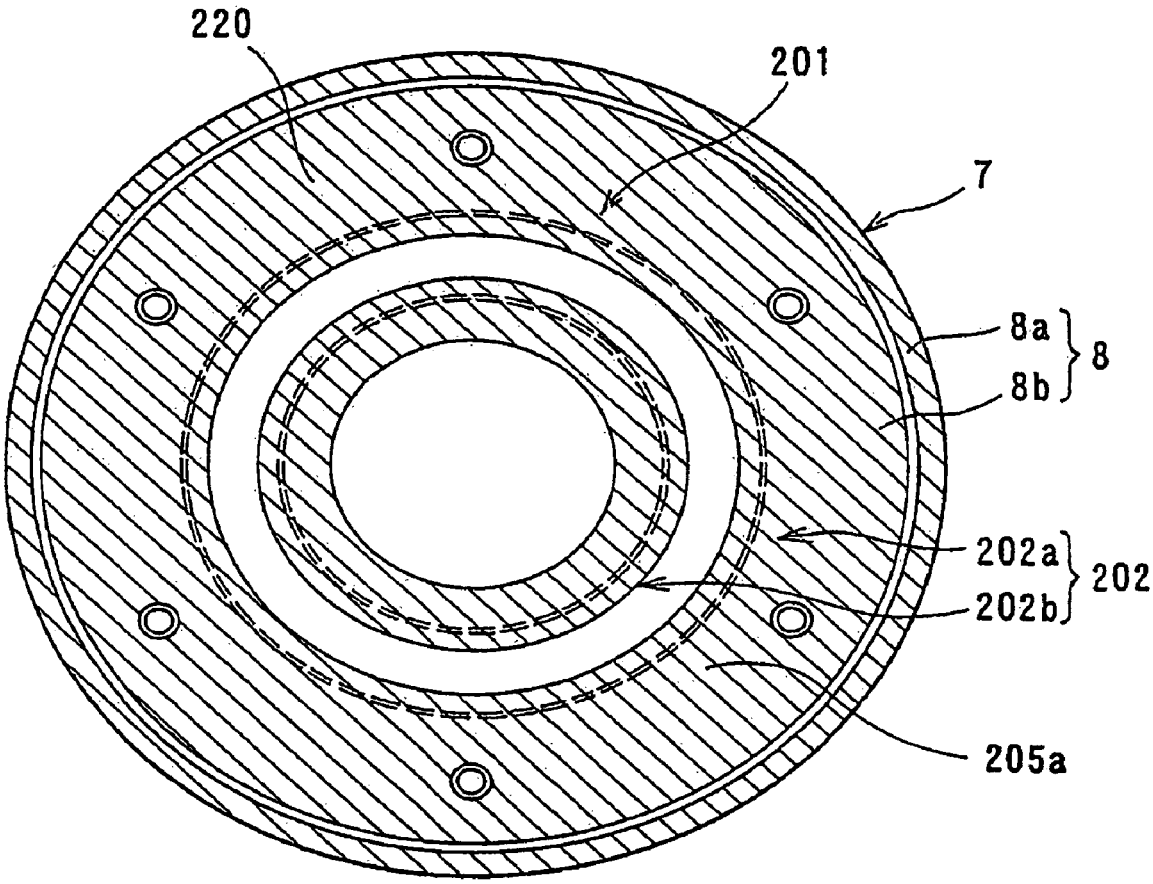
FIG. 17 is a rear view showing a second example of an elastic member incorporated in the substrate holding apparatus according to the twelfth embodiment of the present invention.
Figure 18:
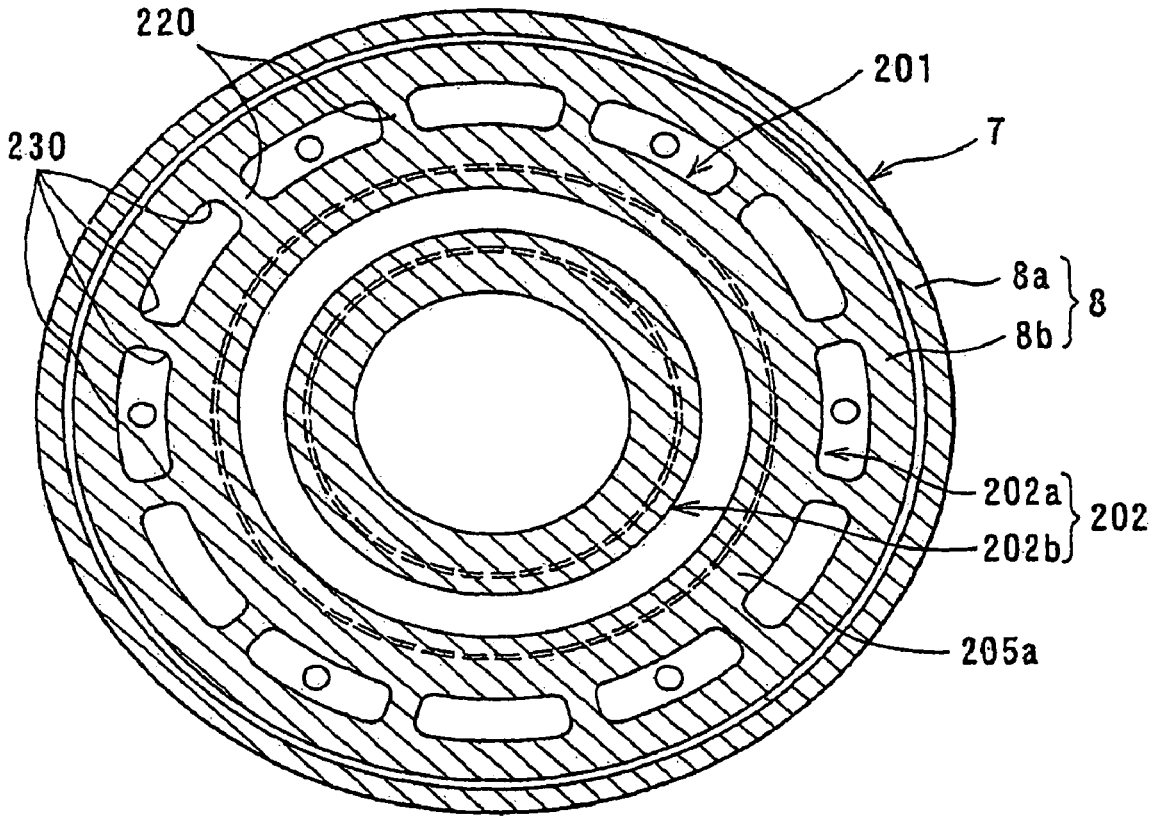
FIG. 18 is a rear view showing a third example of an elastic member incorporated in the substrate holding apparatus according to the twelfth embodiment of the present invention.
Figure 19:
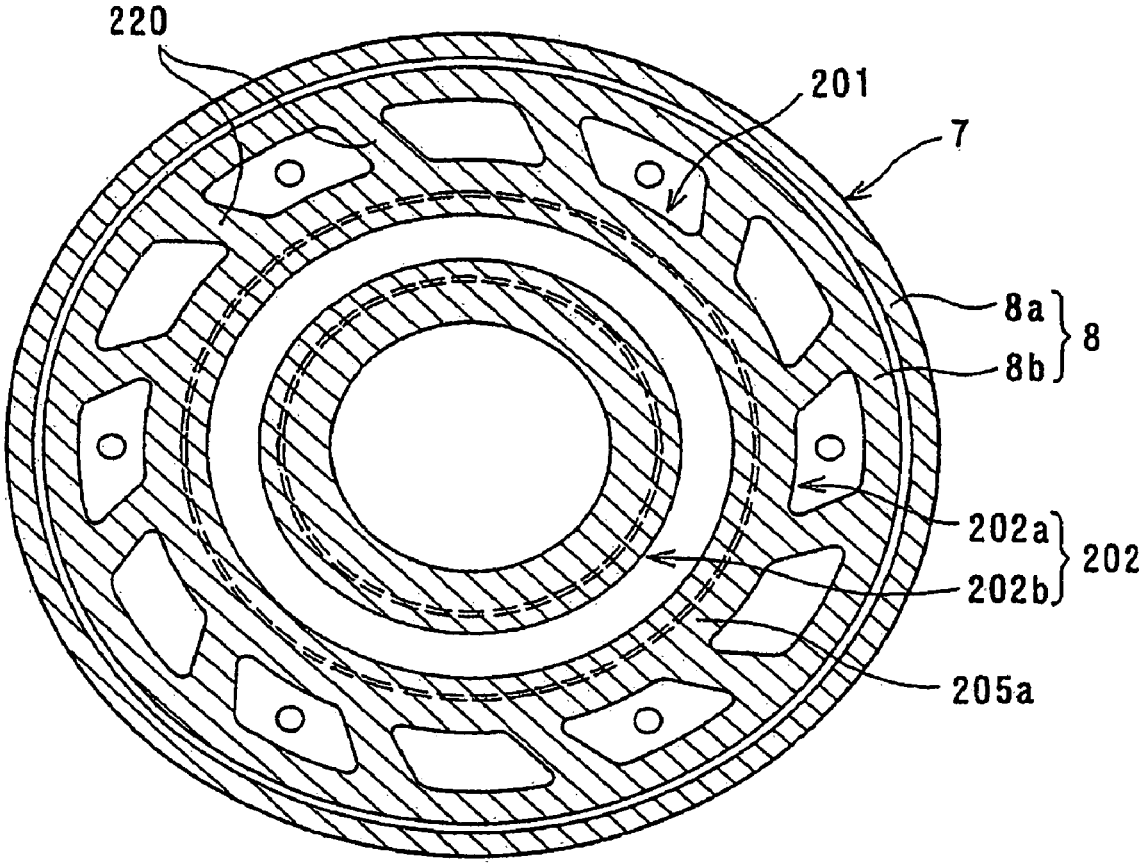
FIG. 19 is a rear view showing a fourth example of an elastic member incorporated in the substrate holding apparatus according to the twelfth embodiment of the present invention.

A substrate holding apparatus according to a twelfth embodiment of the present invention will be described below with reference to FIGS. 16 through 19. FIG. 16 is a rear view showing a first example of an elastic member incorporated in the substrate holding apparatus according to the twelfth embodiment of the present invention. FIG. 17 is a rear view showing a second example of an elastic member incorporated in the substrate holding apparatus according to the twelfth embodiment of the present invention. FIG. 18 is a rear view of a third example of an elastic member incorporated in the substrate holding apparatus according to the twelfth embodiment of the present invention. FIG. 19 is a rear view showing a fourth example of an elastic member incorporated in the substrate holding apparatus according to the twelfth embodiment of the present invention. Structural and operational details of the substrate holding apparatus according to the twelfth embodiment of the present invention which will not be described below are identical to those of the substrate holding apparatus according to the first and tenth embodiments of the present invention.

As shown in FIGS. 16 through 19, an elastic member comprises an edge membrane 7 disposed in an outermost circumferential region, and an intermediate membrane 201 disposed radially inwardly of the edge membrane 7. In a first example of the present embodiment shown in FIG. 16, a contact portion 8 of the edge membrane 7 and an intermediate contact portion 202 of the intermediate membrane 201 are connected to each other by a plurality of interconnecting portions 220 each serving as a removal promoting portion. Specifically, an inner contact portion 8*b* of the contact portion 8 and a nose 205*a* of an outer intermediate contact portion 202*a* are interconnected by the interconnecting portions 220. The interconnecting portions 220 extend radially from a circumferential edge of the nose 205*a* and are disposed at equal intervals in a circumferential direction of the nose 205*a*.

In a second example of the present embodiment shown in FIG. 17, the inner contact portion 8*b* and the nose 205*a* of the outer intermediate contact portion 202*a* are integrally connected to each other by an annular interconnecting portion 220. With this structure, the inner contact portion 8*b*, the outer intermediate contact portion 202*a*, and the interconnecting portion 220 are integrally formed as a single annular member.

In a third example of the present embodiment shown in FIG. 18, the inner contact portion 8*b* and the nose 205*a* are connected to each other by a plurality of radial interconnecting portions 220. Joint portions between the interconnecting portions 220 and the inner contact portion 8*b*, and joint portions between the interconnecting portions 220 and the nose 205*a* have fillets 230, respectively, for preventing stress from concentrating on these joint portions.

In a fourth example of the present embodiment shown in FIG. 19, the inner contact portion 8*b* and the nose 205*a* are connected to each other by a plurality of interconnecting portions 220 which extend obliquely to a radial direction.

With the structures shown in FIGS. 16 through 19, stretching of the nose 205*a* is limited by the interconnecting portions 220. Accordingly, the nose 205*a* is prevented from being stretched as semiconductor wafer W is moved downwardly when released. Therefore, when a fluid is ejected from fluid passage 35 or fluid passage 34, the semiconductor wafer W can quickly be released from the elastic member, i.e. the edge membrane 7 and the intermediate membrane 201. In a case where the semiconductor wafer W has a diameter of 300 mm, the fluid is ejected from the fluid passage 35, and in a case where the semiconductor wafer W has a diameter of 200 mm, the fluid is ejected from the fluid passage 34. A fluid such as pure water is preferably supplied between the semiconductor wafer W and the contact portion 8, and between the semiconductor wafer W and the intermediate contact portion 202. A reason why the inner contact portion 8*b* and the circumferential edge of the nose 205*a* are interconnected by the interconnecting portions 220 is that experiments show that the nose 205*a* of the outer intermediate contact portion 202*a* is most unlikely to be removed from the semiconductor wafer W.

Various embodiments of the present invention have been described above. However, the present invention is not limited to the above embodiments. Various modifications may be made within the scope of the technical concept of the invention.

According to the present invention, as described above, since the stretchable and contractible portion is stretched downwardly so as to follow upward movement of the vertically movable member, i.e. chucking plate, the contact portion which is held in contact with the substrate can maintain its shape. Therefore, the contact area between the elastic member and the substrate can be kept constant, and a uniform pressing force can be thus obtained over the entire surface of the substrate.

Even when the retainer ring is worn to cause a change in a distance between the vertically movable member and the substrate, the stretchable and contractible portion is stretched so as to follow a change of the distance. Thus, the contact portion which is held in contact with the substrate can maintain its shape. Consequently, it is possible to press the substrate under a uniform pressure over an entire region from a center of the substrate to an outer circumferential edge thereof. Therefore, a uniform polishing rate, i.e., polishing profile, can be achieved over the entire surface of the substrate. Further, since the stretchable and contractible portion is contracted in accordance with wear on the retainer ring, a worn retainer ring can be used without being replaced.

Furthermore, according to the present invention, when fluid is ejected to the upper surface of the substrate, the removal promoting portion starts being removed from the substrate to allow the contact portion to be smoothly removed from the substrate. Therefore, the substrate can be transferred to a substrate lifting and lowering device such as a pusher without being damaged by a fluid pressure. The substrate can also well be released from the elastic member without being affected by a type of the substrate, particularly a type of film that is formed on a backside surface (upper surface) of the substrate.

A substrate holding apparatus and a polishing apparatus according to a thirteenth embodiment of the present invention will be described in detail below with reference to the drawings.

Figure 20:
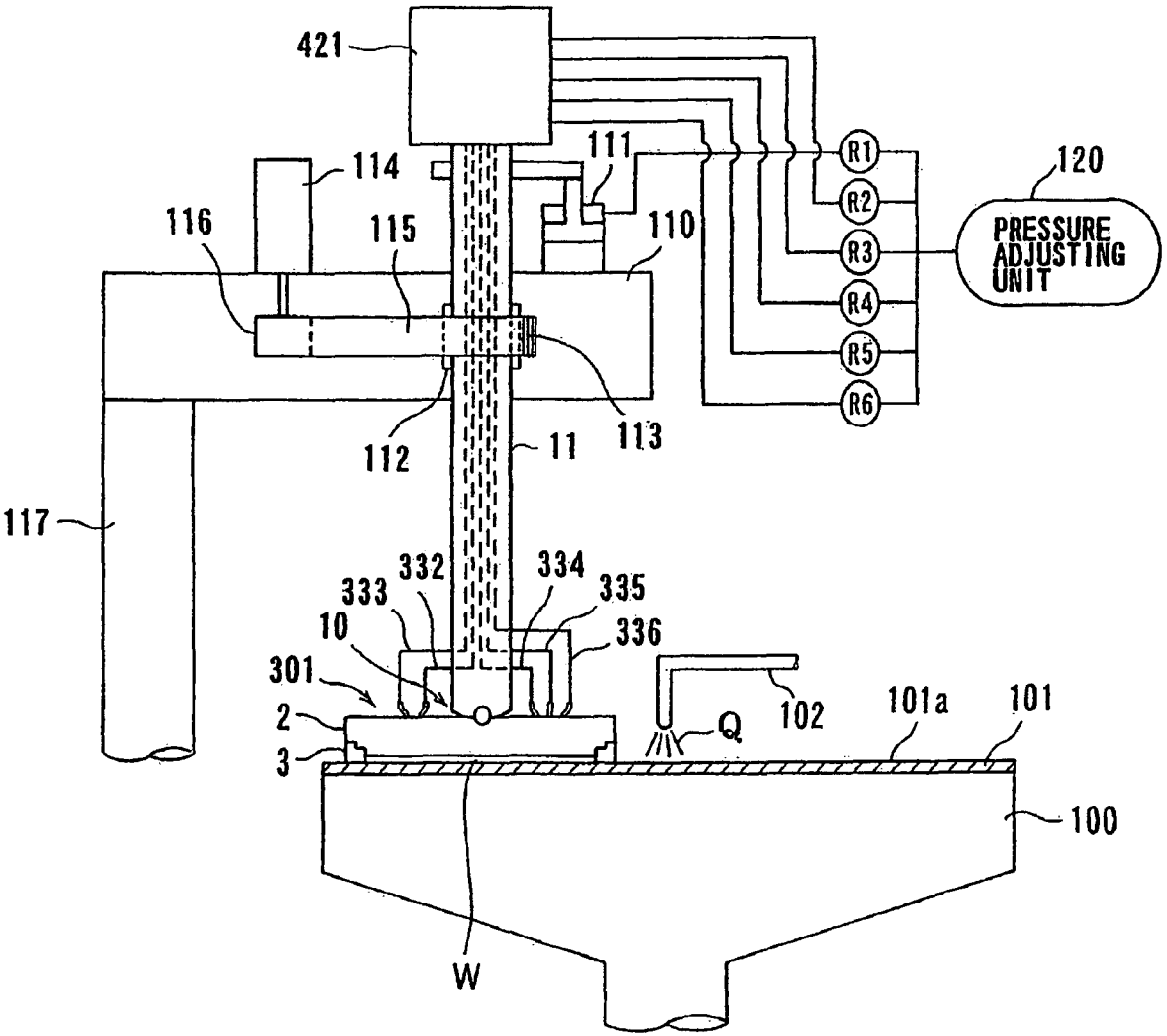
FIG. 20 is a cross-sectional view showing an entire structure of a polishing apparatus having a substrate holding apparatus according to a thirteenth embodiment of the present invention.

FIG. 20 is a cross-sectional view showing an entire structure of a polishing apparatus having a substrate holding apparatus according to the thirteenth embodiment of the present invention. Structural and operational details of the substrate holding apparatus and the polishing apparatus according to the thirteenth embodiment which will not be described below are identical to those of the substrate holding apparatus and the polishing apparatus according to the first embodiment.

As shown in FIG. 20, fluid passages 332, 333, 334, 335 and 336 extend through an interior of top ring drive shaft 11, and are connected to pressure adjusting unit 120 through a rotary joint 421 disposed on an upper end of the top ring drive shaft 11.

Figure 21:
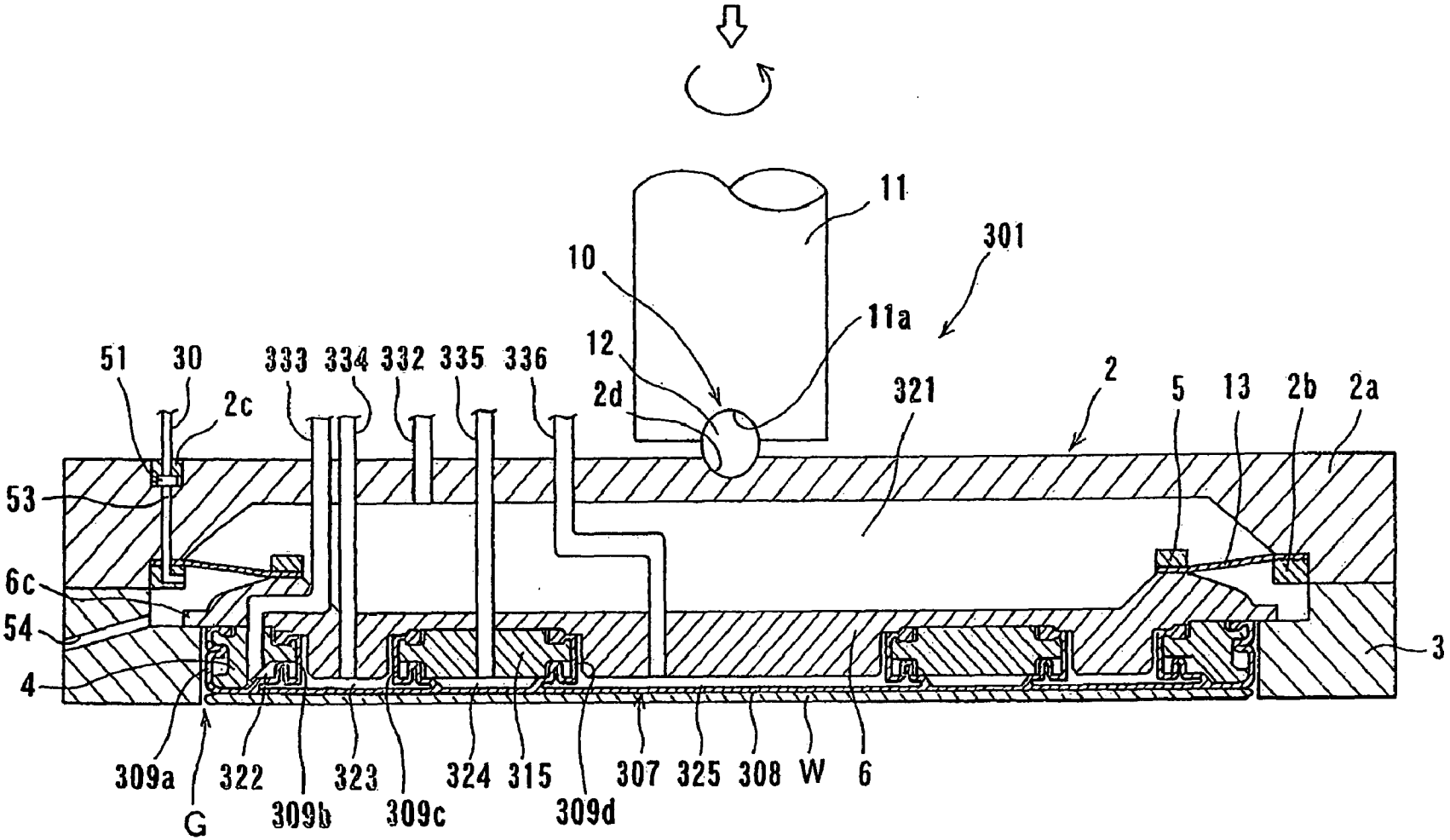
FIG. 21 is a vertical cross-sectional view showing a top ring of the thirteenth embodiment of the present invention.

A top ring 301 serving as the substrate holding apparatus according to the present invention will be described below. FIG. 21 is a vertical cross-sectional view showing a top ring according to the thirteenth embodiment.

As shown in FIG. 21, top ring body 2 and retainer ring 3 integrally fixed to the top ring body 2 define a housing space therein. Annular holder ring 5 and disk-shaped chucking plate 6 serving as a movable member is disposed in the housing space. The chucking plate 6 is movable in a vertical direction within the housing space. The vertical direction means a direction perpendicular to polishing surface 101*a*. The top ring body 2, the chucking plate 6, the holder ring 5, and pressurizing sheet 13 jointly define a pressure chamber 321 in the top ring body 2. As shown in FIG. 21, the pressure chamber 321 communicates with the fluid passage 332 comprising a tube, a connector, and the like. The pressure chamber 321 is connected to the pressure adjusting unit 120 via regulator R2 provided in the fluid passage 332.

An elastic membrane 307, to be brought into contact with semiconductor wafer W, is attached to a lower portion of the chucking plate 6. The elastic membrane 307 has a circular contact portion 308 which is brought into contact with an entire upper surface of the semiconductor wafer W. The elastic membrane 307 also has a plurality of annular circumferential walls extending upwardly from the contact portion 308 and connected to the chucking plate 6. Specifically, the circumferential walls comprise a first circumferential wall 309*a*, a second circumferential wall 309*b*, a third circumferential wall 309*c*, and a fourth circumferential wall 309*d*, which are collectively referred to as circumferential walls 309*a* through 309*d*. The elastic membrane 307 has an integral structure as a one-piece member.

The first circumferential wall 309*a* is disposed on an outer circumferential edge of the contact portion 308. The second circumferential wall 309*b* is disposed radially inwardly of the first circumferential wall 309*a* with a predetermined distance from the first circumferential wall 309*a*. The third circumferential wall 309*c* is disposed radially inwardly of the second circumferential wall 309*b* with a predetermined distance from the second circumferential wall 309*b*. The fourth circumferential wall 309*d* is disposed radially inwardly of the third circumferential wall 309*c* with a predetermined distance from the third circumferential wall 309*c*. The first circumferential wall 309*a*, the second circumferential wall 309*b*, the third circumferential wall 309*c*, and the fourth circumferential wall 309*d* are arranged concentrically with each other.

The first circumferential wall 309*a* and the second circumferential wall 309*b* have respective upper ends clamped between the chucking plate 6 and annular edge ring 4. The third circumferential wall 309*c* and the fourth circumferential wall 309*d* have respective upper ends clamped between the chucking plate 6 and an annular holder 315. The edge ring 4 and the holder 315 are fastened to the chucking plate 6 by bolts (not shown), respectively, so that the elastic membrane 307 is detachably mounted on the chucking plate 6.

The elastic membrane 307 is made of a highly strong and durable rubber material such as ethylene propylene rubber (EPDM), polyurethane rubber, silicone rubber, as with pressurizing sheet 13. The rubber material of the elastic membrane 307 should preferably have a hardness (duro) ranging from 20 to 60. The elastic membrane 307 may have a single circumferential wall, or may have a plurality of circumferential walls as with the present embodiment.

Four pressure chambers 322, 323, 324 and 325 are defined on a backside surface, i.e. an upper surface, of the elastic membrane 307. Specifically, the contact portion 308, the first circumferential wall 309*a*, the second circumferential wall 309*b*, and the edge ring 4 define an annular space serving as the pressure chamber 322. The pressure chamber 322 communicates with the fluid passage 333 comprising a tube, a connector, and the like. The pressure chamber 322 is connected to the pressure adjusting unit 120 through regulator R3 provided in the fluid passage 333.

The contact portion 308, the second circumferential wall 309*b*, the third circumferential wall 309*c*, and the chucking plate 6 define an annular space serving as the pressure chamber 323. The pressure chamber 323 communicates with the fluid passage 334 comprising a tube, a connector, and the like. The pressure chamber 323 is connected to the pressure adjusting unit 120 through regulator R4 provided in the fluid passage 334.

The contact portion 308, the third circumferential wall 309*c*, the fourth circumferential wall 309*d*, and the holder 315 define an annular space serving as the pressure chamber 324. The pressure chamber 324 communicates with the fluid passage 335 comprising a tube, a connector, and the like. The pressure chamber 324 is connected to the pressure adjusting unit 120 through regulator R5 provided in the fluid passage 335.

The contact portion 308, the fourth circumferential wall 309*d*, and the chucking plate 6 define a circular space serving as the pressure chamber 325. The pressure chamber 325 communicates with the fluid passage 336 comprising a tube, a connector, and the like. The pressure chamber 325 is connected to the pressure adjusting unit 120 through regulator R6 provided in the fluid passage 336. The fluid passages 332, 333, 334, 335 and 336 extend through the interior of the top ring drive shaft 11, and are connected to the regulators R2 through R6 through the rotary joint 421, respectively.

The pressure chamber 321 defined above the chucking plate 6 and the pressure chambers 322, 323, 324 and 325 are supplied with a pressurized fluid such as pressurized air, or atmospheric pressure or vacuum is produced in the pressure chambers 321, 322, 323, 324 and 325, through the fluid passages 332, 333, 334, 335 and 336 connected to respective pressure chambers. Specifically, the regulators R2 through R6 provided respectively in the fluid passages 332, 333, 334, 335 and 336 can respectively regulate pressures of the pressurized fluids supplied to the respective pressure chambers 321, 322, 323, 324 and 325. Thus, it is possible to independently control pressures in the pressure chambers 321, 322, 323, 324 and 325, or independently produce atmospheric pressure or vacuum in the pressure chambers 321, 322, 323, 324 and 325.

The pressures in the respective pressure chambers 322, 323, 324 and 325 are independently controlled based on a film thickness measured by one or more film thickness measuring devices that are embedded in polishing table 100 for measuring a thickness of a film on a polished surface of semiconductor wafer W. The film thickness measuring device may comprise an optical-type film thickness measuring device which utilizes light interference or light reflection, or an eddy-current-type film thickness measuring device. A signal from the film thickness measuring device is analyzed based on radial positions of the semiconductor wafer W so as to control internal pressures of the respective pressure chambers 322, 323, 324 and 325 which are concentrically arranged.

In this case, the pressurized fluid supplied to the pressure chambers 322, 323, 324 and 325, or atmospheric air supplied to the above pressure chambers when producing atmospheric pressure therein may independently be controlled in terms of temperature. With such a structure, it is possible to directly control a temperature of a workpiece such as a semiconductor wafer from a backside of a surface to be polished. Particularly, when the temperatures of the respective pressure chambers are independently controlled, a rate of chemical reaction can be controlled during a chemical polishing process of CMP.

Temperatures in the pressure chambers 322, 323, 324 and 325 are usually controlled based on a signal from the film thickness measuring device, in the same manner as internal pressure control of the respective pressure chambers described above.

The retainer ring 3 has an air vent hole 54 formed therein. Communication holes 53 communicate with the air vent hole 54 and a small gap G formed between an outer circumferential surface of the elastic membrane 307 (the first circumferential wall 309*a*) and an inner circumferential surface of the retainer ring 3.

Figure 22A:
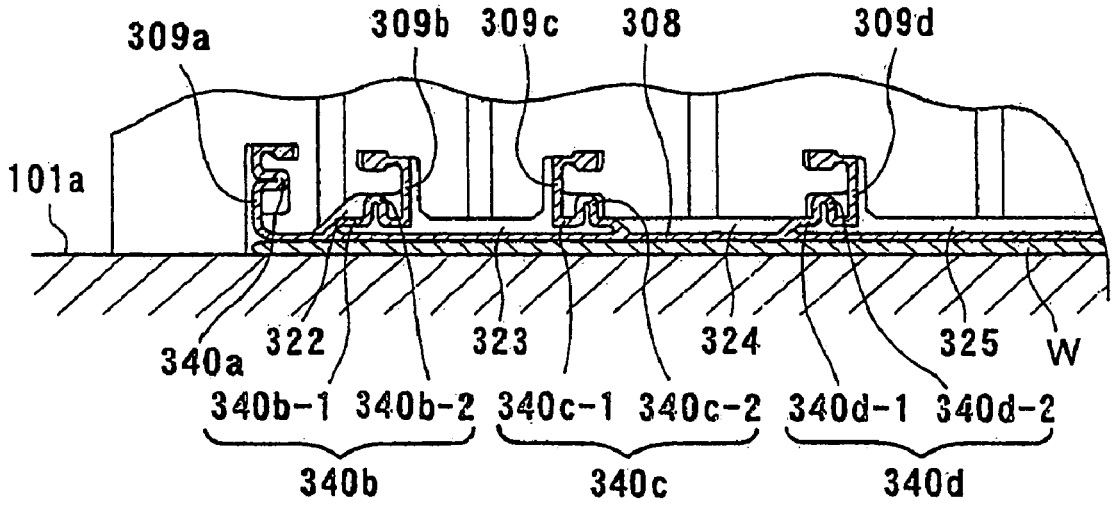
FIG. 22A is a view showing a part of the top ring according to the thirteenth embodiment of the present invention.
Figure 22B:
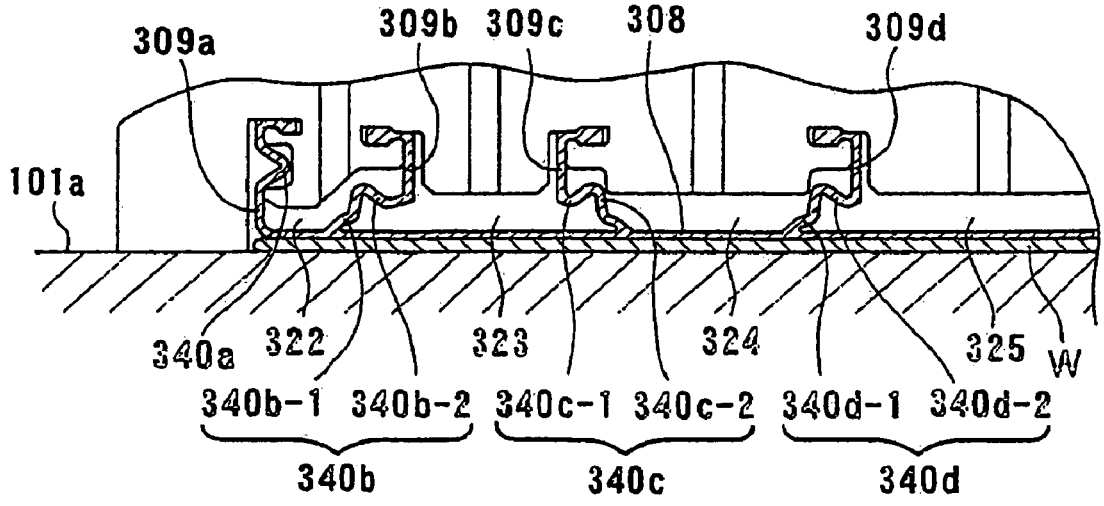
FIG. 22B is a view showing a state in which a fluid is supplied to pressure chambers.

The elastic membrane 307 according to the present embodiment will be described in detail below with reference to FIGS. 22A and 22B. FIG. 22A is a view showing a part of the top ring according to the thirteenth embodiment of the present invention, and FIG. 22B is a view showing a state in which a fluid is supplied to the pressure chambers. In order to simplify these figures, structural details other than the elastic membrane are schematically illustrated in FIGS. 22A and 22B.

As shown in FIG. 22A, the first circumferential wall 309*a* has a stretchable and contractible portion 340*a* which is stretchable and contractible vertically, i.e., perpendicularly to the polishing surface 101*a*. The stretchable and contractible portion 340*a* comprises a folded-back portion projecting radially inwardly. The stretchable and contractible portion 340*a* is positioned in a substantially central region of the first circumferential wall 309*a* where the stretchable and contractible portion 340*a* has no influence on the contact portion 308. The second circumferential wall 309*b* also has a stretchable and contractible portion 340*b* which is stretchable and contractible vertically. The stretchable and contractible portion 340*b* comprises a horizontal portion 340*b*-1 extending radially outwardly and positioned near a lower end of the second circumferential wall 309*b*, and a folded-back portion 340*b*-2 projecting upwardly from the horizontal portion 340*b*-1. The folded-back portion 340*b*-2 is stretchable and contractible in a horizontal direction, i.e. parallel to the polishing surface 101*a*.

The third circumferential wall 309*c* has a stretchable and contractible portion 340*c* which is stretchable and contractible vertically. The stretchable and contractible portion 340*c* comprises a horizontal portion 340*c*-1 extending radially inwardly and positioned near a lower end of the third circumferential wall 309*c*, and a folded-back portion 340*c*-2 projecting upwardly from the horizontal portion 340*c*-1. The fourth circumferential wall 309*d* also has a stretchable and contractible portion 340*d* which is stretchable and contractible vertically. The stretchable and contractible portion 340*d* comprises a horizontal portion 340*d*-1 extending radially outwardly and positioned near a lower end of the fourth circumferential wall 309*d*, and a folded-back portion 340*d*-2 projecting upwardly from the horizontal portion 340*d*-1. The folded-back portion 340*c*-2 and the folded-back portion 340*d*-2 are stretchable and contractible in a horizontal direction, i.e. parallel to the polishing surface 101*a*.

Since the circumferential walls 309*a*, 309*b*, 309*c* and 309*d* have the stretchable and contractible portions 340*a*, 340*b*, 340*c* and 340*d*, respectively, the circumferential walls 309*a*, 309*b*, 309*c* and 309*d* can be stretched and contracted while the contact portion 308 maintains its shape. Specifically, the circumferential walls 309*a*, 309*b*, 309*c* and 309*d* including their respective stretchable and contractible portions 340*a*, 340*b*, 340*c* and 340*d* can be stretched uniformly in the vertical direction. Therefore, as shown in FIG. 22B, when a pressurized fluid is supplied to the pressure chambers 322, 323, 324 and 325 so as to lift the chucking plate 6 (see FIG. 21), the stretchable and contractible portions 340*a*, 340*b*, 340*c* and 340*d* are stretched so as to follow upward movement of the chucking plate 6. Therefore, a constant area between the elastic membrane 307 (the contact portion 308) and the semiconductor wafer W can be kept constant.

Next, operation of top ring 301 having the above structure will be described in detail.

In the polishing apparatus having the above structure, when a semiconductor wafer W is to be transferred to the polishing apparatus, the top ring 301 as a whole is moved to a transfer position where the semiconductor wafer W is transferred. In the case where the semiconductor wafer W has a diameter of 200 mm, the pressure adjusting unit 120 communicates with the pressure chamber 323 through the fluid passage 334. On the other hand, in the case where the semiconductor wafer W has a diameter of 300 mm, the pressure adjusting unit 120 communicates with the pressure chamber 324 through the fluid passage 335.

The contact portion 308 constituting the pressure chamber 323 and the pressure chamber 324 has holes or recesses (not shown), respectively, through which the semiconductor W is directly attracted to and held by a lower end of the top ring 301.

With the semiconductor wafer W attracted to the top ring 301, the top ring 301 as a whole is moved to a position above polishing table 100 having polishing surface 101*a*. An outer circumferential edge of the semiconductor wafer W is held by retainer ring 3, so that the semiconductor wafer W is not removed from the top ring 301, or the semiconductor wafer W does not slide.

Thereafter, attraction of the semiconductor wafer W is released. About at the same time, top ring air cylinder 111 connected to top ring drive shaft 11 is actuated to press the retainer ring 3 fixed to the lower end of the top ring 301 against the polishing surface 101*a* of the polishing table 100 under a predetermined pressure. Then, pressurized fluid is supplied to the pressure chamber 321 so as to move the chucking plate 6 downwardly, thereby bringing the contact portion 308 of the elastic membrane 307 into contact with the semiconductor wafer W. Thereafter, pressurized fluids having respective pressures are supplied respectively to the pressure chambers 322, 323, 324 and 325, so that the chucking plate 6 is moved upwardly and simultaneously the semiconductor wafer W is pressed against the polishing surface 101*a*. At this time, the stretchable and contractible portions 340*a*, 340*b*, 340*c* and 340*d* provided in the elastic membrane 307 are stretched so as to follow upward movement of the chucking plate 6. Therefore, a contact area between a lower surface (contact portion 308) of the elastic membrane 307 and the semiconductor wafer W can be kept constant. Then, the top ring 301 and the polishing table 100 are rotated independently of each other while polishing liquid supply nozzle 102 supplies a polishing liquid Q onto the polishing surface 101*a*. The polishing liquid Q is held on the polishing surface 101*a* of the polishing pad 101, and the semiconductor wafer W is polished in presence of the polishing liquid Q between a (lower) surface, to be polished, of the semiconductor wafer W and the polishing pad 101.

In the present embodiment, even if the pressure of the pressurized fluid is small, the pressure chambers 322, 323, 324 and 325 can be expanded sufficiently. Therefore, it is possible to press the semiconductor wafer W under a small pressing force. Accordingly, in a case where a semiconductor wafer having a low-k material, which has a low dielectric constant and a low hardness, as an interlayer insulator film for Cu interconnections is polished, the semiconductor wafer is polished without causing damage to the low-k material.

With the above structure, since the semiconductor wafer W is polished while the retainer ring 3 is being held in sliding contact with the polishing surface 101*a*, the retainer ring 3 is worn with time. Thus, a distance between the lower surface of the chucking plate 6 and the semiconductor wafer W becomes small. In a conventional substrate holding apparatus, when a distance between a chucking plate and a semiconductor wafer becomes small, a contact area between an elastic membrane and the semiconductor wafer is changed, thus causing a change in a polishing profile. According to the present embodiment, even in such a situation, the stretchable and contractible portions 340*a*, 340*b*, 340*c* and 340*d* are contracted upwardly as the retainer ring 3 is worn, thus allowing the contact area between the semiconductor wafer W and the elastic membrane 307 (the contact portion 308) to be kept constant. Therefore, it is possible to prevent a polishing profile from being changed.

Although an integrally formed elastic membrane is employed in the present embodiment, the present invention is not limited to such elastic membrane. An elastic membrane having a plurality of separate portions divided by a circumferentially extending slit formed in a contact portion may be employed. In this case also, the contact area between the semiconductor wafer and the elastic membrane (the contact portion) can be kept constant by providing the stretchable and contractible portions described above. Therefore, it is possible to obtain a uniform polishing rate over an entire polished surface of a semiconductor wafer.

Local areas of the semiconductor wafer W that are positioned beneath the pressure chambers 322, 323, 324 and 325 are pressed against the polishing surface 101*a* of the polishing pad 101 under pressures of pressurized fluids supplied to the pressure chambers 322, 323, 324 and 325. Therefore, the pressures of the pressurized fluids supplied to the pressure chambers 322, 323, 324 and 325 are controlled independently of each other, so that the entire surface of the semiconductor wafer W can be pressed against the polishing pad 101 under a uniform pressing force. As a result, a uniform polishing rate can be obtained over the entire surface of the semiconductor wafer W. In the same manner, regulator R2 regulates the pressure of the pressurized fluid supplied to the pressure chamber 321 so as to change a pressing force applied to the polishing pad 101 by the retainer ring 3. In this manner, during polishing, the pressing force applied to the polishing pad 101 by the retainer ring 3 and pressing forces applied by the respective pressure chambers 322, 323, 324 and 325 to press the semiconductor wafer W against the polishing pad 101 are appropriately adjusted so as to control the polishing profile of the semiconductor wafer W.

As described above, the pressing force applied by the top ring air cylinder 111 to press the retainer ring 3 against the polishing pad 101 and the pressing forces applied by the pressurized fluids supplied to the pressure chambers 322, 323, 324 and 325 to press the semiconductor wafer W against the polishing pad 101 are appropriately adjusted to polish the semiconductor wafer W. When polishing of the semiconductor wafer W is finished, supply of the pressurized fluids into the pressure chambers 322, 323, 324 and 325 is stopped, and the pressures in the pressure chambers 322, 323, 324 and 325 are reduced to atmospheric pressure. Then, pressurized fluid is supplied to the pressure chamber 321 to move the chucking plate 6 downwardly for thereby bringing the contact portion 308 into uniformly intimate contact with the upper surface of the semiconductor wafer W. In this state, the semiconductor wafer W is attracted again to the lower end of the top ring 301 under vacuum. Immediately thereafter, atmospheric pressure or a negative pressure is produced in the pressure chamber 321. This is because if the pressure chamber 321 is maintained at a high pressure, then the semiconductor wafer W is locally pressed against the polishing surface 101*a* by the lower surface of the chucking plate 6.

After attraction of the semiconductor wafer W in a manner as described above, the top ring 301 as a whole is moved to a transfer position where the semiconductor wafer W is transferred, and vacuum attraction through the holes or recesses (not shown) formed in the lower portion of the pressure chamber 323 or the pressure chamber 324 is stopped. Then, the pressure chambers 322, 323, 324 and 325 are supplied with a pressurized fluid having a predetermined pressure, which is ejected through the holes or recesses to the semiconductor wafer W, thereby releasing the semiconductor wafer W.

The polishing liquid Q used to polish the semiconductor wafer W tends to flow into the small gap G between the outer circumferential surface of the elastic membrane 307 and the retainer ring 3. If the polishing liquid Q is firmly deposited on the outer circumferential surface of the elastic membrane 307 and the retainer ring 3, then the holder ring 5, the chucking plate 6, the elastic membrane 307, and the like are prevented from smoothly moving vertically with respect to the top ring body 2 and the retainer ring 3. In order to avoid such a drawback, a cleaning liquid such as pure water is supplied through the fluid passage 30 to the annular cleaning liquid passage 51. Accordingly, the cleaning liquid is supplied through the plurality of the communication holes 53 to a space above the gap G, thus washing out the polishing liquid Q in the gap G to prevent the polishing liquid Q from being firmly deposited in the gap G. The cleaning liquid is preferably supplied after polished semiconductor wafer W is released and until a next semiconductor wafer to be polished is attracted to the top ring 301.

Figure 23A:
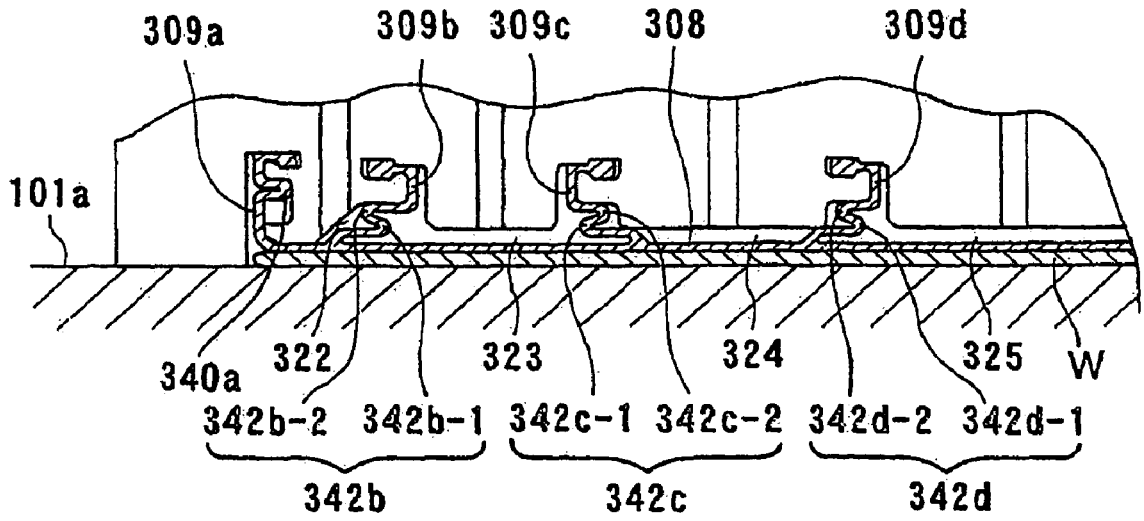
FIG. 23A is a view showing a part of a top ring according to a fourteenth embodiment of the present invention.
Figure 23B:
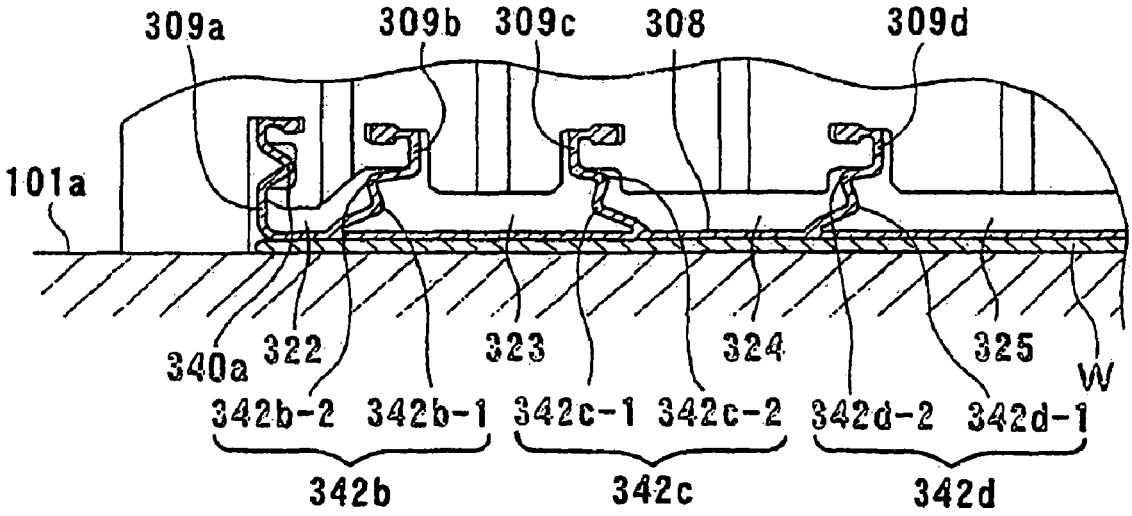
FIG. 23B is a view showing a state in which a fluid is supplied to pressure chambers.

A top ring serving as a substrate holding apparatus according to a fourteenth embodiment of the present invention will be described below with reference to FIGS. 23A and 23B. FIG. 23A is a view showing a part of the top ring according to the fourteenth embodiment of the present invention, and FIG. 23B is a view showing a state in which a fluid is supplied to pressure chambers. In order to simplify these figures, structural details other than an elastic membrane are schematically illustrated in FIGS. 23A and 23B. Structural details of the substrate holding apparatus according to the fourteenth embodiment of the present invention which will not be described below are identical to those of the substrate holding apparatus according to the thirteenth embodiment of the present invention.

As shown in FIG. 23A, second circumferential wall 309*b* has a stretchable and contractible portion 342*b* which is stretchable and contractible vertically. The stretchable and contractible portion 342*b* comprises two folded-back portions 342*b*-1, 342*b*-2 positioned near a lower end of the second circumferential wall 309*b*. The folded-back portion 342*b*-1 projects radially inwardly, and the folded-back portion 342*b*-2 projects radially outwardly. Third circumferential wall 309*c* and the fourth circumferential wall 309*d* also have stretchable and contractible portions 342*c*, 342*d*, respectively, which are stretchable and contractible vertically. The stretchable and contractible portion 342*c* comprises two folded-back portions 342*c*-1, 342*c*-2 positioned near a lower end of the third circumferential wall 309*c*. The folded-back portion 342*c*-1 projects radially outwardly, and the folded-back portion 342*c*-2 projects radially inwardly. The stretchable and contractible portion 342*d* comprises two folded-back portions 342*d*-1, 342*d*-2 positioned near a lower end of the fourth circumferential wall 309*d*. The folded-back portion 342*d*-1 projects radially inwardly, and the folded-back portion 342*d*-2 projects radially outwardly.

Since the circumferential walls 309*a*, 309*b*, 309*c* and 309*d* have the stretchable and contractible portions 340*a*, 342*b*, 342*c* and 342*d*, respectively, the circumferential walls 309*a*, 309*b*, 309*c* and 309*d* can be stretched and contracted while contact portion 308 maintains its shape. Specifically, the circumferential walls 309*a*, 309*b*, 309*c* and 309*d* including respective stretchable and contractible portions 340*a*, 342*b*, 342*c* and 342*d* can be stretched uniformly in a vertical direction. Therefore, as shown in FIG. 23B, when a pressurized fluid is supplied to pressure chambers 322, 323, 324 and 325 to move chucking plate 6 (see FIG. 21) upwardly, the stretchable and contractible portions 340*a*, 342*b*, 342*c* and 342*d* are stretched so as to follow movement of the chucking plate 6. Consequently, a contact area between elastic membrane 307 (the contact portion 308) and semiconductor wafer W can be kept constant.

Figure 24A:
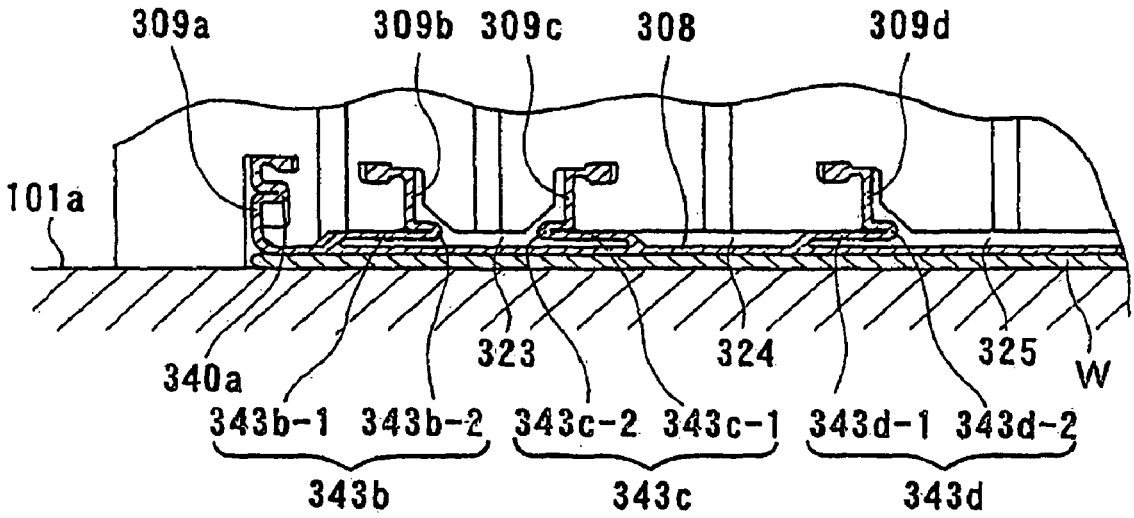
FIG. 24A is a view showing a part of a top ring according to a fifteenth embodiment of the present invention.
Figure 24B:
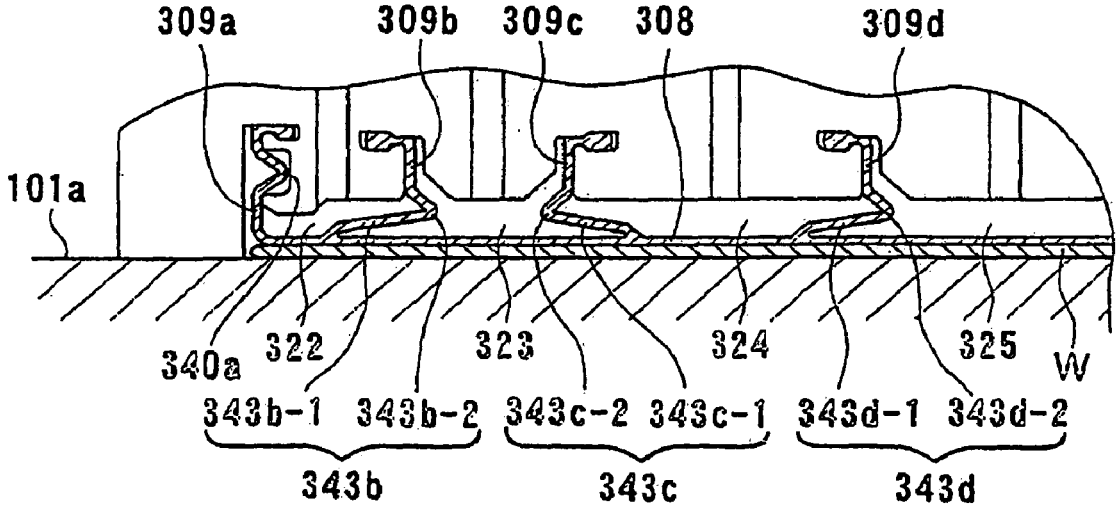
FIG. 24B is a view showing a state in which a fluid is supplied to pressure chambers.

A top ring serving as a substrate holding apparatus according to a fifteenth embodiment of the present invention will be described below with reference to FIGS. 24A and 24B. FIG. 24A is a view showing a part of the top ring according to the fifteenth embodiment of the present invention, and FIG. 24B is a view showing a state in which a fluid is supplied to pressure chambers. In order to simplify these figures, structural details other than an elastic membrane are schematically illustrated in FIGS. 24A and 24B. Structural details of the substrate holding apparatus according to the fifteenth embodiment of the present invention which will not be described below are identical to those of the substrate holding apparatus according to the thirteenth embodiment of the present invention.

As shown in FIG. 24A, second circumferential wall 309*b* has a stretchable and contractible portion 343*b* which is stretchable and contractible vertically. The stretchable and contractible portion 343*b* comprises a horizontal portion 343*b*-1 extending radially outwardly and positioned near a lower end of the second circumferential wall 309*b*, and a folded-back portion 343*b*-2 connected integrally to an inner end of the horizontal portion 343*b*-1 and projecting radially inwardly. Third circumferential wall 309*c* and fourth circumferential wall 309*d* also have stretchable and contractible portions 343*c*, 343*d*, respectively, which are stretchable and contractible vertically. The stretchable and contractible portion 343*c* comprises a horizontal portion 343*c*-1 extending radially inwardly and positioned near a lower end of the third circumferential wall 309*c*, and a folded-back portion 343*c*-2 connected integrally to an outer end of the horizontal portion 343*c*-1 and projecting radially outwardly. The stretchable and contractible portion 343*d* comprises a horizontal portion 343*d*-1 extending radially outwardly and positioned near a lower end of the fourth circumferential wall 309*d*, and a folded-back portion 343*d*-2 connected integrally to an inner end of the horizontal portion 343*d*-1 and projecting radially inwardly.

Since the circumferential walls 309*a*, 309*b*, 309*c* and 309*d* have the stretchable and contractible portions 340*a*, 343*b*, 343*c* and 343*d*, respectively, the circumferential walls 309*a*, 309*b*, 309*c* and 309*d* can be stretched and contracted while the contact portion 308 maintains its shape. Specifically, the circumferential walls 309*a*, 309*b*, 309*c* and 309*d* including respective stretchable and contractible portions 340*a*, 343*b*, 343*c* and 343*d* can be stretched uniformly in a vertical direction. Therefore, as shown in FIG. 24B, when a pressurized fluid is supplied to pressure chambers 322, 323, 324 and 325 to move chucking plate 6 (see FIG. 21) upwardly, the stretchable and contractible portions 340*a*, 343*b*, 343*c* and 343*d* are stretched so as to follow movement of the chucking plate 6. Consequently, a contact area between elastic membrane 307 (the contact portion 308) and semiconductor wafer W can be kept constant.

Figure 25A:
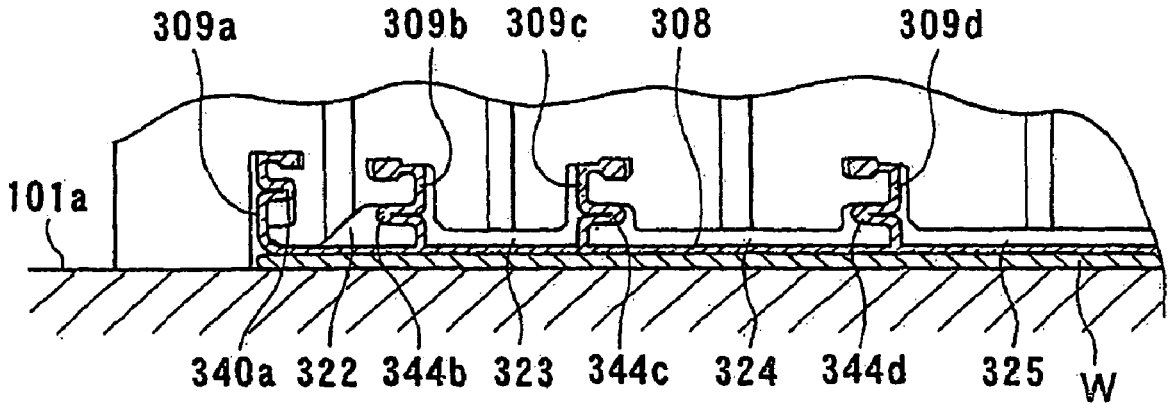
FIG. 25A is a view showing a part of a top ring according to a sixteenth embodiment of the present invention.
Figure 25B:
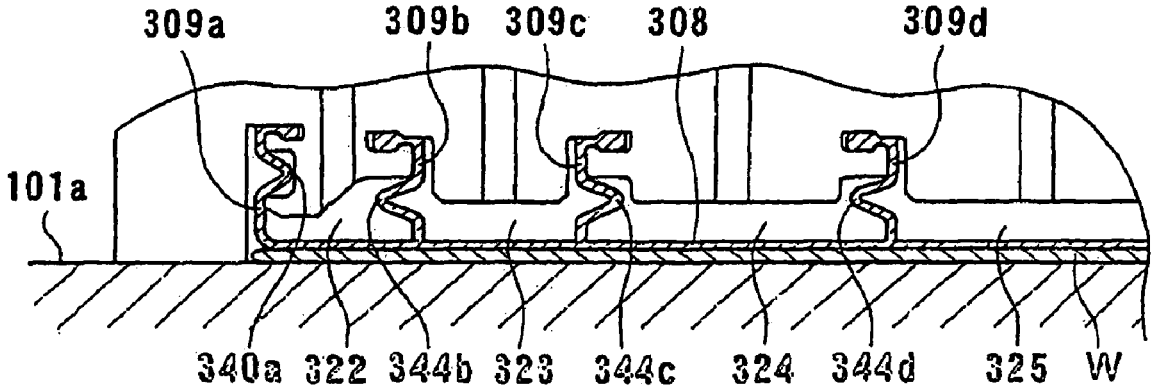
FIG. 25B is a view showing a state in which a fluid is supplied to pressure chambers.

A top ring serving as a substrate holding apparatus according to a sixteenth embodiment of the present invention will be described below with reference to FIGS. 25A and 25B. FIG. 25A is a view showing a part of the top ring according to the sixteenth embodiment of the present invention, and FIG. 25B is a view showing a state in which a fluid is supplied to pressure chambers. In order to simplify these figures, structural details other than an elastic membrane are schematically illustrated in FIGS. 25A and 25B. Structural details of the substrate holding apparatus according to the sixteenth embodiment of the present invention which will not be described below are identical to those of the substrate holding apparatus according to the thirteenth embodiment of the present invention.

As shown in FIG. 25A, second circumferential wall 309*b* has a stretchable and contractible portion 344*b* which is stretchable and contractible vertically. The stretchable and contractible portion 344*b* comprises a folded-back portion projecting radially outwardly and positioned in a substantially central region of the second circumferential wall 309*b*. Third circumferential wall 309*c* and fourth circumferential wall 309*d* also have stretchable and contractible portions 344*c*, 344*d*, respectively, which are stretchable and contractible vertically. The stretchable and contractible portion 344*c* comprises a folded-back portion projecting radially inwardly and positioned in a substantially central region of the third circumferential wall 309*c*. The stretchable and contractible portion 344*d* comprises a folded-back portion projecting radially outwardly and positioned in a substantially central region of the fourth circumferential wall 309*d*.

Since the circumferential walls 309*a*, 309*b*, 309*c* and 309*d* have the stretchable and contractible portions 340*a*, 344*b*, 344*c* and 344*d*, respectively, the circumferential walls 309*a*, 309*b*, 309*c* and 309*d* can be stretched and contracted while contact portion 308 maintains its shape. Specifically, the circumferential walls 309*a*, 309*b*, 309*c* and 309*d* including respective stretchable and contractible portions 340*a*, 344*b*, 344*c* and 344*d* can be stretched uniformly in a vertical direction. Therefore, as shown in FIG. 25B, when a pressurized fluid is supplied to pressure chambers 322, 323, 324 and 325 to move chucking plate 6 (see FIG. 21) upwardly, the stretchable and contractible portions 340*a*, 344*b*, 344*c* and 344*d* are stretched so as to follow movement of the chucking plate 6. Consequently, a contact area between elastic membrane 307 (the contact portion 308) and semiconductor wafer W can be kept constant.

Figure 26A:
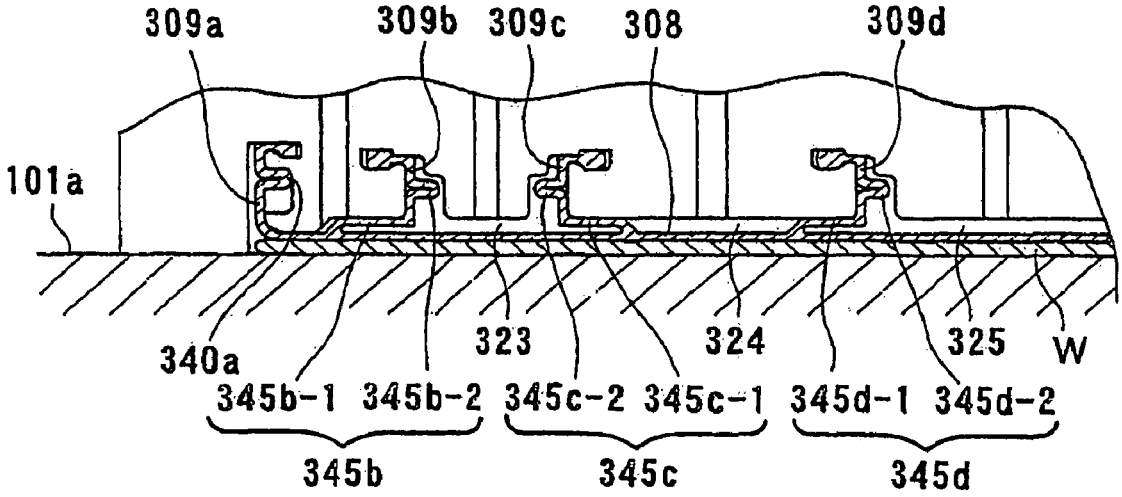
FIG. 26A is a view showing a part of a substrate holding apparatus according to a seventeenth embodiment of the present invention.
Figure 26B:
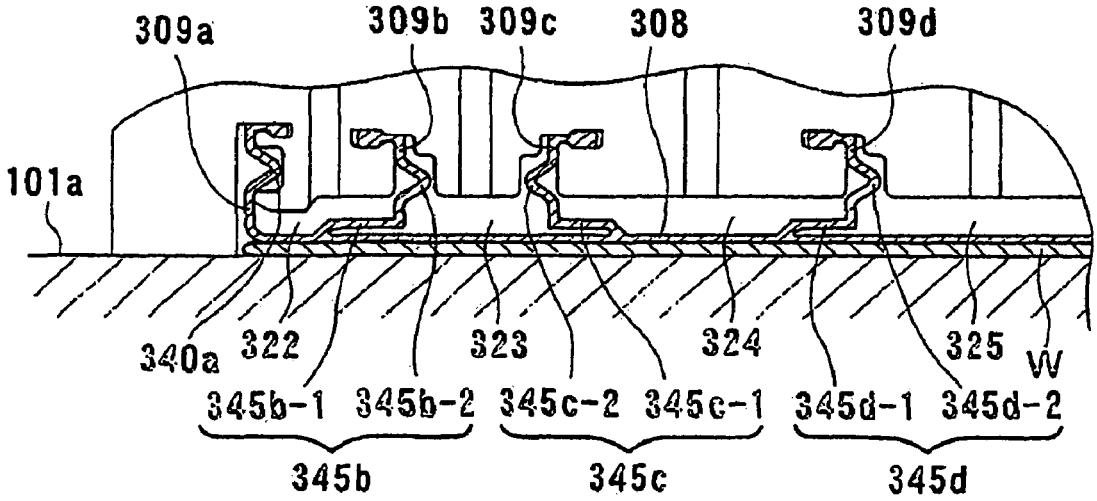
FIG. 26B is a view showing a state in which a fluid is supplied to pressure chambers.

A top ring serving as a substrate holding apparatus according to a seventeenth embodiment of the present invention will be described below with reference to FIGS. 26A and 26B. FIG. 26A is a view showing a part of the top ring according to the seventeenth embodiment of the present invention, and FIG. 26B is a view showing a state in which a fluid is supplied to pressure chambers. In order to simplify these figures, structural details other than an elastic membrane are schematically illustrated in FIGS. 26A and 26B. Structural details of the substrate holding apparatus according to the seventeenth embodiment of the present invention which will not be described below are identical to those of the substrate holding apparatus according to the thirteenth embodiment of the present invention.

As shown in FIG. 26A, second circumferential wall 309*b* has a stretchable and contractible portion 345*b* which is stretchable and contractible vertically. The stretchable and contractible portion 345*b* comprises a horizontal portion 345*b*-1 extending radially outwardly and positioned near a lower end of the second circumferential wall 309*b*, and a folded-back portion 345*b*-2 projecting radially inwardly and positioned in a substantially central region of the second circumferential wall 309*b*. Third circumferential wall 309*c* and fourth circumferential wall 309*d* also have stretchable and contractible portions 345*c*, 345*d*, respectively, which are stretchable and contractible vertically. The stretchable and contractible portion 345*c* comprises a horizontal portion 345*c*-1 extending radially inwardly and positioned near a lower end of the third circumferential wall 309*c*, and a folded-back portion 345*c*-2 projecting radially outwardly and positioned in a substantially central region of the third circumferential wall 309*c*. The stretchable and contractible portion 345*d* comprises a horizontal portion 345*d*-1 extending radially outwardly and positioned near a lower end of the fourth circumferential wall 309*d*, and a folded-back portion 345*d*-2 projecting radially inwardly and positioned in a substantially central region of the fourth circumferential wall 309*d*.

Since the circumferential walls 309*a*, 309*b*, 309*c* and 309*d* have the stretchable and contractible portions 340*a*, 345*b*, 345*c* and 345*d*, respectively, the circumferential walls 309*a*, 309*b*, 309*c* and 309*d* can be stretched and contracted while contact portion 308 maintains its shape. Specifically, the circumferential walls 309*a*, 309*b*, 309*c* and 309*d* including respective stretchable and contractible portions 340*a*, 345*b*, 345*c* and 345*d* can be stretched uniformly in a vertical direction. Therefore, as shown in FIG. 26B, when a pressurized fluid is supplied to pressure chambers 322, 323, 324 and 325 to move chucking plate 6 (see FIG. 21) upwardly, the stretchable and contractible portions 340*a*, 345*b*, 345*c* and 345*d* are stretched so as to follow movement of the chucking plate 6. Consequently, a contact area between elastic membrane 307 (the contact portion 308) and semiconductor wafer W can be kept constant.

Figure 27A:
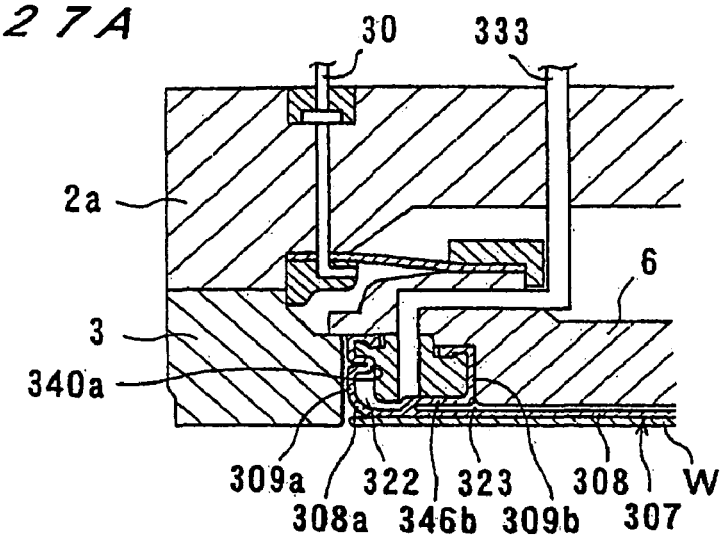
FIG. 27A is an enlarged cross-sectional view showing a part of a first example of a top ring according to an eighteenth embodiment of the present invention.
Figure 27B:
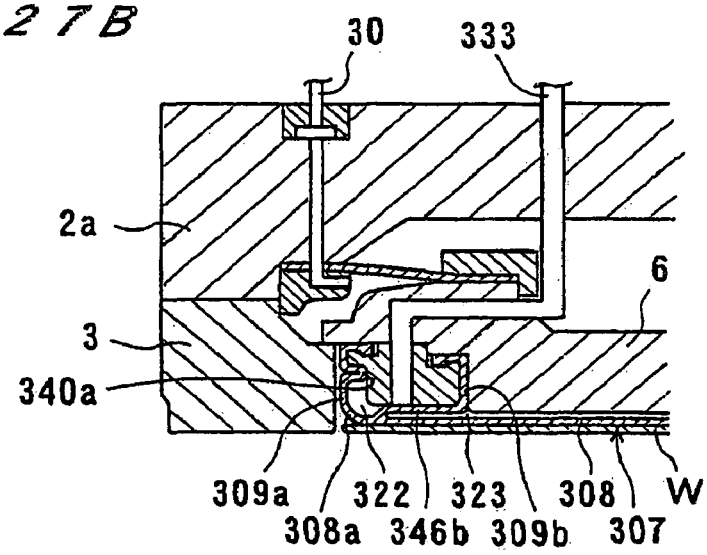
FIG. 27B is an enlarged cross-sectional view showing a part of a second example of a top ring according to the eighteenth embodiment of the present invention.
Figure 27C:
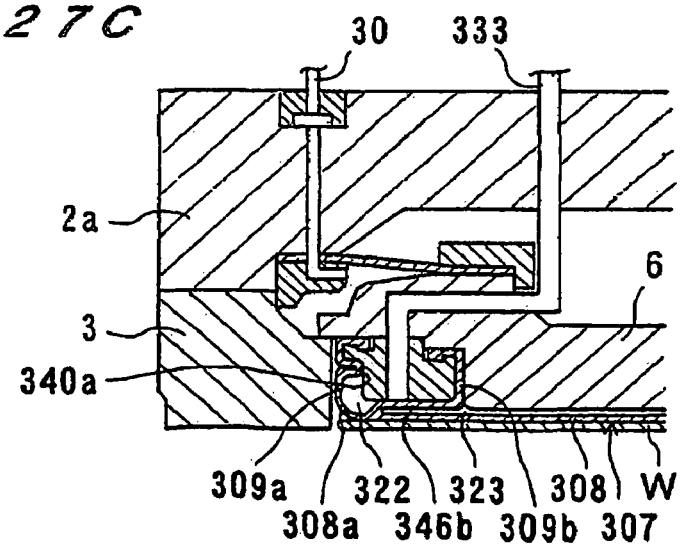
FIG. 27C is an enlarged cross-sectional view showing a part of a third example of a top ring according to the eighteenth embodiment of the present invention.

A top ring serving as a substrate holding apparatus according to an eighteenth embodiment of the present invention will be described below with reference to FIGS. 27A through 27C. FIG. 27A is an enlarged fragmentary cross-sectional view showing a first example of the top ring according to the eighteenth embodiment of the present invention, FIG. 27B is an enlarged fragmentary cross-sectional view showing a second example of the top ring according to the eighteenth embodiment of the present invention, and FIG. 27C is an enlarged fragmentary cross-sectional view showing a third example of the top ring according to the eighteenth embodiment of the present invention. Structural details of the substrate holding apparatus according to the eighteenth embodiment of the present invention which will not be described below are identical to those of the substrate holding apparatus according to the thirteenth embodiment of the present invention.

As shown in FIG. 27A, an upwardly inclined portion 308*a* is formed in an outer circumferential edge of contact portion 308 of elastic membrane 307. The inclined portion 308*a* has a curved cross section. With this structure, even when a pressurized fluid is supplied to pressure chambers 322, 323 so as to lift chucking plate 6, the contact portion 308 of the elastic membrane 307 and an outer circumferential edge of semiconductor wafer W can be kept out of contact with each other. Therefore, the elastic membrane 307 does not apply a pressing force to the outer circumferential edge of the semiconductor wafer W. Consequently, so-called "edge rounding" in which the outer circumferential edge of the semiconductor wafer W is excessively polished is prevented from occurring.

A space between the inclined portion 308*a* and the semiconductor wafer W should preferably be as small as possible because polishing liquid tends to be retained in the space. Accordingly, the inclined portion 308*a* should preferably have a vertical dimension smaller than a horizontal dimension thereof. In the present embodiment, second circumferential wall 309*b* has a stretchable and contractible portion 346*b*. The stretchable and contractible portion 346*b* comprises a horizontal portion extending radially outwardly and positioned near a lower end of the second circumferential wall 309*b*. The second circumferential wall 309*b* may further have a folded-back portion shown in the thirteenth through seventeenth embodiments.

The second example shown in FIG. 27B is different from the first example shown in FIG. 27A in a position of the second circumferential wall 309*b*. Specifically, a lower end of the second circumferential wall 309*b* is positioned closely to first circumferential wall 309*a*, and inclined portion 308*a* extends upwardly from the lower end of the second circumferential wall 309*b*. Therefore, pressure in pressure chamber 323 can be applied to a region of semiconductor wafer W which is located radially inwardly of an outer circumferential edge of the semiconductor wafer W.

The third example shown in FIG. 27C is different from the second example shown in FIG. 27B in a thickness of the inclined portion 308*a*. Specifically, in the third example, the inclined portion 308*a* is thinner than a horizontal portion of contact portion 308. Therefore, when a pressurized fluid is supplied to pressure chamber 322, the inclined portion 308*a* can be easily expanded to press only an outer circumferential edge of semiconductor wafer W against polishing surface 101*a* (see FIG. 1) under a desired pressing force. As a result, a polishing rate at the outer circumferential edge of the semiconductor wafer W can independently be controlled.

Figure 28A:
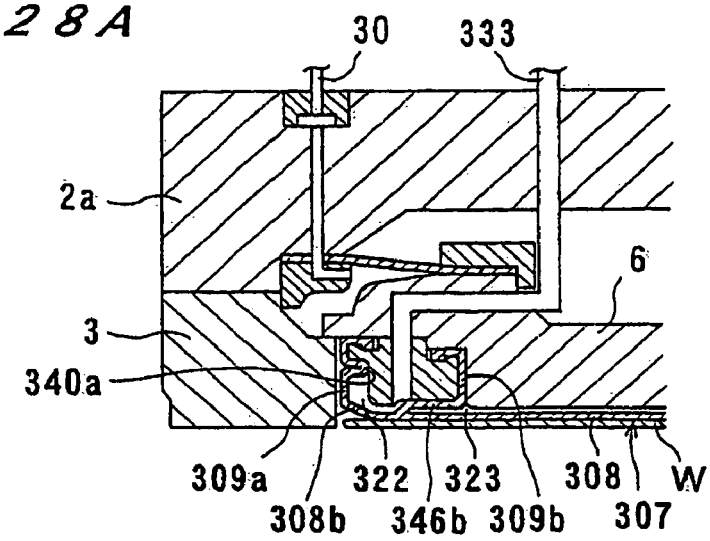
FIG. 28A is an enlarged cross-sectional view showing a part of a first example of a top ring according to a nineteenth embodiment of the present invention.
Figure 28B:
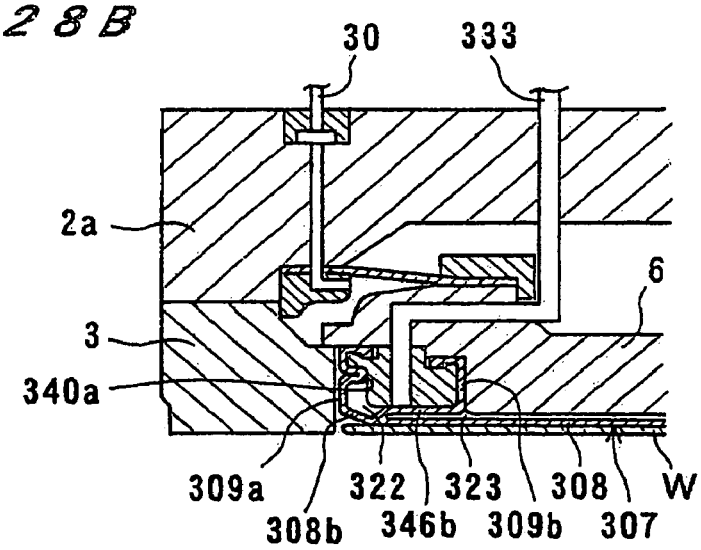
FIG. 28B is an enlarged cross-sectional view showing a part of a second example of a top ring according to the nineteenth embodiment of the present invention.
Figure 28C:
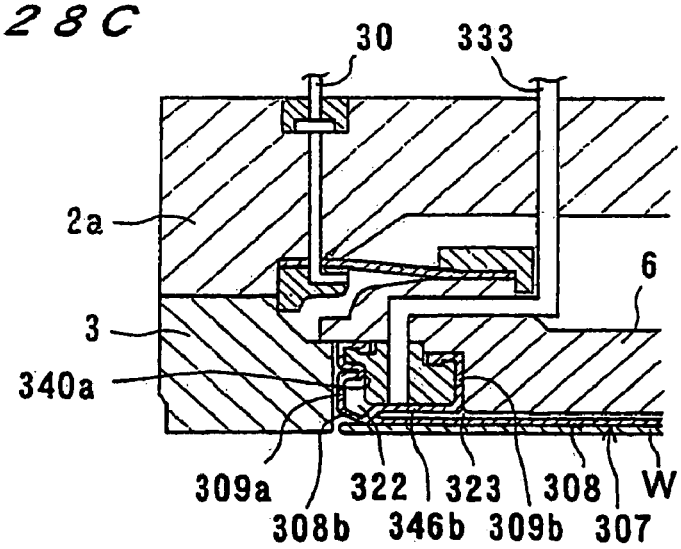
FIG. 28C is an enlarged cross-sectional view showing a part of a third example of a top ring according to the nineteenth embodiment of the present invention.
Figure 29A:
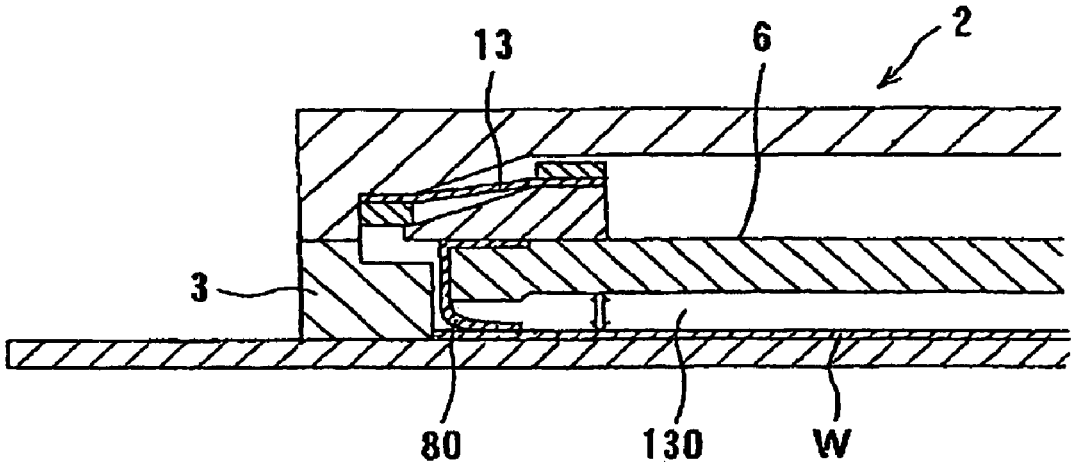
FIG. 29A (Prior Art)
FIGS. 29A and 29B are fragmentary cross-sectional views showing a conventional substrate holding apparatus.
Figure 29B:
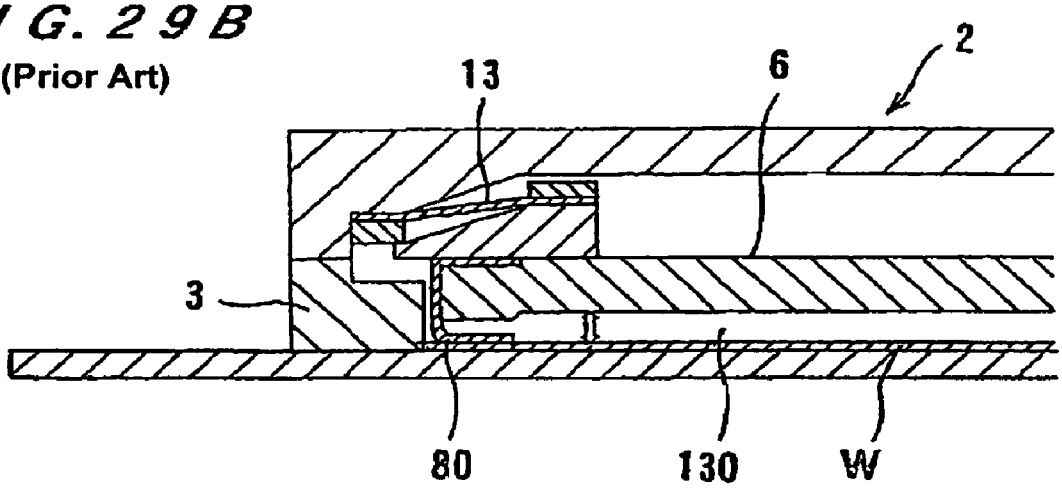
FIG. 29B (Prior Art)

A top ring serving as a substrate holding apparatus according to a nineteenth embodiment of the present invention will be described below with reference to FIGS. 28A through 28C. FIG. 28A is an enlarged fragmentary cross-sectional view showing a first example of the top ring according to the nineteenth embodiment of the present invention, FIG. 28B is an enlarged fragmentary cross-sectional view showing a second example of the top ring according to the nineteenth embodiment of the present invention, and FIG. 28C is an enlarged fragmentary cross-sectional view showing a third example of the top ring according to the nineteenth embodiment of the present invention. Structural details and advantages of the substrate holding apparatus according to the nineteenth embodiment of the present invention which will not be described below are identical to those of the substrate holding apparatus according to the thirteenth and eighteenth embodiments of the present invention.

As shown in FIG. 28A, an upwardly inclined portion 308*b* is formed in an outer circumferential edge of contact portion 308 of elastic membrane 307. The inclined portion 308*b* has a straight cross section. With this structure, even when a pressurized fluid is supplied to pressure chambers 322, 323 to lift chucking plate 6, the contact portion 308 of the elastic membrane 307 and an outer circumferential edge of semiconductor wafer W can be kept out of contact with each other. In order to reduce a space between the inclined portion 308*b* and the semiconductor wafer W, the inclined portion 308*b* should preferably have a vertical dimension smaller than a horizontal dimension thereof.

A lower end of second circumferential wall 309*b* shown in FIG. 28B is positioned closely to first circumferential wall 309*a*. The inclined portion 308*b* extends upwardly from the lower end of the second circumferential wall 309*b*. Therefore, pressure produced in the pressure chamber 323 can be applied to a region of the semiconductor wafer W which is located radially inwardly of the outer circumferential edge of the semiconductor wafer W.

In the third example shown in FIG. 28C, the inclined portion 308*b* is thinner than a horizontal portion of contact portion 308. Therefore, when a pressurized fluid is supplied to pressure chamber 322, the inclined portion 308*b* can be easily expanded to press only an outer circumferential edge of semiconductor wafer W against polishing surface 101*a* (see FIG. 1) under a desired pressing force. As a result, a polishing rate of the outer circumferential edge of the semiconductor wafer W can independently be controlled.

During a polishing process, the lower end of the retainer ring 3 is gradually worn due to sliding contact with the polishing surface 101*a*. Therefore, a distance between the chucking plate 6 and the semiconductor wafer W becomes small, and hence a contact area between the elastic membrane 307 and the semiconductor wafer W is changed. Consequently, the polishing rate tends to be locally changed. In order to prevent such a problem from occurring, it is preferable that the stretchable and contractible portions 340*a* to 340*d*, 341*b* to 341*d*, 342*b* to 342*d*, 343*b* to 343*d*, 344*b* to 344*d*, 345*b* to 345*d*, and 346*b* are stretchable and contractible to a degree greater than an amount of wear on the retainer ring 3. Thus, the stretchable and contractible portions can be contracted upwardly as the retainer ring 3 is worn, thus preventing the polishing rate from being locally changed.

According to the present invention, as described above, since a stretchable and contractible portion is stretched perpendicularly to a polishing surface as fluid is supplied to a pressure chamber, a contact portion of an elastic membrane can maintain its shape. Therefore, a contact area between the elastic membrane (the contact portion) and a substrate can be kept constant, and hence a uniform polishing rate can be obtained over an entire polished surface of the substrate. The stretchable and contractible portion is effective to allow the elastic membrane and the substrate to be kept in sufficient contact with each other. Therefore, it is possible to use an elastic membrane having a high hardness, thus enabling the elastic membrane to be increased in terms of durability. In this case, an elastic membrane having a high hardness can maintain a contact area between the substrate and the elastic membrane (the contact portion), compared to an elastic membrane having a low hardness. Thus, a stable polishing rate can be obtained.

INDUSTRIAL APPLICABILITY

The present invention is applicable to a substrate holding apparatus for holding a substrate to be polished and pressing the substrate against a polishing surface, and more particularly to a substrate holding apparatus for holding a substrate such as a semiconductor wafer in a polishing apparatus for polishing the substrate to a flat finish. The present invention is also applicable to a polishing apparatus having such a substrate holding apparatus.

The invention claimed is:

1. An elastic membrane for use in a substrate holding apparatus, said elastic membrane comprising:

a contact portion to be brought into contact with a substrate;

a first annular circumferential wall extending upwardly from said contact portion, said first annular circumferential wall being located at a circumferential edge of said contact portion and having a first stretchable and contractible portion, said first stretchable and contractible portion including a folded-back portion having an inwardly-folded portion and an outwardly-folded portion extending along a circumferential direction of said first annular circumferential wall; and a second annular circumferential wall extending upwardly from said contact portion, said second annular circumferential wall being located radially inwardly of said first annular circumferential wall and having a second stretchable and contractible portion, said second stretchable and contractible portion including an inwardly-extending portion that is folded so as to extend inwardly from said contact portion along a circumferential direction of said second annular circumferential wall, said inwardly-extending portion being positioned at a lower end of said second annular circumferential wall.

2. The elastic membrane according to claim 1, wherein said first annular circumferential wall has an upper end folded inwardly.

3. The elastic membrane according to claim 1, wherein said second annular circumferential wall has an upper end folded outwardly.

4. The elastic membrane according to claim 1, further comprising:

a third annular circumferential wall extending upwardly from said contact portion.

5. The elastic membrane according to claim 4, further comprising:

a fourth annular circumferential wall extending upwardly from said contact portion.

6. The elastic membrane according to claim 1, wherein said elastic membrane has an integral structure as a one-piece member.

7. The elastic membrane according to claim 1, wherein said first stretchable and contractible portion and said second stretchable and contractible portion are configured to be stretchable and contractible to a degree greater than an amount of wear on a retainer ring of the substrate holding apparatus.

8. The elastic membrane according to claim 1, wherein said second stretchable and contractible portion further includes an outwardly-folded portion.

9. The elastic membrane according to claim 1, wherein said contact portion has a rounded-edge shape at the circumferential edge thereof.

10. An elastic membrane for use in a substrate holding apparatus, said elastic membrane comprising:

a contact portion to be brought into contact with a substrate;

a first annular circumferential wall extending upwardly from said contact portion, said first annular circumferential wall being located at a circumferential edge of said contact portion and having a first stretchable and contractible portion, said first stretchable and contractible portion including a folded-back portion having an inwardly-folded portion and an outwardly-folded portion extending along a circumferential direction of said first annular circumferential wall; and a second annular circumferential wall extending upwardly from said contact portion, said second annular circumferential wall being located radially inwardly of said first annular circumferential wall and having a second stretchable and contractible portion, said second stretchable and contractible portion including a horizontal portion that is folded inwardly from said contact portion along a circumferential direction of said second annular circumferential wall, said horizontal portion being positioned at a lower end of said second annular circumferential wall.

11. The elastic membrane according to claim 10, further comprising:

a third annular circumferential wall extending upwardly from said contact portion; and a fourth annular circumferential wall extending upwardly from said contact portion.

12. An elastic membrane for use in a substrate holding apparatus, said elastic membrane comprising:

a contact portion to be brought into contact with a substrate;

a first annular circumferential wall extending upwardly from said contact portion, said first annular circumferential wall having a first stretchable and contractible portion and having a first upper folded portion that is folded inwardly at an upper end of said first annular circumferential wall, said first annular circumferential wall being located at a circumferential edge of said contact portion, said first stretchable and contractible portion including a first folded-back portion having an inwardly-folded portion and an outwardly-folded portion extending along a circumferential direction of said first annular circumferential wall, said first folded-back portion being positioned between said first upper folded portion and said contact portion; and a second annular circumferential wall extending upwardly from said contact portion, said second annular circumferential wall having a second stretchable and contractible portion and having a second upper folded portion that is folded outwardly at an upper end of said second annular circumferential wall, said second annular circumferential wall being located radially inwardly of said first annular circumferential wall, said second stretchable and contractible portion including a second folded-back portion having an inwardly-folded portion and an outwardly-folded portion extending along a circumferential direction of said second annular circumferential wall, said second folded-back portion being positioned between said second upper folded portion and said contact portion.

13. The elastic membrane according to claim 12, further comprising:

a third annular circumferential wall extending upwardly from said contact portion; and a fourth annular circumferential wall extending upwardly from said contact portion.

14. The elastic membrane according to claim 12, wherein said elastic membrane has an integral structure as a one-piece member.

15. An elastic membrane for use in a substrate holding apparatus, said elastic membrane comprising:

a contact portion to be brought into contact with a substrate;

a first annular circumferential wall extending upwardly from said contact portion, said first annular circumferential wall being located at a circumferential edge of said contact portion and having a first stretchable and contractible portion, said first stretchable and contractible portion including a first folded-back portion having an inwardly-folded portion and an outwardly-folded portion extending along a circumferential direction of said first annular circumferential wall;

a second annular circumferential wall extending upwardly from said contact portion, said second annular circumferential wall being located radially inwardly of said first annular circumferential wall and having a second stretchable and contractible portion, said second stretchable and contractible portion including a second folded-back portion having an inwardly-folded portion and an outwardly-folded portion extending along a circumferential direction of said second annular circumferential wall;

a third annular circumferential wall extending upwardly from said contact portion, said third annular circumferential wall being located radially inwardly of said second annular circumferential wall and having a third stretchable and contractible portion, said third stretchable and contractible portion including a third folded-back portion having an inwardly-folded portion and an outwardly-folded portion extending along a circumferential direction of said third annular circumferential wall; and a fourth annular circumferential wall extending upwardly from said contact portion, said fourth annular circumferential wall being located radially inwardly of said third annular circumferential wall and having a fourth stretchable and contractible portion, said fourth stretchable and contractible portion including a fourth folded-back portion having an inwardly-folded portion and an outwardly-folded portion extending along a circumferential direction of said fourth annular circumferential wall, wherein said elastic membrane has an integral structure as a one-piece member.

16. An elastic membrane for use in a substrate holding apparatus, said elastic membrane comprising:

a contact portion to be brought into contact with a substrate;

a first annular circumferential wall extending upwardly from said contact portion, said first annular circumferential wall being located at a circumferential edge of said contact portion and having a first stretchable and contractible portion, said first stretchable and contractible portion including a first folded-back portion having an inwardly-folded portion and an outwardly-folded portion extending along a circumferential direction of said first annular circumferential wall;

a second annular circumferential wall extending upwardly from said contact portion, said second annular circumferential wall being located radially inwardly of said first annular circumferential wall and having a second stretchable and contractible portion, said second stretchable and contractible portion including a second folded-back portion having an inwardly-folded portion and an outwardly-folded portion extending along a circumferential direction of said second annular circumferential wall;

a third annular circumferential wall extending upwardly from said contact portion, said third annular circumferential wall being located radially inwardly of said second annular circumferential wall and having a third stretchable and contractible portion, said third stretchable and contractible portion including a third folded-back portion having an inwardly-folded portion and an outwardly-folded portion extending along a circumferential direction of said third annular circumferential wall; and a fourth annular circumferential wall extending upwardly from said contact portion, said fourth annular circumferential wall being located radially inwardly of said third annular circumferential wall and having a fourth stretchable and contractible portion, said fourth stretchable and contractible portion including a fourth folded-back portion having an inwardly-folded portion and an outwardly-folded portion extending along a circumferential direction of said fourth annular circumferential wall, wherein said first annular circumferential wall, said second annular circumferential wall, said third annular circumferential wall and said fourth annular circumferential wall extend upwardly from different locations of said contact portion.

17. The elastic membrane according to claim 16, wherein said third annular circumferential wall further includes an outwardly-extending portion that is folded outwardly from said contact portion along the circumferential direction of said third annular circumferential wall, and said outwardly-extending portion is positioned between said contact portion and said third folded-back portion.

18. The elastic membrane according to claim 17, wherein said fourth annular circumferential wall further includes an inwardly-extending portion that is folded inwardly from said contact portion along the circumferential direction of said fourth annular circumferential wall, and said inwardly-extending portion is positioned between said contact portion and said fourth folded-back portion.

19. The elastic membrane according to claim 16, wherein said contact portion has a plurality of holes at a position between said second annular circumferential wall and said third annular circumferential wall.

20. The elastic membrane according to claim 16, wherein said contact portion has a plurality of holes at a position between said third annular circumferential wall and said fourth annular circumferential wall.

* * * * *